US007049268B2

(12) United States Patent
Sakata et al.

(10) Patent No.: US 7,049,268 B2
(45) Date of Patent: May 23, 2006

(54) HEAT REVERSIBLE RECORDING MEDIUM, HEAT REVERSIBLE RECORDING LABEL, HEAT REVERSIBLE RECORDING MEMBER, IMAGE PROCESSOR AND IMAGE PROCESSING METHOD

(75) Inventors: Yoshiko Sakata, Numazu (JP); Yoshihiko Hotta, Mishima (JP); Hiroki Kuboyama, Mishima (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/004,542

(22) Filed: Dec. 3, 2004

(65) Prior Publication Data

US 2005/0119122 A1 Jun. 2, 2005

Related U.S. Application Data

(63) Continuation of application No. PCT/JP03/07015, filed on Jun. 3, 2003.

(30) Foreign Application Priority Data

Jun. 3, 2002 (JP) ..... 2002-161632

(51) Int. Cl.
*B41M 5/30* (2006.01)

(52) U.S. Cl. ..... 503/201; 503/214

(58) Field of Classification Search ..... 503/201, 503/214

See application file for complete search history.

(56) References Cited

U.S. PATENT DOCUMENTS 5,278,129 A * 1/1994 Watanabe et al. ..... 503/217
5,310,611 A 5/1994 Okabe et al.

FOREIGN PATENT DOCUMENTS

| | | |
|---|---|---|
| JP | 55-154198 | 12/1980 |
| JP | 63-221087 | 9/1988 |
| JP | 63-317385 | 12/1988 |
| JP | 64-14079 | 1/1989 |
| JP | 1-133781 | 5/1989 |
| JP | 2-566 | 1/1990 |
| JP | 2-1363 | 1/1990 |
| JP | 2-3876 | 1/1990 |
| JP | 3-2089 | 1/1991 |
| JP | 3-130188 | 6/1991 |
| JP | 6-48024 | 2/1994 |
| JP | 7-101157 | 4/1995 |
| JP | 8-72416 | 3/1996 |
| JP | 8-127182 | 5/1996 |
| JP | 8-282131 | 10/1996 |
| JP | 10-100547 | 4/1998 |
| JP | 11-115319 | 4/1999 |
| JP | 3003745 | 11/1999 |
| JP | 2000-52662 | 2/2000 |

(Continued)

OTHER PUBLICATIONS

Jul. 22, 2005 Written Opinion in connection with Singapore Patent Application No. 200407125-4.

*Primary Examiner*—Bruce H. Hess
(74) *Attorney, Agent, or Firm*—Cooper & Dunham LLP

(57) ABSTRACT

A heat reversible recording medium includes a heat sensitive layer which comprises a resin and an organic low molecular compound, and has a transparency which is reversibly variable depending on a temperature. The heat sensitive layer has a glass transition temperature change of −10° C. to 5° C., and a transparency temperature width of 30° C. or more.

33 Claims, 26 Drawing Sheets

FOREIGN PATENT DOCUMENTS

| | | |
|---|---|---|
| JP | 2000-71623 | 3/2000 |
| JP | 2000-71624 | 3/2000 |
| JP | 2000-198274 | 7/2000 |
| JP | 2000-256419 | 9/2000 |
| JP | 2001-30633 | 2/2001 |
| JP | 2002-113956 | 4/2002 |

* cited by examiner

FIG. 9A FIG. 9B FIG. 9C
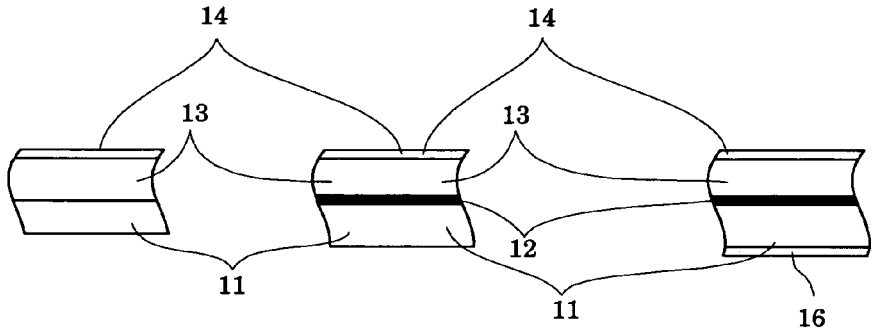
FIG. 10A FIG. 10B
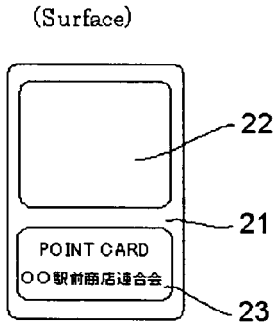
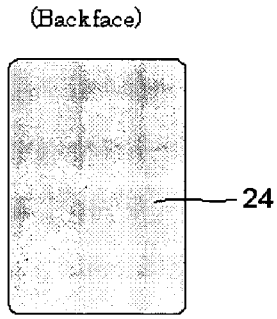

HEAT REVERSIBLE RECORDING MEDIUM, HEAT REVERSIBLE RECORDING LABEL, HEAT REVERSIBLE RECORDING MEMBER, IMAGE PROCESSOR AND IMAGE PROCESSING METHOD

CROSS-REFERENCE TO RELATED APPLICATIONS

This is a continuation of Application No. PCT/JP03/07015, filed on Jun. 3, 2003.

BACKGROUND OF THE INVENTION

1. Field of the Invention

The present invention relates to a heat reversible recording medium which is preferable for such an application as rewritable point card and the like, and is capable of rapidly carrying out forming and deleting an image having an excellent visibility. Moreover, the preset invention relates to a heat reversible recording label, a heat reversible recording member, an image processor and an image processing method using the above heat reversible recording medium.

2. Description of the Related Art

A heat reversible recording medium has a heat sensitive layer having a transparency which is reversibly variable depending on temperature. Moreover, the heat reversible recording medium can carry out forming and deleting of an image at an arbitrary timing with ease. With the above, recently the heat reversible recording medium is rapidly becoming more and more prevalent as a rewritable point card and the like. In the present, from the viewpoint of smaller size and lower cost of a recording apparatus, development of the heat reversible recording medium is so desired that the heat reversible recording medium does not need a specific image deleting unit, is capable of forming and deleting the image only with a thermal head and is capable of overwriting.

Conventionally known as the heat reversible recording medium include, for example, the one having organic low molecular compound such as higher fatty acid and the like dispersed in a resin such as vinyl chloride-vinyl acetate copolymer (refer to Japanese Patent Application Laid-Open (JP-A) No. 55-154198). In the above conventional heat reversible recording medium, however, a temperature width showing transparency (light transmission) (as the case may be, hereinafter referred to as "transparency temperature width") is as narrow as from 2° C. to 4° C., making it uneasy to control temperature when forming the image by using the transparency (light transmission) or whitening property (shading property), which is a problem. For the above problem, a proposal (refer to JP-A No. 2-1363 and JP-A No. 3-2089) is made that uses, as the above organic low molecular compound, a mixture of higher fatty acid and aliphatic dicarboxylic acid, to thereby expand the transparency temperature width to about 20° C., deleting the image (causing transparency). In the above proposal, it is possible to delete the white image (causing transparency) by heating with a heat roller, a heat plate and the like for a comparatively long time. In this case, however, use of the thermal head for heating for a minimum time of several milli seconds may enlarge a temperature distribution in the thickness direction of the heat sensitive layer, thereby a base section which is far from the thermal head cannot be sufficiently heated, failing to sufficiently delete the image, which is a problem.

Another heat reversible recording medium is proposed that is capable of sufficiently deleting the image even when using the thermal head for an overwrite recording. For example, in a heat reversible recording medium (refer to JP-A No. 11-115319), thio ether and aliphatic dibasic acid are contained as the above organic low molecular compound. In this proposal, the transparency temperature width when the heat reversible recording medium is heated for a long time is expanded. In this proposal, however, the minimum heating time of several milli seconds with the thermal head cannot sufficiently delete the image. Moreover, in this proposal, storing the image for a long time at a temperature higher than room temperature with an elapsed time after the image formation may change the deleting energy, making it difficult to delete the image, failing to obtain sufficient deleting property and contrast, which is a problem.

Moreover proposed include a method of containing aliphatic thio ether as an organic low molecular compound (refer to JP-A No. 2000-71623), and a method of containing higher fatty acid ester and aliphatic dibasic acid as an organic low molecular compound (refer to JP-A No. 2000-71624). The above proposals use a resin having sufficiently higher glass transition temperature than a crystallization temperature of the organic low molecular compound. Thereby, heating with the thermal head for a minimum time of several milli seconds cannot sufficiently soften the resin, failing to sufficiently delete the image. Moreover, in the above proposals, storing the image for a long time at a temperature higher than room temperature with an elapsed time after the image formation may change the deleting energy, making it difficult to delete the image, failing to obtain sufficient deleting property and contrast, which is a problem.

On the other hand, a method of containing, as organic low molecular compound, higher fatty acid hydrazide and aliphatic saturated carboxylic acid (refer to JP-A No. 7-101157), and a method of containing, as organic low molecular compound, fatty acid which has fatty acid ester and steroid skeleton (refer to JP-A No. 8-282131). In the above proposals, however, the transparency temperature range is in the high temperature range, thus a sufficient temperature width is not secured. Therefore, use of the thermal head for heating for a minimum time of several milli seconds cannot sufficiently delete the image. Moreover, in the above proposals, storing the image for a long time at a temperature higher than room temperature with an elapsed time after the image formation may change the deleting energy, making it difficult to delete the image, failing to obtain sufficient deleting property and contrast, which is a problem.

Moreover, disposing a temperature slope relieving layer on a surface of a heat sensitive layer is proposed (refer to JP-A No. 2001-30633). In this proposal, however, the heat sensitive layer has a large thickness. Therefore, use of the thermal head for heating for a minimum time of as several milli seconds cannot sufficiently heat the base section of the heat reversible recording medium, specifically, a side not contacting the thermal head, failing to sufficiently carry out forming and deleting of the image. Moreover, in this proposal, storing the image for a long time at a temperature higher than room temperature with an elapsed time after the image formation may change the deleting energy, making it difficult to delete the image, failing to obtain a sufficient deleting property and contrast, which is a problem.

Moreover, a method of mixing a specific cross-linking resin (refer to JP-A No. 8-72416 and JP-A No. 8-127183), and a method of containing a heat sensitive polymer (refer to JP-A No. 10-100547) are proposed. In the above proposed methods, though the image's deleting property can be improved to a certain extent, heating for a minimum time of several milli seconds with a thermal head having fast image-forming rate cannot obtain sufficient deleting property and contrast. Moreover, in the above proposals, storing the image for a long time at a temperature higher than room temperature with an elapsed time after the image formation may change the deleting energy, failing to obtain sufficient deleting property and contrast, which is a problem.

For the purpose of obtaining a heat reversible recording medium free from the above problems, use of resin having a glass transition temperature lower than that of a resin base material is proposed (refer to JP-B No. 3003745). In this case, however, the image's holding property may be insufficient, and storing the image at a temperature higher than room temperature after forming the image may delete the image, failing to obtain a sufficient contrast, which is a problem.

Moreover, decreasing deterioration of the image's deleting property with an elapsed time after the image formation is proposed by using, as a cross-linking agent, a mixture of chain isocyanate compound and cyclic isocyanate compound (refer to JP-A No. 2000-198274). In the above proposal, the image's deleting property with the elapsed time after the image formation is improved by a static deleting method with a hot stamp and the like. Use of the thermal head for heating for a minimum time of several milli seconds cannot improve the image's deleting property, failing to sufficiently delete the image, which is a problem.

Moreover, decreasing the glass transition temperature by blending a low molecular weight polyester resin in a resin base material at a coagulation point 30° C. or less is proposed (refer to JP-A No. 2000-52662 and JP-A No.2002-113956). In the above proposal, however, the low molecular weight polyester resin may move after forming of the image and thereby the image may be deleted, failing to obtain sufficient contrast, moreover, the low molecular weight polyester resin may be deposited, which are problems.

In sum, such a heat reversible recording medium and such a related art using the above heat reversible recording medium are yet to be provided as can sufficiently delete the image even when the image is heated with the thermal head for a minimum time of several milli seconds, can keep, with the elapsed time after the image formation, a sufficient deleting property and a sufficient contrast without changing the deleting energy, and can form the image excellent in storing property, visibility and the like.

OBJECTS AND ADVANTAGES

It is an object of the present invention to solve the conventional problems and accomplish the following object. Specifically, it is an object of the present invention to provide a heat reversible recording medium that has a high processing speed, can sufficiently delete the image even when the image is heated with the thermal head for a minimum time of several milli seconds, can keep, with the elapsed time after the image formation, a sufficient deleting property without changing the deleting energy, and can form the image excellent in storing property, contrast, visibility and the like after being left at rest for a long time at a high temperature. It is another object of the present invention to provide a heat reversible recording label which uses the above heat reversible recording medium and is preferable as various labels, various cards and the like. It is still another object of the present invention to provide a heat reversible recording member which uses the above heat reversible recording medium, and is preferable as disk, disk cartridge, tape cassette and the like.

It is still another object of the present invention to provide an image processor and an image processing method which use the above heat reversible recording medium, have a high processing speed and are capable of forming an image excellent in contrast, visibility and the like.

SUMMARY OF THE INVENTION

According to a first aspect of the present invention, there is provided a heat reversible recording medium.

The heat reversible recording medium of the present invention comprises at least a heat sensitive layer which comprises a resin and an organic low molecular compound, and has a transparency which is reversibly variable depending on temperature. The heat reversible recording medium according to its first embodiment has a glass transition temperature change in the heat sensitive layer of −10° C. to 5° C., and a transparency temperature width of 30° C. or more. The heat reversible recording medium according to its second embodiment has the above resin comprising an acrylic polyol resin, and the heat sensitive layer having a glass transition temperature change of −10° C. to 5° C. The heat reversible recording medium according to its third embodiment has the above resin comprising an acrylic resin, and the heat sensitive layer having a transparency temperature width of 40° C. or more. The heat reversible recording medium according to its fourth embodiment has the above resin comprising an acrylic polyol resin, and the heat sensitive layer having transparency temperature width of 30° C. or more.

With the above heat reversible recording medium, the resin heated to a softening temperature (Ts) thereof or more may be softened, deleting an air gap formed in an interface between the resin and the above organic low molecular compound, resulting in deletion of an image which was formed by the air gap present in the interface between the above resin and the organic low molecular compound. When the heat sensitive layer is cooled to less than the above resin's softening temperature (Ts), the interface between the resin and the organic low molecular compound may be kept free from the air gap and the heat sensitive layer may be kept in a transparent state, thereby deleting the image. On the other hand, when the heat sensitive layer is not cooled but still heated to the organic low molecular compound's melting point (Tm) or more, the organic low molecular compound in the thus heated part may be melt. Thereafter, when the heat sensitive layer is cooled to less than the organic low molecular compound's melting point (Tm), moreover, cooled to less than the resin's softening temperature (Ts), the air gap may be, in the thus cooled part, formed in the interface between the resin and the organic low molecular compound, causing the white state, thus forming the image.

With the heat reversible recording medium according to the first embodiment to the fourth embodiment, at least two selected from the glass transition temperature change, the transparency temperature width and resin type meet the above description. As a result, the image forming to the image deleting is accomplished for a short time, even the minimum-time (several milli seconds)-heating with the thermal head can sufficiently delete the image, sufficient deleting property can be kept with the elapsed time after the image formation due to unchanged deleting energy, and even high temperature rest for a long time can form the image excellent in storing property, contrast, visibility and the like.

According to a second aspect of the present invention, there is provided a heat reversible recording label.

The heat reversible recording label of the present invention has one of an adhesive layer and a viscosity agent layer, on a face opposite to a face which is formed with the image of the heat reversible recording medium of the present invention. With the heat reversible recording label, heating the heat reversible recording medium's part by using the thermal head for a minimum time of several milli seconds can sufficiently delete the image, and the deleting energy may not change with the elapsed time after the image formation, thus keeping sufficient deleting property. Moreover, an image that is excellent in storing property, contrast, visibility and the like can be formed even when the heat reversible recording medium's part of the heat reversible recording label is left at high temperature for a long time. In addition, having one of the adhesive layer and the viscosity agent layer, the heat reversible recording label of the present invention can be applied to various applications such as a thick base plate, a specific example thereof being a magnetic stripe-mounted vinyl chloride card and the like to which direct application of the heat sensitive layer is difficult.

According to a third aspect of the present invention, there is provided a heat reversible recording member.

The heat reversible recording member of the present invention has an information memorizing part and a reversible displaying part, with the reversible displaying part being the heat reversible recording medium of the present invention. With the heat reversible recording member, in the reversible displaying part, a desired image can be formed and deleted at a desired timing. In this case, even when the heating is carried out for a minimum time of several milli seconds with the thermal head can sufficiently delete the image, and the deleting energy may not change with the elapsed time after the image formation, thus keeping sufficient deleting property. Moreover in this case, even a long time leaving at high temperature can form the image that is excellent in storing property, contrast, visibility and the like. On the other hand, in the information recording part, a recording method according to types of card, disk, disk cartridge, tape cassette and the like can record and delete pieces of desired information such as character information, image information, music information, screen image information and the like.

According to a fourth aspect of the present invention, there is provided an image processor.

The image processor of the present invention comprises at least one of an image forming unit and an image deleting unit, where the image forming unit heats the heat reversible recording medium of the present invention to thereby form the image and the image deleting unit deletes the image. In the image processor, the above image deleting unit may heat the heat reversible recording medium of the present invention. When the heat sensitive layer of the heat reversible recording medium is heated to the above resin's softening temperature (Ts) or more, the above resin may be softened in the heat sensitive layer, thus deleting the air gap which was formed in the interface between the resin and the organic low molecular compound. As a result, the image formed by the air gap present in the interface between the above resin and the above organic low molecular compound may be deleted. Then, in this state, the heat sensitive layer may be cooled to less than the above resin's softening temperature (Ts), the interface between the above resin and the above organic low molecular compound may be kept free from the air gap, and the heat sensitive layer may be in a transparent state, thus deleting the image.

On the other hand, the above image forming unit may heat the heat reversible recording medium of the present invention. The heat sensitive layer of the heat reversible recording medium may be heated to the above resin's softening temperature (Ts) or more, moreover, heated to the above organic low molecular compound's melting point (Tm) or more. With this, in the thus heated part, the organic low molecular compound may be melted. Thereafter, the heat sensitive layer may be cooled to less than the above organic low molecular compound's melting point (Tm), moreover, cooled to less than the above resin's softening temperature (Ts). With this, in the thus cooled part, the air gap may be formed in the interface between the above resin and the above organic low molecular compound, thereby causing the white state, and forming the image.

According to a fifth aspect of the present invention, there is provided an image processing method.

The image processing method of the present invention carries out at least one of the image forming and the image deleting by heating the heat reversible recording medium of the present invention. In the image processing method, the heat reversible recording medium of the present invention is heated. When the heat sensitive layer of the heat reversible recording medium is heated to the above resin's softening temperature (Ts) or more, the above resin may be softened in the heat sensitive layer, thus deleting the air gap which was formed in the interface between the resin and the organic low molecular compound. As a result, the image formed by the air gap present in the interface between the above resin and the above organic low molecular compound may be deleted. Then, in this state, the heat sensitive layer may be cooled to less than the above resin's softening temperature (Ts), the interface between the above resin and the above organic low molecular compound may be kept free from the air gap, and the heat sensitive layer may be in the transparent state, thus deleting the image. On the other hand, the heat reversible recording medium of the present invention may be heated to such an extent that the heat sensitive layer of the heat reversible recording medium is heated to the above resin's softening temperature (Ts) or more, moreover, heated to the above organic low molecular compound's melting point (Tm) or more. With this, in the thus heated part, the organic low molecular compound may be melted. Thereafter, the heat sensitive layer may be cooled to less than the above organic low molecular compound's melting point (Tm), moreover, cooled to less than the above resin's softening temperature (Ts). With this, in the thus cooled part, the air gap may be formed in the interface between the above resin and the above organic low molecular compound, thereby causing the white state, and forming the image.

BRIEF DESCRIPTION OF THE DRAWINGS

FIG. 9A is a schematic of a film with a heat sensitive layer and a protective layer disposed on a supporter.

FIG. 9B is a schematic of a film with a reflecting layer, the heat sensitive layer and the protective layer disposed on the supporter.

FIG. 9C is a schematic of a film with the reflecting layer, the heat sensitive layer and the protective layer disposed on the supporter, and a magnetic heat sensitive layer disposed on the supporter's backface.

FIG. 10A is a schematic of a surface side of an example of the heat reversible recording medium of the present invention, which medium is machined in a form of a card.

FIG. 10B is a schematic of a backface of the schematic in FIG. 10A.

Figure 1:
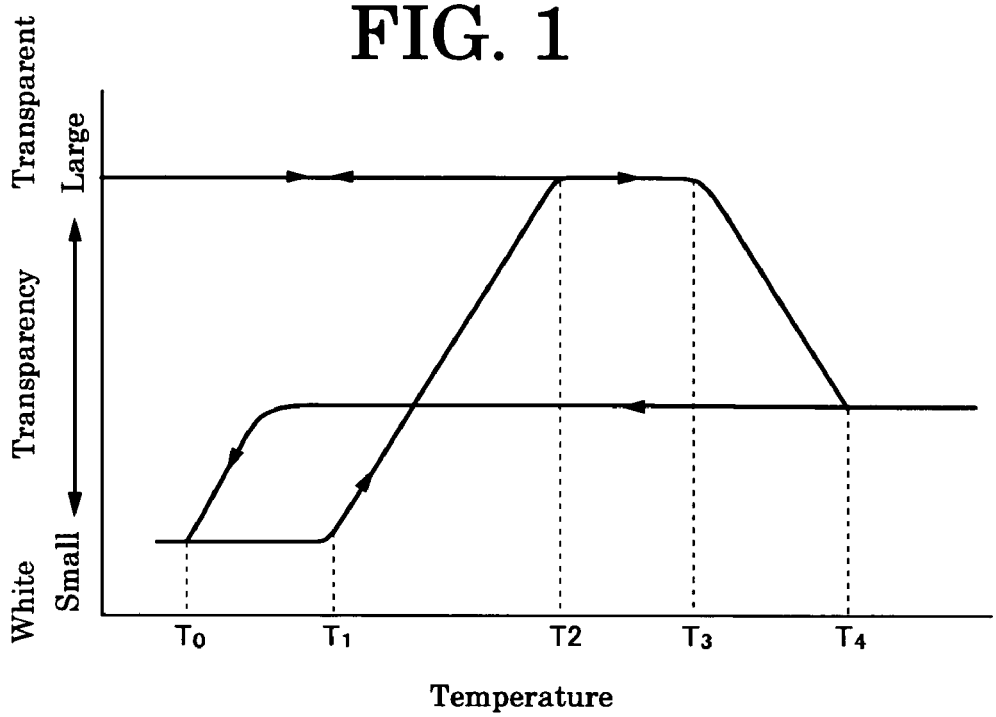
FIG. 1 is a graph showing an example of a temperature relative to a transparency change of a heat reversible recording medium of the present invention.

DESCRIPTION OF THE PREFERRED EMBODIMENTS (Heat Reversible Recording Medium)

The heat reversible recording medium of the present invention comprises at least a heat sensitive layer which comprises a resin and an organic low molecular compound, moreover, other component properly selected when necessary, and has a transparency which is reversibly variable depending on temperature. The heat reversible recording medium of the present invention is preferred to be any of the following first embodiment to fourth embodiment.

According to the first embodiment, the heat sensitive layer has a glass transition temperature change of −10° C. to 5° C., and the transparency temperature width of 30° C. or more. According to the second embodiment, the above resin contains an acrylic polyol resin, and the heat sensitive layer has a glass transition temperature change of −10° C. to 5° C. According to the third embodiment, the above resin contains an acrylic resin, and the heat sensitive layer has a transparency temperature width of 40° C. or more. According to the fourth embodiment, the above resin contains an acrylic polyol resin, and the heat sensitive layer has a transparency temperature width of 30° C. or more.

The heat sensitive layer has a transparency which may reversibly vary, depending on temperature, from a transparent state to a white state (hereinafter, as the case may be, referred to as "opaque state"). The heat reversible recording medium of the present invention forms and deletes an image, by using the transparency change of the heat sensitive layer. In the heat sensitive layer, a mechanism changing the transparency may be inferred, for example, in the following manner. Specifically, in the heat sensitive layer, the above organic low molecular compound is dispersed in the above resin (as the case may be, referred to as "resin base material," "matrix resin") in a form of a particle. When the heat sensitive layer is in "the transparent state," an air gap is not present in an interface between the above the organic low molecular compound (which is dispersed in the above resin in a form of a particle) and the above resin, and thereby an incident light into the heat sensitive layer may transmit without scattering. As a result, the heat sensitive layer becomes "transparent." On the other hand, when the heat sensitive layer is in "the white state," the air gap is present in the interface between the above the organic low molecular compound (which is dispersed in the above resin in a form of a particle) and the above resin, and thereby the incident light into the heat sensitive layer makes a large refraction and a large scattering in an interface between the air gap and the above organic low molecular compound and in an interface between the air gap and the above resin. As a result, the heat sensitive layer may become "white," that is, only a part where the above air gap is present becomes "white," with the other part becoming "transparent," to thereby form a desired image with a contrast between the white and the transparency. Examples of the thus formed "image" herein include a character, a mark, a diagram, a picture, an image, and arbitrary combination thereof, and the like.

Hereinafter described referring to the drawings is forming and deleting of the image in the heat reversible recording medium. FIG. 1 is a graph showing an example of a temperature relative to a transparency change of the heat sensitive layer of the heat reversible recording medium. Herein, the graph in FIG. 1 uses polyester and the like for the above resin, and the above organic low molecular compound is higher alcohol, higher fatty acid and the like. Profile of FIG. 1 may be deformed by changing the material for the above resin, the material for the above organic low molecular compound, and the like.

In FIG. 1, the heat sensitive layer containing the above resin and the organic low molecular compound (dispersed in the resin) may be in a "white" state (opaque), for example, at a normal temperature of "$T_0$" or less. The heat sensitive layer heated from the temperature "$T_1$" may gradually become transparent, and then heated to a temperature "$T_2$" to "$T_3$" may become in a "transparent" state. Even when returned from this "transparent" state again to the normal temperature of "$T_0$" or less, the heat sensitive layer may be kept in the "transparent" state. The above can be described as follows. The above resin may start being softened from about the temperature "$T_1$." Then, with increase in the temperature, the resin in combination with the above organic low molecular compound may expand. In this case, however, the organic low molecular compound has greater expansion than the above resin, thereby the organic low molecular compound may gradually decrease the air gap in the interface between the resin and the organic low molecular compound, resulting in a gradually increased transparency. From the temperature "$T_2$" to the temperature "$T_3$", the above organic low molecular compound may be in a semi-melted state, and then may be in the "transparent" state with the remaining air gap embedded by the organic low molecular compound in the semi-melted state. When the heat sensitive layer is cooled in this state, the above organic low molecular compound may be crystallized at a comparatively high temperature, causing volume change. At this point in time, the above resin is in a softened state, and therefore is capable of following the volume change of the above organic low molecular compound attributable to the crystallization, thus keeping the "transparent" state without causing the air gap in the interface between the organic low molecular compound and the resin.

Moreover, the heat sensitive layer further heated to a temperature "$T_4$" or more may be in a "semi-transparent" state which is a middle between the maximum transparency and the maximum opacity. Then, when this temperature is decreased, the heat sensitive layer may be in the "white" state (opaque), without being in the "transparent" state. That is, after completely melted at the temperature "$T_4$" or more, the above organic low molecular compound may be in too cooled a state, thereby may be crystallized at a temperature slightly higher than the temperature "$T_0$." In this case, the above resin cannot follow the volume change of the above organic low molecular compound attributable to the crystallization, causing the air gap in the interface between the organic low molecular compound and the resin, thus bringing about the "white" state.

As described above, the forming and the deleting of the image of the heat reversible recording medium can be carried out by using the transparency change of the heat sensitive layer from the "transparent" state to the "white" state. For the transparency change of the heat sensitive layer from the "transparent" state to the "white" state, the following elements of the heat sensitive layer are important: glass transition temperature (Tg), glass transition temperature change with elapsed time (ΔTg), transparency temperature width (ΔTw), initial deleting energy width, deleting energy width change ratio with elapsed time, in addition, softening points of the above resin and the above organic low molecular compound in the heat sensitive layer, deformation of the above resin and the above organic low molecular compound in the heat sensitive layer at the softening points or more, and the like.

Glass Transition Temperature (Tg).

The glass transition temperature (Tg) of the heat sensitive layer is not specifically limited, and therefore can be properly selected according to the object, a preferable example thereof including 30° C. to 70° C., and more preferably 30° C. to 50° C.

The glass transition temperature (Tg) less than 30° C. denotes a room temperature (hereinafter denoted by 23° C.±3° C.), and more than 70° C. may decrease repetition durability of the heat sensitive layer.

The glass transition temperature of the heat sensitive layer can be obtained by a curve (DSC=differential scanning calorimetry) of a transition part seen in temperature increase which curve is measured pursuant to JIS K7121 (instituted in 1987, version 1999). In the DSC curve, the glass transition temperature of the heat sensitive layer is defined as an intersecting point of a line longitudinally equidistant from each extended base line with the curve of a stepwise change part of a glass transition temperature. In other words, the above intersecting point is equal to a middle point in the longitudinal direction of the following extrapolated glass transition initial temperature (Tig) and extrapolated glass transition ending temperature (Teg):

Extrapolated Glass Transition Initial Temperature (Tig) is Defined as an Intersecting Point of the Following:

1) the base line extending straightly from the low temperature side to the high temperature side, and 2) the tangent drawn on the point that maximizes the slope of the stepwise change part of the glass transition.

Extrapolated Glass Transition Ending Temperature (Teg) is Defined as an Intersecting Point of the Following:

1) the base line extending straightly from the high temperature side to the low temperature side, and 2) the tangent drawn on the points that maximizes the slope of the stepwise change part of the glass transition.

Herein, when a peak is present on the high temperature side of the stepwise change part, the "extrapolated glass transition ending temperature (Teg)" for obtaining the glass transition temperature is defined as an intersection point of the following:

1) the base line extending straightly from the high temperature side to the low temperature side, and 2) the tangent drawn on the point that maximizes the slope of the curve on the high temperature side.

The glass transition temperature of the heat sensitive layer can be measured, for example, with a DSC measuring apparatus and the like. Specifically, at first, the heat sensitive layer of the heat reversible recording medium is to be peeled. In this case, when the glass transition temperature of the heat sensitive layer is measurable, adhesion of a small amount of the protective layer, adhesive layer and the like to the heat sensitive layer is allowed. Herein, examples of a method of peeling the heat sensitive layer includes the following: When the heat sensitive layer is applied on to an aluminum evaporation layer, a paper file and the like is to be used for removing the layer (such as protective layer) that is applied to an upper part of heat sensitive layer, then, an aluminum evaporate part is to be dissolved with hydrochloric acid or hydrofluoric acid, to thereby obtain the heat sensitive layer in a form of a film. Then, the thus peeled heat sensitive layer is to be put in a DSC measuring cell made of aluminum, to thereby carrying out the measurement.

The above DSC measuring apparatus is not specifically limited, an can be properly selected from those known in the art according to the object, a preferable example thereof including differential thermal layer scanning calorimeter 6200 and the like made by SII. Sample quantity for the DSC measuring apparatus is, in general, about 5 mg, a standard substance is aluminum oxide and the like, temperature increase rate is about 15° C./min. Herein, too small the above sample quantity may increase noise to data, too much the sample quantity may hinder heat conveyance to the entire sample, the above both cases making it difficult to obtain accurate data.

Glass Transition Temperature Change with Elapsed Time (ΔTg)

The glass transition temperature change with elapsed time (ΔTg) of the heat sensitive layer according to the first embodiment and the second embodiment is −10° C. to 5° C. and more preferably −7° C. to 5° C., while according to the third embodiment and the fourth embodiment −10° C. to 5° C. and more preferably −7° C. to 5° C.

When the glass transition temperature change with elapsed time (ΔTg) is within the above range, the glass transition temperature of the heat sensitive layer is less likely to shift to the high temperature side after the elapsed time of image forming, thus bringing about a good deleting property even with the elapsed time after the image formation.

The glass transition temperature change with elapsed time (ΔTg) denotes:

a glass transition temperature with elapsed time after image formation (Tga)

minus an initial glass transition temperature soon after-image formation (TgI).

Herein, the above "the glass transition temperature with elapsed time after image formation (Tga)" is obtained by making the measurement after the heat sensitive layer is stored for 1 week at a temperature 5° C. lower than the glass transition temperature (TgI) of the heat sensitive layer. Specifically, for (TgI) of 40° C., (Tga) is 35° C.

The glass transition temperature change with elapsed time (ΔTg) can be measured, for example, in the following manner. Specifically, at first, a sample of the heat sensitive layer put in a DSC measuring cell is to be heated in a homoiothermal bath for 5 minutes at 130° C. which is sufficiently higher than the softening temperature of the heat sensitive layer, to thereby soften the sample of the heat sensitive layer. Then, the DSC measuring cell including the thus softened sample of the heat sensitive layer is to be taken out of the homoiothermal bath, to be left cooled at room temperature for 2 time, thus making the resin in the heat sensitive layer in a glass state. The glass transition temperature measured by the above method is defined as the "initial glass transition temperature soon after image formation (TgI)."

Herein, soon after the sample of the heat sensitive layer is softened, the resin of the heat sensitive layer is not sufficiently cooled, and thereby the glass transition temperature cannot be accurately measured. Therefore, measurement after rest of 30 minutes at room temperature can obtain an accurate DSC measure data of the "initial glass transition temperature soon after image formation (TgI)." In case that the "initial glass transition temperature soon after image formation (TgI)" cannot be obtained after the rest of 30 minutes at room temperature, the rest time is to be extended to about 3 hours. With this, the above resin of the heat sensitive layer becomes in a stable glass state, to thereby measure the "initial glass transition temperature soon after image formation (TgI)."

When the above rest time is too short, it is difficult to accurately measure the "initial glass transition temperature soon after image formation (TgI)." When above rest time is too long, the above "enthalpy relaxation" phenomenon may be caused, shifting the "initial glass transition temperature soon after image formation (TgI)" to the high temperature. In sum, the rest time is preferably 30 minutes to about 3 hours.

On the other hand, the "glass transition temperature with elapsed time after image formation (Tga)" is defined in the following manner: After heating, the sample of the heat sensitive layer is to be sufficiently cooled at room temperature (23° C.), then, making the measurement after the heat sensitive layer is stored for 1 week at a temperature 5° C. lower than the glass transition temperature (TgI) of the heat sensitive layer. Specifically, for (TgI) of 40° C., (Tga) is 35° C.

Transparency Temperature Width (ΔTw)

The transparency temperature width (ΔTw) is not specifically limited, and therefore can be properly selected according to the object. For example, according to the first embodiment and the fourth embodiment, 30° C. or more is necessary, 40° C. or more is more preferable. Specifying the upper limit, 30° C. to 90° C. is preferable, 40° C. to 90° C. is more preferable, and 40° C. to 80° C. is especially preferable.

According to the second embodiment, 30° C. or more is preferable, 40° C. or more is more preferable, specifying the upper limit, 30° C. to 90° C. is preferable, 40° C. to 90° C. is more preferable, and 40° C. to 80° C. is especially preferable. According to the third embodiment, 40° C. or more is necessary, specifying the upper limit, 40° C. to 90° C. is preferable, 40° C. to 80° C. is more preferable.

The wider the transparency temperature width (ΔTw) is, the more excellent the deleting property and the high speed deleting property are. Even when being heated with the thermal head for a short time, the heat sensitive layer can be caused to have softening temperature or more of the above resin and the above organic low molecular compound, increasing the deleting rate and accomplishing an even deleting. On the other hand, less than 30° C. may decrease the deleting property, making the deleting property with the thermal head insufficient. More than 90° C. may increase the whitening temperature too much, therefore a large energy is to be applied for forming the white image, worsening the thermal head's life and decreasing the durability of the heat reversible recording medium.

The transparency temperature width (ΔTw) is defined the following manner.

Figure 2:
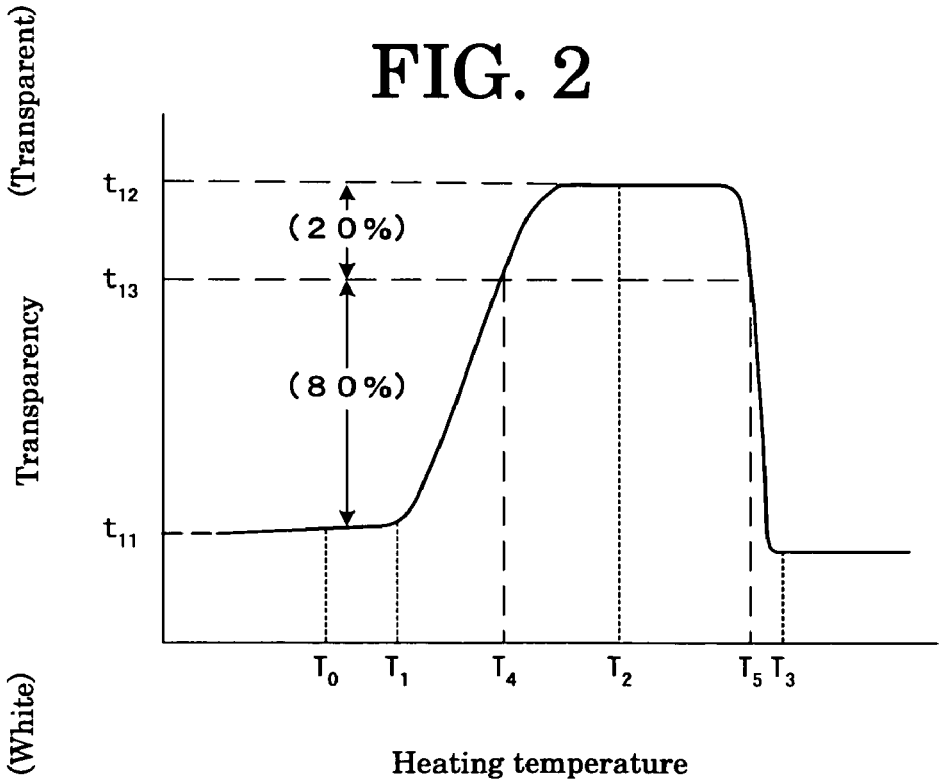
FIG. 2 is a graph showing another example of the temperature relative to the transparency change of the heat reversible recording medium of the present invention.

At first, as is seen in FIG. 2, the heat reversible recording medium is to be heated from temperature $T_1$ to temperature $T_3$ followed by cooling to temperature $T_0$ or less. With this, the transparency of the heat reversible recording medium may vary between the "white" state and the "transparent" state. In FIG. 2, a transparency value (density) $t_{11}$ in the maximum "white" state added by a transparency value (density) which is equivalent to 80% of difference between the transparency value (density) $t_{12}$ in the maximum "transparent" state and the transparency value $t_{11}$ in the maximum "white" state is defined as a transparency value (density) $t_{13}$. A temperature causing a transparency equal to or more than the transparency value (density) $t_{13}$ is defined as the "transparency temperature" which has a range "transparency temperature range ($T_4$ to $T_5$)," with a width thereof defined as "transparency temperature width ($\Delta Tw=T_5-T_4$)."

In this case, when the above transparency value (density) $t_{12}$ in the above maximum "transparent" state is defined as a non-image forming part (in other words, when transparency value (density) of transparent part of a non-heating part is defined as a "texture density,"), the following definition can be made: When the above texture density is higher than the transparency value (density) $t_{12}$ in the density maximum "transparent" state, the "texture density" is defined as the above transparency value (density) $t_{12}$.

The transparency temperature width ($\Delta Tw$) can be measured, for example, in the following manner.

Specifically, at first, the heat reversible recording medium which is not sufficiently in the white state or which is in the transparent state is to be pressed to a sufficiently heated hot plate, otherwise to be heated in a homoiothermal bath, to thereby make the white state. In this case, the heating time is, for example, about 1.0 seconds to 30 seconds when using the hot plate, and about 1 minute to 5 minutes when using the above homoiothermal bath. Herein, to verify that the heating temperature is sufficient for whitening the heat reversible recording medium, reheating is be carried out at a temperature slightly higher than the above heating temperature (for example, 10° C. higher). When the whitening density shows no change before and after the reheating, the temperature before the reheating is sufficient for the above whitening. On the other hand, when the whitening density changes before and after the reheating with whitening density higher after the reheating than before the heating, the temperature before the reheating is still low, and therefore is not sufficient for the above whitening. In this case, the above heating temperature is to be increased for repeating the reheating.

Then, the heat reversible recording medium in the white state is to be heated with a different temperature, to thereby check the temperature for causing transparency to the heat reversible recording medium. For heating the heat reversible recording medium, for example, a heat slope tester (HG- 100 made by TOYO SEIKI KOGYO CO., LTD.) can be preferably used that has five heat blocks. Hereinabove, setting of each block is made in terms of heating time, pressure, heating temperature and the like, and the above heat slope tester is controllable. In this case, the heating is to be carried out with the above heating time set at 1.0 sec., the above pressure set about 1.0 kg/cm$^2$, and the above temperature set stepwise (namely, 1° C. to 5° C. at an equal step) from the low temperature causing no change in the "white" state to the sufficient temperature for the above whitening. For preventing viscosity of the heat reversible recording medium to each of the heat blocks, the heat reversible recording medium may be located on a thin film (10 μm or less) made of polyimide or polyamide.

After carrying out the heating as described above, the heat reversible recording medium is to be cooled to the normal temperature. Then, using a Macbeth RD-914 reflection densitometer (Made by Macbeth), density of the heat reversible recording medium heated at each of heat blocks was measured. Then, as is seen in FIG. 2, the abscissa is defined as the heating temperature (set temperature of the above heat slope tester), while the ordinate is defined as the reflection density (reflection density of the heat reversible recording medium), to thereby plot the above density per temperature, and connect the thus plotted adjacent points with a line, resulting in development of a graph. In this case, when the transparent supporter is used as the heat reversible recording medium, a light absorbing sheet or a light reflecting sheet is to be laid on a backface of the heat reversible recording medium, for measurement of the density.

As is seen in FIG. 2, the graph is usually shaped into a trapezoid. In FIG. 2, "$T_0$" denotes a temperature that does not change the whitening density even when the white image is cooled after being heated at the temperature "$T_0$". "$T_1$" denotes the lowest temperature that changes the whitening density when the white image is cooled at the temperature "$T_1$." "$T_2$" denotes a temperature that shows the transparency value in the maximum "transparent" state when the white image is cooled after being heated at the temperature "$T_2$." "$T_3$" denotes a temperature that shows the transparency value in the maximum "white" state when the white image is cooled after being heated at the "$T_3$."

Initial Deleting Energy Width

The initial deleting energy width is not specifically limited, and therefore can be properly selected according to the object, in general, however, wider initial deleting energy width is better for bringing about more excellent deleting property. For example, 20% to 80% is preferable, 30% to 75% is more preferable, and 40% to 60% is especially preferable.

When the initial deleting energy width is less than 20%, deleting cannot be sufficiently carried out in a short-time heating with the thermal head and the like. When more than 80%, the lower limit of the initial deleting energy width becomes low, worsening the image's heat resistance in the high temperature storage, increasing the upper limit of the initial deleting energy, high energy is to be applied for the white state, easily deteriorating the image by repeated formings and deletings of the image, and decreasing the thermal head's life.

The initial deleting energy width denotes an energy width capable of deleting the white image with the thermal head soon after the white image is formed on the above heat sensitive record material, and is defined in the following manner.

Figure 3:
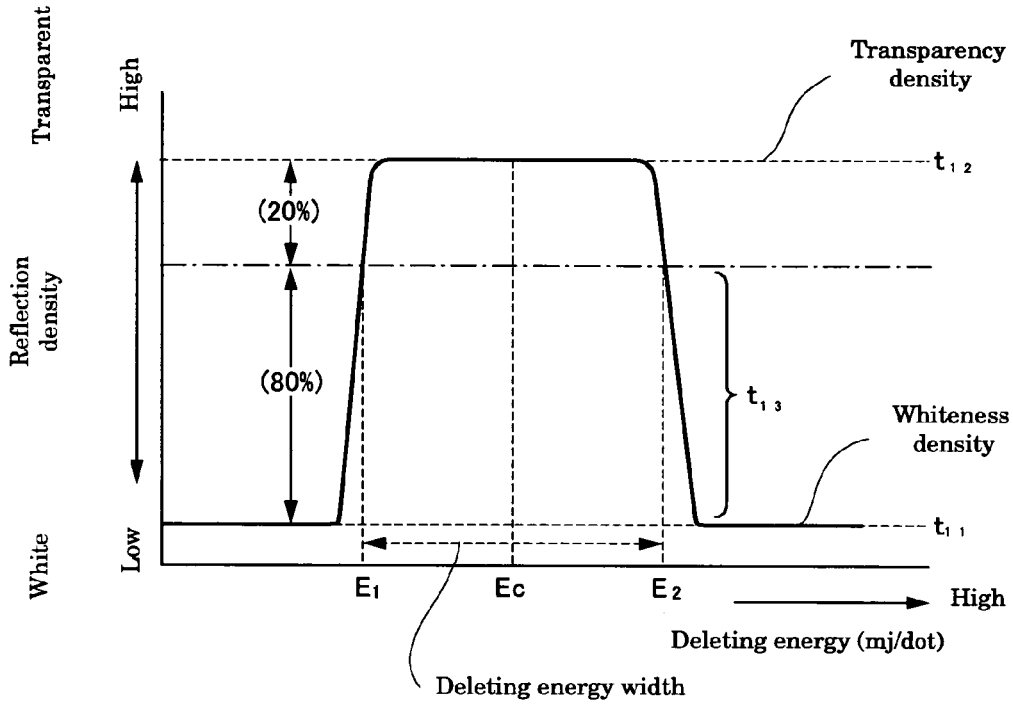
FIG. 3 is a graph showing an example of an applied energy and a deleting energy width relative to a reflection density of the heat reversible recording medium of the present invention.

Specifically, in FIG. 3, a transparency value (density) $t_{11}$ in the maximum "white" state added by a transparency value (density) which is equivalent to 80% of difference between the transparency value (density) $t_{12}$ in the maximum "transparent" state and the transparency value $t_{11}$ in the maximum "white" state is defined as a transparency value (density) $t_{13}$.

An energy causing a transparency which is more than or equal to the transparency value (density) $t_{13}$ is defined as "initial deleting energy," having a range defined as "deleting energy range ($E_1$ to $E_2$)." Moreover, in the above initial deleting energy range ($E_1$ to $E_2$), a center value between the deleting energy lower limit $E_1$ and the deleting energy upper limit $E_2$ is defined as an initial deleting energy center value ($E_c$). Moreover, percentage (%) difference ($E_2-E_1$) between the deleting energy upper limit $E_2$ and the deleting energy lower limit $E_1$ in the initial deleting energy range ($E_1$ to $E_2$), relative to the initial deleting energy center value ($E_c$) in the initial deleting energy range ($E_1$ to $E_2$) is defined as an "initial deleting energy width."

Thus, the initial deleting energy width is expressed by the following equation.

$$\text{Initial deleting energy width (\%)}=[(E_2-E_1)/E_c]\times 100$$

In the above equation, $E_1$ denotes the deleting energy lower limit (mj/dot) in the initial deleting energy range, $E_2$ denotes the deleting energy upper limit (mj/dot) of in the initial deleting energy range, and $E_c$ denotes an initial deleting energy center value $(E_1+E_2)/2$ (mj/dot).

Herein, for the following reason, the initial deleting energy width (%) is specified by ratio relative to the initial deleting energy center value $E_c$. Specifically, when the initial deleting energy width is present in the low energy range, deleting the image with the heating of the thermal head may allow the heat reversible recording medium to be influenced by the environmental temperature change. Moreover, in this case, the heat reversible recording medium has a small temperature distribution between its surface and its backface, thereby the heat energy from the thermal head is unlikely to be stored (to such an extent that heat diffusion of the heat reversible recording medium in the horizontal direction does not cause influence on the adjacent dot zone in the heat reversible recording medium). On the other hand, when the initial deleting energy width is present in the high energy range, the heat reversible recording medium is likely to be influenced by the environmental temperature change. Moreover, in this case, the heat reversible recording medium has a large temperature distribution between its surface and its backface, thereby, the heat energy from the thermal head likely to be stored. As described above, the initial deleting energy width is likely to be influenced by the energy range where the initial deleting energy width is present. For expressing the initial deleting energy width with this influence decreased, it is effective to define the initial deleting energy width as the ratio relative to the center value of the energy.

The initial deleting energy width can be measured, for example, in the following manner. Specifically, at first, a printing tester (made by BeCOM) is to be used for the heat reversible recording medium which is cooled to the room temperature, then the image is to be deleted by heating at an arbitrary energy value using a thermal head (KBE-40 head made by Kyocera Corporation).

The heat reversible recording medium with the image deleted is to be heated and then cooled to the normal temperature. Then, Macbeth RD-914 reflection densitometer (Made by Macbeth) is to be used for measuring the density of the heat reversible recording medium. As is seen in FIG. 3, the abscissa is defined as the deleting energy (mj/dot), while the ordinate is defined as the reflection density (reflection density of the heat reversible recording medium). The above density of each of the deleting energy values is plotted, and adjacent points of the plotting are connected by line, thus developing the graph.

Hereinafter described is a condition for measuring the initial deleting energy width. At first, printing tester has thermal head printing conditions, for example, pulse width 2.94 msec, line frequency 4.2 msec, printing speed 30 mm/sec., and platen roll pressure 2 kg/cm$^2$. Then, the heat reversible recording medium in the "transparent" state is to be heated in advance with an arbitrary energy value, then cooled to the room temperature, to thereby obtain the energy value causing the white saturated density.

Herein, as conditions for deleting and forming the image which is formed on the heat reversible recording medium, the pulse width, the line frequency, and the printing speed are important. As conditions for deleting and forming the image with the thermal head, for example, 19 mm/sec. to 60 mm/sec. is preferable, 25 mm/sec. to 35 mm/sec. is more preferable, as the above line frequency, for example, 2.0 msec to 6.6 msec is preferable, 3.5 msec to 4.5 msec is more preferable, as the above pulse width, for example, 2.0 msec to 5.0 msec is preferable, 2.5 msec to 3.5 msec is more preferable.

Moreover, the thermal head is not specifically limited, and therefore can be properly selected according to the object, for example, those other than an end face head can be used. The thermal head is preferred to have its main scanning density of 8 dot/mm. Moreover, an upper limit energy value of the deleting energy range to be applied to the heat reversible recording medium by the thermal head is preferably 0.8 mJ/dot or less. In this case, high energy is not applied to the heat reversible recording medium, thereby suppressing image deterioration which may be caused by repeated formings and deletings of the image, and suppressing decreased life of the thermal head in the printing apparatus. Herein, the wider deleting energy range is more preferable for better deleting the image by the thermal head.

For widening the initial deleting energy width, the following resin is preferable: Even when the heat sensitive layer gets rapidly softened near the softening point and is heated for a short time with the thermal head and the like, the resin is excellent in heat response and has high viscosity-elasticity at room temperature. In this case, the heat reversible recording medium is capable of having a high contrast, which is advantageous.

For obtaining the above resin, for example, the following two methods can be raised.

In the first method, a steric hindrance structure is to be incorporated in a side chain of the resin. Examples of the steric hindrance structure include straight chain alkyl group, branch alkyl group, and the like. The straight chain alkyl group has the preferable number of carbons of 2 to 20, more preferably 2 to 10, especially preferably 5 to 10. Specific examples of the straight chain alkyl group include butyl group, ethyl hexyl group and the like.

The second method uses the resin made of a material capable of imparting flexibility. Examples of the method using the above material include use of cross-linking agent having a flexible structure, use of plasticizer, and the like. Examples of the above cross-linking agent include those having a chain isocyanate group. Examples of the above plasticizer include phthalic acid plasticizer and the like.

Use of the above resins obtained by the above methods can decrease the energy which is necessary for softening the heat sensitive layer, an can increase the initial deleting energy width. Moreover, even a long term storage can prevent cohesion of high molecule chains, and the above "enthalpy relaxation" phenomenon becomes less likely to be caused, thus decreasing change ratio of the glass transition temperature with the elapsed time after the image formation. On the other hand, with the heat sensitive layer using the resin that is likely to cause the "enthalpy relaxation" phenomenon, the deleting energy may be shifted to the high energy side after a long term storage, elapsed time deleting energy width may become narrow, failing to sufficiently carry out the deleting.

Elapsed Time Deleting Energy Width

The elapsed time deleting energy width is not specifically limited, and therefore can be properly selected according to the object, in general, however, the wider elapsed time deleting energy width can bring about more excellent deleting property, for example, 20% to 80% is preferable, 30% to 75% is more preferable, and 40% to 60% is especially preferable.

When the elapsed time deleting energy width is 20% less than, the short time heating with the thermal head and the like may not sufficiently carry out the deleting. More than 80% may decrease the lower limit of the elapsed time deleting energy width, worsening the image's heat resistance at high temperature storage, increasing the upper limit of the elapsed time deleting energy, high energy is to be applied for making the white state, image deterioration attributable to repeated formings and deletings of the image is likely to be caused, and the thermal head's life is decreased.

After the white image is formed on the above heat sensitive record material, the elapsed time deleting energy width after a long term storage at high temperature can delete the white image with the thermal head. The elapsed time deleting energy width is defined and measured like the initial deleting energy.

Deleting Energy Width Change Ratio with Elapsed Time

The deleting energy width change ratio with elapsed time is not specifically limited, and therefore can be properly selected according to the object, for example, 12% or less is preferable, 10% or less is more preferable, and 7% or less is especially preferable.

When the deleting energy width change ratio with elapsed time is 12% or less, the elapsed time deleting energy width is stable, and after the elapsed time, reflection density as high as that obtained when the image is deleted with the initial deleting energy value can be obtained, the contrast obtained by the image forming and deleting with the same printing apparatus after the elapsed time storage is stable. On the other hand, when the deleting energy width change ratio with elapsed time is more than 12%, use of the same thermal head and the like for carrying out the image deleting with the same deleting energy may not sufficiently delete the image.

The reason therefor is described in the following manner.

Figure 4:
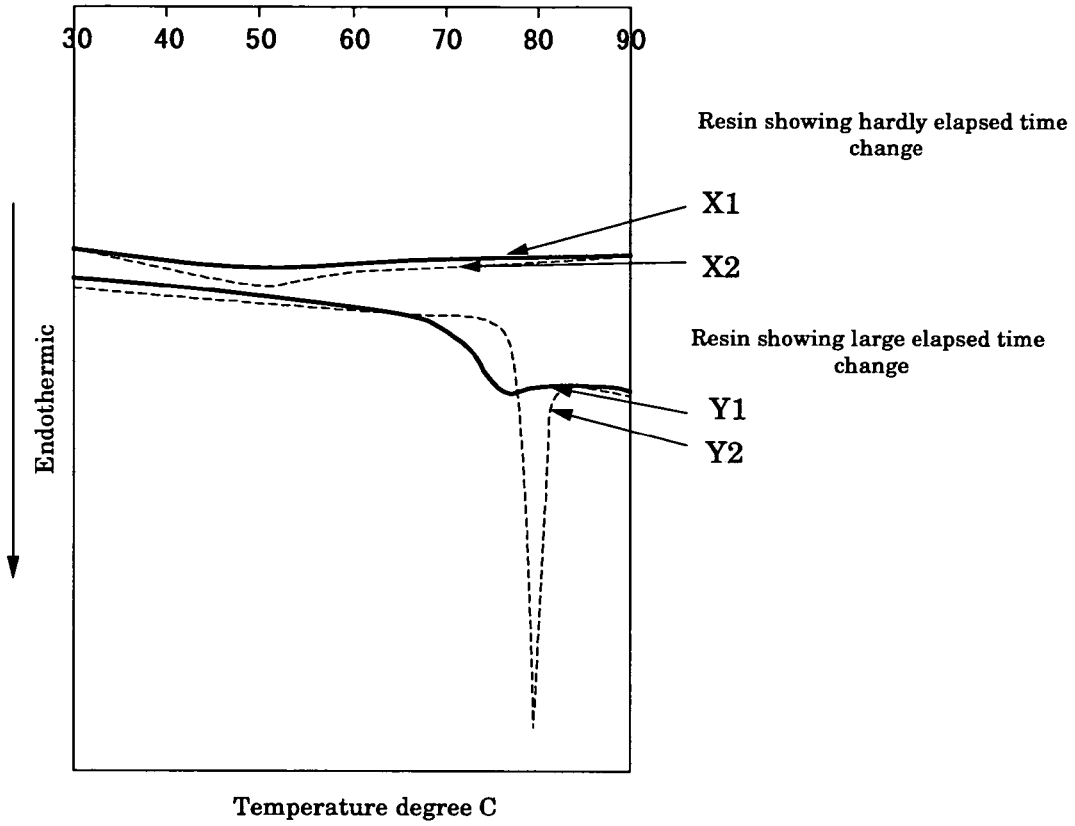
FIG. 4 is a graph showing an enthalpy relaxation measurement by a DSC measurement.

Specifically, as is seen in FIG. 4, the resin (high molecular compound) is, in general, observed in terms of base line change and peak near the glass transition temperature at the temperature increase of the DSC measurement. Herein, the peak is small soon after the rapid quenching after the resin (high molecular compound) is heated. However, after storage at the glass transition temperature or less after the heating of the resin (high molecular compound), a large endothermic peak may be caused to the low temperature side of the glass transition temperature (refer to "Resin showing large elapsed time change" in FIG. 4). In FIG. 4, Y1 denotes DSC curve soon after heating, and Y2 denotes DSC curve with elapsed time. The endothermic peak has its peak area increased according to extension of the storage time. Moreover, according to the extension of the storage time, the glass transition temperature of the above resin (high molecular compound) may be shifted to the high temperature side. Hereafter described is the view of this phenomenon in terms of the heat reversible recording medium: When the heat reversible recording medium is left at rest (storage) for a long time under a high temperature environment after the image (white image) is formed, deleting the image on the heat reversible recording medium by a short time (such as msec order) heating with the thermal head may, in general, decrease the transparent reflection density and the contrast due to fluctuation of the elapsed time deleting energy width. The fluctuation of the elapsed time deleting energy width is interpreted as follows:

Compared with the initial deleting energy width obtained when the image is deleted with the thermal head soon after the image formation, the elapsed time deleting energy width obtained with the elapsed time after the image formation (heat reversible recording medium is left at rest for a long time after the image forming under a high temperature environment) is narrower.

In the elapsed time deleting energy range brought about by the narrowing of the elapsed time deleting energy width, shift of the upper limit of the elapsed time deleting energy range is, in general, not observed on the high energy side, while a large shift (to the high energy side) of the lower limit of the elapsed time deleting energy range is observed on the low energy side.

On the other hand, even after being stored at the glass transition temperature or less after heating, some of the above resins may have a phenomenon which is free from increase of the above peak area or free from the shift (to the high temperature side) of the glass transition temperature (refer to "Resin showing hardly elapsed time change" in FIG. 4). In FIG. 4, X1 denotes DSC curve soon after heating, and X2 denotes DSC curve with elapsed time. The heat sensitive layer using the above resin does not cause the above "enthalpy relaxation" phenomenon of the resin, thereby the deleting energy width change ratio with elapsed time may not become more than 12%, the image deleting property of-the heat reversible recording medium may not change after the long term storage, the image is excellent in deleting property, which are advantageous.

The deleting energy width change ratio with elapsed time denotes an elapsed time change ratio of an energy width capable of deleting the image by heating with the thermal head. The smaller the value thereof is, the smaller the change in the elapsed time deleting energy width with the elapsed time (capable of deleting the image after storing at the softening point or less of the heat sensitive layer after the image formation) is relative to the initial deleting energy width (capable of deleting the image soon after the image formation).

The deleting energy width change ratio with elapsed time can be obtained in the following manner. Specifically, at first, the thermal head is used for forming the image (white image) on the heat sensitive layer, left at rest at 35° C. for 1 week, then the deleting energy width is to be calculated like the above initial energy width, and the thus calculated value is defined as "elapsed time deleting energy width $E_D$." Then, an "initial deleting energy width $E_I$" soon after formation of the above image is to be obtained, and "deleting energy width change ratio with elapsed time (%)" is to be calculated from the following equation.

$$\text{Deleting energy width change ratio with elapsed time (\%)}=[(E_I-E_D)/E_I]100$$

In the above equation, $E_I$ denotes an initial energy width (mj/dot), while $E_D$ denotes an elapsed time energy width (mj/dot).

For making the deleting energy width change ratio with elapsed time of 12% or less, it is preferable that no material property is changed between the heat sensitive layer with the elapsed time after the image formation and the heat sensitive layer soon after the above image formation. As the above resin constituting the heat sensitive layer, the resin free from the "enthalpy relaxation" phenomenon is preferable.

Resin

The above resin is not specifically limited, and therefore can be properly selected according to the object, for example, according to the first embodiment, the resin preferably contains acrylic resin and the like, among the acrylic resins, acrylic polyol resin is especially preferable; according to the third embodiment, the resin is in need of containing acrylic resin, acrylic polyol resin is especially preferable; and according to the second embodiment and the fourth embodiment, the resin is in need of containing acrylic polyol resin.

According to the first embodiment and the third embodiment, the acrylic resin has speedy dryness in the film-forming thus making the heat sensitive layer forming easy. Being synthesized by a radical polymerization, the acrylic resin has a molecule which is easily designed from the viewpoint of controlling refractive index, glass transition temperature, heat reversible recording medium's viscosity-elasticity-and-transparency, and the like. In addition, the deleting energy width, the heat resistance and the like can be improved, the elapsed time change of the deleting energy can be suppressed. The above described features are advantageous. According to the second embodiment and the fourth embodiment, the acrylic polyol resin is more remarkable in terms of the above advantages of the acrylic polyol resin according to the first embodiment and the third embodiment.

The method of verifying that the resin used in the above heat sensitive layer is the acrylic resin or the acrylic polyol resin is not specifically limited. For example, an infrared absorption spectrometry can be used for making a comparison with an absorption pattern of a standard acrylic resin. Especially, the acrylic resin (the acrylic polyol resin) has a characteristic infrared absorption peak. With this, a resin which is determined, through a detection, to have an infrared absorption peak same as that of the acrylic resin (the above acrylic polyol) can be verified that such resin is an acrylic resin (the acrylic polyol resin). Moreover, a copolymer of (meth)acrylic acid ester monomer and other monomer (for example, unsaturated monomer having hydroxyl group) can be detected by peeling or carving the heat sensitive layer only and subjecting it to heat decomposition by a gas chromatograph. Hereinabove, the "(meth)acrylic acid" denotes at least one of "acrylic acid" and "methacrylic acid," which is to be interpreted likewise hereinafter. Subjecting the copolymer to a mass analysis can specify the resinous monomer composition constituting the heat sensitive layer, resulting in verification of the acrylic resin (the acrylic polyol resin).

Herein, the acrylic resin is a copolymerization of (meth) acrylic acid ester monomer and a monomer which is copolymerizable with the former. In the copolymerizing, content of the (meth)acrylic acid ester monomer relative to the total monomer is to be 50% by mass or more.

Examples of the above copolymerizable monomer include unsaturated monomer having carboxyl group, unsaturated monomer having hydroxyl group, other ethylene unsaturated monomer, and the like.

The (meth)acrylic acid ester monomer is not specifically limited, and therefore can be properly selected according to the object, in general, preferable examples thereof including monomer, oligomer and the like used for ultraviolet ray curing resin or electron beam curing resin. Among the above, those having flexible structure are preferable, aliphatic compound is preferable, aromatic compound having chain structure is preferable, moreover, monofunctional monomer to 2-functional monomer are more preferable than 3-functional monomer or more.

Specific examples of the (meth)acrylic acid ester monomer include (meth)acrylic acid alkyl ester having alkyl group, amino (meth)acrylic acid ester having alkyl group, glycol di(meth)acrylic acid ester, allyl (meth)acrylic acid ester, trimethylol propane tri(meth)acrylic acid ester, glycidyl (meth)acrylic acid ester, (meth)acrylonitrile (meth) acrylic acid ester, acrylic amide, diacetone acrylic amide, (meth)acrylonitrile, benzil (meth)acrylic acid ester, dimethyl aminoethyl (meth)acrylic acid ester methyl chloride salt, allyl (meth)acrylate, trimethylol propane tri(meth)acrylate, glycidyl (meth)acrylate, and the like. These can be used alone or in combination of two or more.

The (meth)acrylic acid alkyl ester having the alkyl group is not specifically limited, and therefore can be properly selected according to the object, preferable examples thereof including those having the number of carbons of 1 to 18, more preferably those having the number of carbons of 3 to 15. Specific examples thereof include methyl (meth)acrylic acid ester, ethyl (meth)acrylic acid ester, n-butyl (meth) acrylic acid ester, i-butyl (meth)acrylic acid ester, cyclo hexyl (meth)acrylic acid ester, 2-ethyl hexyl (meth)acrylic acid ester, lauryl (meth)acrylic acid ester, stearyl (meth) acrylic acid ester, and the like.

When the number of carbons of the above alkyl group is too small, the acrylic resin may lack flexibility. When the number of carbons of the above alkyl group is too large, methylene chains of side chain may be regularly arranged thereby lacking flexibility of the acrylic resin.

The amino (meth)acrylic acid ester having the alkyl group is not specifically limited, and therefore can be properly selected according to the object, for example, those having the number of carbons of 1 to 5 is preferable, specifically, dimethyl aminoethyl (meth)acrylic acid ester dimethyl aminoethyl, (meth)acrylic acid ester and the like.

The above glycol di(meth)acrylic acid ester is not specifically limited, and therefore can be properly selected according to the object, for example, ethylene glycol di(meth)acrylic acid ester, butylene glycol di(meth)acrylic acid ester, and the like.

Of the (meth)acrylic acid ester monomers, the (meth) acrylic acid alkyl ester having the alkyl group is preferable in that the acrylic resin has flexibility without causing to the synthesized acrylic resin i) the "enthalpy relaxation" phenomenon, ii) shift of the glass transition temperature to high temperature side, and the like. Among the (meth)acrylic acid alkyl esters having the alkyl group, those having the number of carbons of 1 to 18 are preferable, those having 3 to 15 are more preferable. Specific examples thereof include n-butyl (meth)acrylic acid ester, i-butyl (meth)acrylic acid ester, cyclo hexyl (meth)acrylic acid ester, 2-ethyl hexyl (meth) acrylic acid ester, lauryl (meth)acrylic acid ester, stearyl (meth)acrylic acid ester, and the like.

Moreover, among the (meth)acrylic acid ester monomers, benzil (meth)acrylic acrylate is preferable in that a high refractive index is obtained in the adjustment of the refractive index.

The unsaturated monomer having the above carboxyl group is not specifically limited, and therefore can be properly selected according to the object, for example, (meth)acrylic acid, itaconic acid, monobutyl itaconate, citraconic acid, maleic acid, monomethyl maleate, monobutyl maleate, succinic acid 2-(meth)acryloyloxy ethyl, succinic acid 2-(meth)acryloyloxy propyl, succinic acid 2-(meth) acryloyloxy butyl, maleic acid 2-(meth)acryloyloxy ethyl, maleic acid 2-(meth)acryloyloxy propyl, maleic acid 4-(meth)acryloyloxy butyl, hexahydro phthalic acid 2-methacryloyloxy ethyl, and the like.

These can be used alone or in combination of two or more. Among the above, a long chain carboxylic acid-containing unsaturated monomer, and the like such as hexahydro phthalic acid 2-methacryloyloxy ethyl, succinic acid 2-(meth)acryloyloxy ethyl, and the like are preferable, in that the transparency of the heat reversible recording medium can be improved.

The unsaturated monomer having the above hydroxyl group is not specifically limited, and therefore can be properly selected according to the object, for example, hydroxy alkyl (meth)acrylic acid ester, ϵ-caprolactone adduct of hydroxy alkyl (meth)acrylic acid ester, glycol di(meth)acrylate, and the like. These can be used alone or in combination of two or more.

Examples of the above hydroxy alkyl (meth)acrylic acid ester include 2-hydroxy ethyl (meth)acrylic acid ester, 2-hydroxy propyl (meth)acrylic acid ester, 4-hydroxy butyl (meth)acrylic acid ester, alkyl (meth)acrylic acid ester, and the like. Examples of the above glycol di(meth)acrylate include ethylene glycol di(meth)acrylic acid ester, butylene glycol di(meth)acrylic acid ester, and the like.

The unsaturated monomer having the above hydroxyl group can be preferably used in cross-linking with an after described isocyanate compound, and the structure of the isocyanate compound can be properly selected, thereby imparting flexibility to the heat sensitive layer, which is advantageous. Of the unsaturated monomers having the hydroxyl group, 4-hydroxy butyl (meth)acrylic acid ester is especially preferable, in that it is excellent in cross-linking with polyisocyanate compound and in long term durability.

Hydroxyl value (mgKOH/g, solid calculated value) of the unsaturated monomer having the above hydroxyl group is not specifically limited, and therefore can be properly selected according to the object, for example, 20 mgKOH/g to 130 mgKOH/g is preferable.

The above other ethylene unsaturated monomer is not specifically limited, and therefore can be properly selected according to the object, for example, aromatic vinyl compounds such as styrene, α-methyl styrene, p-methyl styrene, and the like; vinyl acetate; vinyl propionate; and the like. These can be used alone or in combination of two or more. Among the above, styrene is preferable in that a high refractive index is obtained in the adjustment of refractive index.

Among the acrylic resins of the present invention, acrylic polyol resin having the following features is especially preferable: i) using the synthesized (meth)acrylic acid ester monomer 50% by mass or more relative to total monomer, ii) having a plurality of hydroxyl groups, and iii) being cross-linkable by using cross-linking agent such as isocyanate compound and the like.

The glass transition temperature of the acrylic polyol resin is preferably calculated from the following equation (Fox's equation) (hereinafter referred to as "calculated Tg"), 30° C. to 60° C. being preferable, and 40° C. to 50° C. being more preferable.

When the calculated Tg is 30° C. less than, an image's heat resistance of the heat sensitive layer may be worse, as the case may be, the image cannot be sufficiently deleted even when stored at a high temperature (such as room temperature or more). When the calculated Tg is more than 60° C., repeated recordings may be difficult.

The above equation (Fox) can be expressed by an equation $1/Tg=\Sigma (Wi/Tgi)$.

In the above equation, "Tg" denotes the calculated Tg, "Wi" denotes mass ratio of monomer i, and "Tgi" denotes a glass transition temperature Tg (K) of homopolymer of the monomer i.

The hydroxyl value (mgKOH/g, solid calculated value) of the acrylic polyol resin is not specifically limited, and therefore can be properly selected according to the object, for example, 20 mgKOH/g to 130 mgKOH/g is preferable, and 30 mgKOH/g to 80 mgKOH/g is more preferable. When the above hydroxyl value is less than 20 mgKOH/g, the long term durability of the heat sensitive layer may be decreased. When the above hydroxyl value is more than 130 mgKOH/g, the deleting energy width of the heat sensitive layer may not be sufficiently obtained.

The hydroxyl value (mgKOH/g, solid calculated value) of the acrylic polyol resin can be measured, for example, by expressing potassium hydroxide in milligrams that is required for neutralizing an acetic acid which is caused in a reaction for 1 hour at a specified temperature with an acetylating agent.

Otherwise, the hydroxyl value (mgKOH/g, solid calculated value) of the acrylic polyol resin can be calculated with the resin's monomer composition by the following formula ((hydroxyl group×composition ratio)×1000×56.1(KOH))/(hydroxyl group monomer molecular weight×100).

Acid value (AV) of the acrylic polyol resin is not specifically limited, and therefore can be properly selected according to the object, for example, 1 mgKOH/g to 10 mgKOH/g is preferable, and 3 mgKOH/g to 8 mgKOH/g is more preferable. When the above acid value (AV) is less than 1 mgKOH/g, transparency of the heat sensitive layer may improve, while when the above acid value (AV) is more than 10 mgKOH/g, the long term durability may be deteriorated.

The acid value (AV) of the acrylic polyol resin can be measured, for example, in the following manner: A sample is to be dissolved in a mixture of alcohol and toluene, a specified alcoholic potassium solution is to be titrated with phenol phthalein as an indicator, potassium hydroxide required for neutralizing an acid contained in the sample 1 g is to be calculated in mg, and the acid value is to be calculated from the following formula (acid value=A×f×(½)×(56.1/1000)×(1000/sample (g)) (where A denotes consumption (ml) of N/2 alcoholic potassium hydroxide, f denotes titer of N/2 alcoholic potassium hydroxide solution)).

A weight average molecular weight (Mw) of the acrylic polyol resin is not specifically limited, and therefore can be properly selected according to the object, for example, 20,000 to 100,000 is preferable, and 40,000 to 60,000 is more preferable. When the above weight average molecular weight is too low, durability may be deteriorated, and a long time storage may fluctuate deleting property. When the above weight average molecular weight is too high, the deleting energy width for deleting the white image for a short time with a heat energy may become narrow.

The weight average molecular weight (Mw) of the acrylic polyol resin can be measured, for example, with a light scattering method, a GPC apparatus (HLC-8220GPC made by Tosoh Corporation) and the like.

The refractive index of the acrylic polyol resin is not specifically limited, and therefore can be properly selected according to the refractive index and the like with the above organic low molecular compound used for the heat sensitive layer of the heat reversible recording medium, for example, 1.45 to 1.60 is preferable, and 1.48 to 1.55 is more preferable.

The refractive index of the acrylic polyol resin can be measured, for example, with a digital refraction meter (RX-2000 made by ATAGO) and the like of a light refraction critical angle detecting method, and can be calculated from the monomer composition equation. Moreover, the refractive index of the acrylic polyol resin can be calculated with a formula, by using property of a polymer of Synthia method.

Herein, the larger the ratio of the refractive index (of the acrylic polyol resin) relative to the refractive index (of the above organic low molecular compound used for the heat sensitive layer of the heat reversible recording medium) is, the larger the whiteness becomes. Hereinabove, the smaller the ratio is, the more the transparency decrease by the scatter light is prevented. The ratio of about 1 (difference in the above two refractive indexes is small) can improve the deleting property.

The acrylic polyol resin uses the (meth)acrylic acid ester monomer, an unsaturated monomer having the above carboxyl group, an unsaturated monomer having the above hydroxyl group, and the other ethylene unsaturated monomer(s) described above; and can be synthesized by known solution polymerization method, known suspension polymerization method, known emulsification polymerization method and the like. Herein, the method of supplying the above monomers into the polymer system is not specifically limited, and therefore can be properly selected according to the object, including those conventionally known.

From the viewpoint of improving repetition durability of the image (printings-deletings), the acrylic resin is preferred to be cross-linked by using a cross-linking agent. The cross-linking can be carried out, for example, by heat, ultraviolet ray, electron beam and the like. Among the above, the cross-linking by heat and the ultraviolet ray is preferable, in that the cross-linking can be carried out at low cost and with ease, and that the long term storage for curing is unnecessary.

The above cross-linking agent is not specifically limited, and therefore can be properly selected according to the object, for example, preferably, (meth)acrylic monomer, isocyanate compound, and the like. These can be used alone or in combination of two or more. These can be properly synthesized, or may be those commercially available. Among the above, the isocyanate compound is preferable.

Specific examples of the combination of the acrylic resin and the cross-linking agent preferably include (1) a combination of heat plastic resin having acryloyl group or methacryloyl group, with (meth)acrylic monomer; (2) a combination of acrylic resin (acrylic polyol resin) having hydroxyl group, with isocyanate compound; and the like.

There are provided two cross-link methods for the above (1), namely, the combination of the heat plastic resin having the acryloyl group or the methacryloyl group, with the (meth)acrylic monomer.

In the first method, an organic peroxide is to be mixed and heated to thereby cause a radical, then the acryloyl group or the methacryloyl group of the resin is to be reacted with the monomer, thus accomplishing the cross-linking of the resin. In the second method, a light polymerization starter is to be mixed and an ultraviolet ray is to be irradiated to thereby cause a radical, then the acryloyl group or the methacryloyl group of the resin is to be reacted with the monomer, thus accomplishing the cross-linking of the resin. The first method using the organic peroxide is more preferable, in that the heat may act for the cross-linking, and any expensive equipment is unnecessary for the cross-linking.

In the combination (2) of acrylic resin (acrylic polyol resin) having hydroxyl group, with isocyanate compound, polyisocyanate compound having a plurality of isocyanate groups is to be preferably used for the isocyanate compound. Examples of the polyisocyanate compound include: i) trimethylol propane adduct of diisocyanate selected from toluene diisocyanate (TDI), hexamethylene diisocyanate (HDI), xylylene diisocyanate (XDI), and isophorone diisocyanate (IPDI); ii) glycol adduct; iii) lactone ester adduct; iv) ether adduct; v) buret polyisocyanate, isocyanurate bonded-polyisocyanate, block polyisocyanate thereof; and the like.

The above isocyanate compound preferably uses at least a chain isocyanate compound. Mixture of the chain isocyanate compound and the cyclic isocyanate compound is usable, in this case, the heat cross-link is to be preferably carried out.

When the above chain isocyanate compound only is used, in general, the cross-linked resin may get flexible and improve the deleting property while decreasing the repetition durability and the image storing property. On the other hand, when the above cyclic isocyanate compound only is used, in general, the cross-linked resin may get rigid and improve the repetition durability and the image storing property while decreasing the deleting property. With this, use of the mixture of the above chain isocyanate compound and the above cyclic isocyanate compound can compatibly accomplish the deleting property, the durability and the heat resistance.

The above chain isocyanate compound is not specifically limited, and therefore can be properly selected according to the object, examples thereof including, i) those made by directly reacting a chain compound (having hydroxyl group such as diol, triol and the like) with aliphatic isocyanate (such as hexamethylene diisocyanate and the like); and ii) a reactant of the above via a single or a plurality of ethylene oxides, propylene oxides, caprolactones or aliphatic polyester chains.

The weight average molecular weight of the above chain isocyanate compound is not specifically limited, and therefore can be properly selected according to the object, for example, the lower limit thereof is preferably 700 or more, the upper limit thereof is preferably 5,000 or less, more preferably 4,000 or less, and especially preferably 3,000 or less. When the above weight average molecular weight is too small, the cross-linked heat sensitive layer may have deteriorated flexibility, and the deleting property may be decreased. When the above weight average molecular weight is too large, the molecule may be less likely to be mobile and the strength and the durability may be decreased.

Herein, the weight average molecular weight per one isocyanate group has its preferable lower limit of 150 or more, more preferably 200 or more, and especially preferably 250 or more, its preferable upper limit of 2,000 or less, more preferably 1,500 or less, and especially preferably 1,000 or less. When the weight average molecular weight per one isocyanate group is too small, the cross-linked heat sensitive layer may have deteriorated flexibility, and the deleting property may be decreased. When the weight average molecular weight per one isocyanate group is too large, the molecule may be less likely to be mobile and the strength and the durability may be decreased.

The above cyclic isocyanate compound is not specifically limited, and therefore can be properly selected according to the object, examples thereof including, isocyanate compound and the like having benzene ring, isocyanurate ring and the like. These can be used alone or in combination of two or more. Among the above, the cyclic isocyanate compound having isocyanurate ring is preferable, in that it is unlikely to be yellowed, and that it has chain structure such as alkylene chain and the like other than the cyclic structure.

The weight average molecular weight of the above cyclic isocyanate compound is not specifically limited, and therefore can be properly selected according to the object, for example, the lower limit of 100 or more is preferable, 200 or more is more preferable, 300 or more is especially preferable, the upper limit of 1,000 or less is preferable, 700 or less is more preferable. When the above weight average molecular weight is too small, heating in the coat film forming may cause evaporation thus making the coat film incapable of cross-linking, thereby the durability may be decreased. When the above weight average molecular weight is too large, only a rigid structure can be formed, thereby decreasing durability.

The addition amount of the above isocyanate compound is not specifically limited, and therefore can be properly selected according to the object, for example, 1 mass part to 50 mass part relative to the acrylic resin (the acrylic polyol resin) 100 mass part is preferable, 3 mass part to 50 mass part is more preferable, and 5 mass part to 40 mass part is especially preferable. When the addition amount of the above isocyanate compound is less than 1 mass part, the elastic modulus at high temperature may become low, and thereby the heating by the thermal head and the like may break the coat film, resulting in deteriorated durability. When the addition amount of the above isocyanate compound is more than 50 mass part, the refractive index may become low, and the transparent density may be decreased.

The quantity of the isocyanate group in the above isocyanate compound, relative to the hydroxyl group of the acrylic resin (the acrylic polyol resin) is not specifically limited, and therefore can be properly selected according to the object, for example, 0.05 equivalence to 1 equivalence is preferable, and 0.1 equivalence to 1.0 equivalence is more preferable. The above quantity less than 0.05 equivalence may decrease the elastic modulus at high temperature, and thereby the heating with the thermal head and the like may break the coat film, resulting in deteriorated durability. The above quantity of more than 1 equivalence may decrease the refractive index, thereby decreasing the transparent density.

For promoting curing reaction of the acrylic resin (the acrylic polyol resin) and the above isocyanate compound, catalyst can be used. The catalyst is not specifically limited, and therefore can be properly selected according to the object, examples thereof including triethylene diamine, cobalt naphthenate, stannous chloride, tetra-n-butyl tin, dimethyl tin dichloride, trimethyl tin hydroxide, dimethyl stannic chloride, di-n-butyl tin dilaurate, and the like. These can be used alone or in combination of two or more.

Herein, the consumed quantity of the above catalyst is not specifically limited, and therefore can be properly selected according to the object, for example, 0.1% by mass to 2% by mass relative to resin solid content is preferable.

Organic Low Molecular Compound

The molecular weight of the above organic low molecular compound is to be lower than the above resin, for example, 100 to 2,000 in weight average molecular weight is preferable, and 150 to 1,000 is more preferable.

When the above weight average molecular weight is less than 100, the melting point is too low, therefore, the organic low molecular compound may not be crystallized. When the above weight average molecular weight is more than 2,000, the melting point is too high, therefore, the organic low molecular compound may not be melted by the heat of the thermal head, failing to be whitened.

The above weight average molecular weight can be measured for example, by a liquid chromatography.

As long as being capable of becoming in a form of a particle in the heat sensitive layer, the above organic low molecular compound is not specifically limited, and therefore can be properly selected according to the object. For example, the above organic low molecular compound molecule preferably contains at least one selected from the group consisting of oxygen, nitrogen, sulfur and halogen atom, specific examples thereof including —OH, —COOH, —CONH, —COOR, —NH, —$NH_2$, —S—, —S—S—, —O—, halogen atom and the like.

The melting point of the above organic low molecular compound is not specifically limited, and therefore can be properly selected according to the object, usually, 30° C. to 200° C. is preferable, and 50° C. to 150° C. is more preferable. When the above melting point is less than 30° C., the melting point is low, thereby the cooling after the heating cannot sufficiently crystallize the organic low molecular compound, failing to carrying out the image forming-deleting. When the above melting point is more than 200° C., the heat sensitivity may be high thereby the heating with the thermal head cannot melt the organic low molecular compound, failing to carry out the image forming.

Preferable examples of the above organic low molecular compound include carboxyl group-containing compound, carboxyl group non-containing-compound (which does not contain carboxyl group at its terminal end, hereinafter referred to as "carboxyl group non-containing-compound") and the like. These can be used alone or in combination of two or more. Among the above, the carboxyl group non-containing-compound is especially preferable, in the following points: i) the melting point thereof may not increase even when the carboxyl group non-containing-compound is stored in an environment where a basic substance such as a minor amount of ammonia or amine is present, ii) the white saturation energy and the white saturation temperature may not shift to the high energy-and-high temperature side, iii) incapability of forming image is not caused which may be attributable to decreased heat sensitivity, and the like.

The above carboxyl group-containing compound is not specifically limited, and therefore can be properly selected according to the object, examples thereof including, saturated monocarboxylic acid, saturated dicarboxylic acid, unsaturated monocarboxylic acid, unsaturated dicarboxylic acid, saturated halogen fatty acid, unsaturated halogen fatty acid, allyl carboxylic acid, halogen allyl carboxylic acid, thio carboxylic acid, and the like. The number of carbons of the above compounds is not specifically limited, and therefore can be properly selected according to the object, for example, 10 to 60 is preferable, 10 to 38 is more preferable, and 10 to 30 is especially preferable. These can be used alone or in combination of two or more. Among the above, saturated or unsaturated monocarboxylic acid, saturated or unsaturated dicarboxylic acid, allyl carboxylic acid, halogen allyl carboxylic acid, and thio carboxylic acid are preferable.

Examples of the above saturated or unsaturated monocarboxylic acid include higher fatty acid such as lauric acid, dodecanoic acid, myristic acid, pentadecanoic acid, palmitic acid, stearic acid, behenic acid, nonadecanoic acid, arachic acid, oleic acid and the like.

The above saturated or unsaturated dicarboxylic acid is preferred to be aliphatic dicarboxylic acid having melting point of 100° C. to 135° C., preferable examples thereof including succinic acid, glutaric acid, adipic acid, pimelic acid, suberic acid, azelaic acid, sebacic acid, undecane dioate, dodecane dioate, tetradecane dioate, pentadecane dioate, hexadecane dioate, heptadecane dioate, octadecane dioate, nonadecane dioate, eicosane dioate, heneicosadioate, docosane dioate, and the like.

The above carboxyl group non-containing-compound is not specifically limited, and therefore can be properly selected according to the object, for example, a compound containing in its molecule at least one selected from the group consisting of oxygen, nitrogen, sulfur and halogen atom (for example, —OH, halogen atom and the like) is preferable. Specific examples thereof include alkanol, alkane diol, halogen alkanol, halogen alkane diol, alkyl amine, alkane, alkene, alkyne, halogen alkane, halogen alkene, halogen alkyne, cyclo alkane, cyclo alkene, cyclo alkyne, saturated monocarboxylic acid ester, saturated dicarboxylic acid ester, unsaturated monocarboxylic acid ester, unsaturated dicarboxylic acid ester, saturated monocarboxylic acid amide, saturated dicarboxylic acid amide, unsaturated monocarboxylic acid amide, unsaturated dicarboxylic acid amide, saturated monocarboxylic acid ammonium salt, saturated dicarboxylic acid ammonium salt, unsaturated monocarboxylic acid ammonium salt, unsaturated dicarboxylic acid ammonium salt, saturated halogen fatty acid ester, saturated halogen fatty acid amide, saturated halogen fatty acid ammonium salt, unsaturated halogen fatty acid ester, unsaturated halogen fatty acid amide, unsaturated halogen fatty acid ammonium salt, allyl carboxylic acid ester, allyl carboxylic acid amide, allyl carboxylic acid ammonium salt, halogen allyl carboxylic acid ester, halogen allyl carboxylic acid amide, halogen allyl carboxylic acid ammonium salt, thio alcohol, thio carboxylic acid ester, thio carboxylic acid amide, thio carboxylic acid ammonium salt, carboxylic acid ester of thio alcohol, and the like. These can be used alone or in combination of two or more.

The number of carbons of the above carboxyl group non-containing-compound is not specifically limited, and therefore can be properly selected according to the object, for example, 10 to 60 is preferable, and 10 to 38 is more preferable. The alcohol group part in the ester of the above carboxyl group non-containing-compound may be saturated or unsaturated, otherwise may be substituted with halogen atom.

The above carboxyl group non-containing-compound preferably may be those having low melting point of 40° C. to 70° C., for example, fatty acid ester, dibasic acid ester, polyvalent alcohol di-fatty acid ester, and the like.

The above fatty acid ester has melting point lower than that of the fatty acid having the same number of carbons (two molecules associated), meanwhile has the number of carbons more than that of the fatty acid having the same melting point. With the above, the above fatty acid ester having the following features is more advantageous than the fatty acid having the same melting point: suppressing deterioration of the image printing-deleting, increasing degree of whiteness, making high contrast, and improving repetition durability. Herein, the above deterioration of the image printing-deleting is inferred to be caused by change of the dispersion state of the particulate organic low molecular compound which change is attributable to compatibility of the above resin and the above organic low molecular compound in the heating.

Of the present invention, use of a mixture of the fatty acid ester and the high-melting-point organic low molecular compound can increase the transparency temperature width and improve the deleting property when using the thermal head. As a result, even when the deleting property has a small fluctuation due to storage, a sufficient deleting property is secured, improving the repetition durability from the material itself.

The above fatty acid ester is not specifically limited, and therefore can be properly selected according to the object, for example, the one expressed by the following structural formula (1) is preferable.

$$R_1—COO—R^2 \qquad \text{Structural formula (1)}$$

In the above structural formula (1), $R^1$ and $R^2$ may be the same or different from each other, denoting alkyl group having the number of carbons of 10 or more. The fatty acid ester may be used alone or in combination of two or more.

The number of carbons of the above fatty acid ester is not specifically limited, and therefore can be properly selected according to the object, for example, 20 or more is preferable, 25 or more is more preferable, and 30 or more is especially preferable. The more the above number of carbons is, the higher the degree of whiteness is, improving the repetition durability.

The melting point of the above fatty acid ester is not specifically limited, and therefore can be properly selected according to the object, for example, 40° C. or more is preferable.

Specific examples of the fatty acid ester expressed by the above structural formula (1) include higher fatty acid esters such as methyl stearate, tetradecyl stearate, octadecyl stearate, octadecyl laurate, tetradecyl palmitate, dodecyl behenate and the like; ethers and thio ethers such as $C_{16}H_{33}$—O—$C_{16}H_{33}$, $C_{16}H_{33}$—S—$C_{16}H_{33}$, $C_{18}H_{37}$—S—$C_{18}H_{37}$, $C_{12}H_{25}$—S—$C_{12}H_{25}$, $C_{19}H_{39}$—S—$C_{19}H_{39}$, $C_{12}H_{25}$—S—S—$C_{12}H_{25}$, and the like; and the like.

The above dibasic acid ester is not specifically limited, and therefore can be properly selected according to the object, for example, any one of monoester and diester, and the one expressed by the following structural formula (2) is preferable.

$$R^3OOC—(CH)_n—COOR^4 \qquad \text{Structural formula (2)}$$

In the above structural formula (2), $R^3$ and $R^4$ may be the same or different from each other, denoting hydrogen atom, or alkyl group having the number of carbons of 10 or more (not applicable when both $R^3$ and $R^4$ are hydrogen atom). The total number of carbons of the alkyl groups of $R^3$ and $R^4$ is preferably 20 or more, 25 or more is more preferable, and 30 or more is especially preferable. n is preferably 0 to 40, 1 to 30 is more preferable, and 2 to 20 is especially preferable. Herein, the melting point of the dibasic acid ester is more preferably 40° C. or more.

The above polyvalent alcohol di-fatty acid ester is not specifically limited, and therefore can be properly selected according to the object, for example, the one expressed by the following structural formula (3) is preferable.

$$CH_3(CH_2)_m\text{-}2COO(CH_2)_pOOC(CH_2)_m\text{-}2CH_3 \qquad \text{Structural formula (3)}$$

In the above structural formula (3), p is preferably 2 to 40, 3 to 30 is more preferable, and 4 to 22 is especially preferable. m is preferably 2 to 40, 3 to 30 is more preferable, and 4 to 22 is especially preferable.

The above polyvalent alcohol di-fatty acid ester has melting point lower than that of the fatty acid having the same number of carbons, meanwhile has the number of carbons more than that of the fatty acid having the same melting point. With the above, the above polyvalent alcohol di-fatty acid ester having the following features is more advantageous than the fatty acid having the same melting point: suppressing deterioration of the image printing-deleting, increasing degree of whiteness, making high contrast, and improving repetition durability.

The above organic low molecular compound is preferred to be a combination of i) a low-melting-point organic low molecular compound and ii) a high-melting-point organic low molecular compound (namely, having melting point higher than that of the low-melting-point organic low molecular compound in i)), thus further increasing transparency temperature width.

The difference in the melting point between i) and ii) above is not specifically limited, and therefore can be properly selected according to the object, for example, 30° C. or more is preferable, 40° C. or more is more preferable, and 50° C. or more is especially preferable.

The melting point of the above low-melting-point organic low molecular compound is not specifically limited, and therefore can be properly selected according to the object, for example, 40° C. to 100° C. is preferable, and 50° C. to 80° C. is more preferable. Moreover, the melting point of the above high-melting-point organic low molecular compound is not specifically limited, and therefore can be properly selected according to the object, for example, 100° C. to 200° C. is preferable, and 110° C. to 180° C. is more preferable.

The above high-melting-point organic low molecular compound is preferred to have the melting point of 100° C. or more, examples thereof including aliphatic saturated dicarboxylic acid, ketone having higher alkyl group, semicarbazone derived from the ketone, α-phosphono fatty acid, and the like. These can be used alone or in combination of two or more.

Examples of the above aliphatic saturated dicarboxylic acid include succinic acid, glutaric acid, adipic acid, pimelic acid, suberic acid, azelaic acid, sebacic acid, undecane dioate, dodecane dioate, tetradecane dioate, pentadecane dioate, hexadecane dioate, heptadecane dioate, octadecane dioate, nonadecane dioate, eicosane dioate, heneicosadioate, docosane dioate, and the like.

The above ketone preferably includes ketone group and higher alkyl group as necessary structure groups, moreover includes aromatic ring or arsenic ring having nonsubstitutional group or substitutional group. The total number of carbons of the above ketone is preferably 16 or more, and 21 or more is more preferable. Herein, the above semi-carbazone is derived from the ketone.

The above α-phosphono fatty acid can be synthesized, for example, in the following manner: According to the method of J. Ak. Oil Chekit's Soc, 41, 205 (1964) such as E. V. Kaurer and the like, the fatty acid is to be brominated through Hell-Volhard-Zelinskin reaction, to thereby obtain α-brominated acid bromide. Then, the α-brominated acid bromide is added by ethanol, to thereby obtain α-bromo fatty acid ester. Then, the α-bromo fatty acid ester is reacted by heating with triethyl phosphite, to thereby obtain α-phosphono fatty acid ester, followed by hydrolysis using dense hydrochloric acid, to thereby recrystallize α-phosphono fatty acid (which is a product) from toluene. With the above, α-phosphono fatty acid can be synthesized.

Of the present invention, for increasing the transparency temperature width, the above organic low molecular compound may be properly combined, or other material(s) having melting point different from that of the above organic low molecular compound may be combined.

In the heat sensitive layer, the mix mass ratio of the above organic low molecular compound to the acrylic resin (resin having cross-link structure) is not specifically limited (organic low molecular compound: acrylic resin), and therefore can be properly selected according to the object, for example, 2:1 to 1:16 is preferable, and 1:2 to 1:8 is more preferable.

When the above mass ratio is out of the above range, dispersing the above organic low molecular compound in the above resin may be difficult, thereby making opacity may become difficult.

Of the present invention, when the above fatty acid ester is used as organic low molecular compound of the above low melting point, it is preferable to mix a straight chain hydrocarbon-containing compound as an organic low molecular compound having higher melting point than the low-melting-point fatty acid ester, for increasing the above transparency temperature width. In this case, the image deleting (making transparency) by the short time heating with the thermal head and the like can be improved. Moreover in this case, margin of the image deleting may be increased. With this, even when the image deleting energy is fluctuated with the elapsed time, no practical problem may be caused, which is advantageous in that deleting with the thermal head is accomplished.

The above straight chain hydrocarbon-containing compound preferably has the total number of carbons of 6 to 60, and 8 to 50 is more preferable. Among the above, those having cyclic structure are preferable such as cyclic hydrocarbon (for example cyclo hexane, cyclo pentane and the like), aromatic ring (for example, benzene, naphthalene and the like), heterocyclic ring (for example cyclic ether, furan, pyran, morpholine, pyrrolidine, piperidine, pyrrole, pyridine, pyrazine, piperazine, pyrimidine and the like), condensed heterocyclic ring (for example benzopyrrolidine, indole, benzooxazine, quinoline and the like); more preferably those having phenylene structure (for example phenyl group and the like), cyclo hexylene structure (for example cyclo hexyl group and the like), and heterocyclic ring; and especially preferably those having methyl group in at least one of terminal ends of molecule.

Specific examples of the above straight chain include (1) straight chain hydrocarbon-containing compound having urethane bond, (2) straight chain hydrocarbon-containing compound having sulfonyl bond, (3) straight chain hydrocarbon-containing compound having diamide oxalate bond, (4) straight chain hydrocarbon-containing compound having diacyl hydrazide bond, (5) straight chain hydrocarbon-containing aliphatic compound having carbamide bond and urethane bond, (6) straight chain hydrocarbon-containing aliphatic compound having carbamide bond and amide bond, (7) straight chain hydrocarbon-containing aliphatic compound having a plurality of carbamide bonds, (8) cyclic compound having carbamide bond, (9) cyclic compound having amide bond, and the like.

Preferably, the straight chain hydrocarbon-containing compound of the above (1) to (9) does not have carboxyl group, and has, in molecule thereof, urethane bond (—NHCOO—), sulfonyl bond (—$SO_2$—), amide bond (—CONH—), diamide oxalate bond (—NHCOCONH—), diacyl hydrazide bond (—CONHNHCO—), or polar group such as carbamide bond (—HNCONH—).

The above straight chain hydrocarbon-containing compound preferably has the melting point having its lower limit of 100° C. or more, more preferably 110° C. or more, moreover preferably 120° C. or more, and especially preferably 130° C. or more; its upper limit of 180° C. or less, more preferably 160° C. or less, especially preferably 150° C. or less. When the above melting point is too low, the transparency temperature width cannot be increased, thereby decreasing the deleting property, while, when too high, the sensitivity in forming the white image may be decreased.

Examples of the above straight chain hydrocarbon-containing compound include those expressed by the following structural formula (4) to (9).

$R^5—X—R^6—Y—R^7$ Structural formula (4)

In the above structural formula (4), at least one of X and Y denotes one of urethane bond, sulfonyl bond, and carbamide bond, and the other of X and Y denotes one of urethane bond, sulfonyl bond, carbamide bond and amide bond. $R^5$ and $R^7$ denote one of $CH_3(CH_2)_m$— and $CH_3(CH_2)_m$—O—$(CH_2)_n$—, $R^6$ denotes any of —$(CH_2)_m$—, the groups expressed by the following structural formula (4-1) and structural formula (4-2).

Structural formula (4-1)

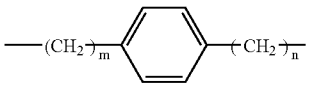

Structural formula (4-2)

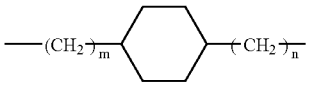

In the structural formula (4-1) and the structural formula (4-2), m and n each are preferably 0 to 30.

$R^8—X—R^9$ Structural formula (5)

In the above structural formula (5), X denotes one of diamide oxalate bond and diacyl hydrazide bond. $R^8$ and $R^9$ denote one of $CH_3(CH_2)_m$— and $CH_3(CH_2)_m$—O—$(CH_2)_n$—. m and n each denote an integer of 0 to 30.

Structural formula (6)

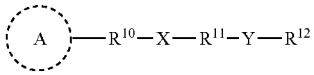

In the above structural formula (6), X and Y denote at least one selected from the group consisting of urethane bond, sulfonyl bond, carbamide bond, amide bond, diamide oxalate bond, and diacyl hydrazide bond. $R^{10}$ and $R^{12}$ denote one of —$(CH_2)_m$— and —$(CH_2)_m$—O—$(CH_2)_n$—. $R^{11}$ denotes one of $CH_3(CH_2)_m$—0 and $CH_3(CH_2)_m$—O—$(CH_2)_n$—. m and n each denote an integer of 0 to 30. A denotes phenyl group, cyclo hexyl group, and the groups expressed by the following structural formula (6-1) to structural formula (6-2).

Structural formula (7)

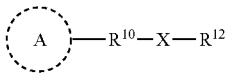

In the above structural formula (7), X denotes any of urethane bond, sulfonyl bond, carbamide bond, amide bond, diamide oxalate bond, and diacyl hydrazide bond. $R^{10}$ and $R^{12}$ denote one of —$(CH_2)_m$— and —$(CH_2)_m$—O—$(CH_2)_n$—. m and n each denote an integer of 0 to 30. A denotes any of phenyl group, cyclo hexyl group, and the groups expressed by the following structural formula (6-1) to structural formula (6-2).

Structural formula (6-1)

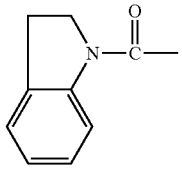

Structural formula (6-2)

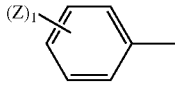

In the above structural formula (6-2), 1 denotes an integer of 1 to 3. Z denotes any of $R^{13}OCO$—, $R^{13}O$— and $R^{13}$—. $R^{13}$ denotes one of $CH_3(CH_2)_m$— and $CH_3(CH_2)_m$—O—$(CH_2)_n$—. m and n each denote an integer of 0 to 30.

Structural formula (8)

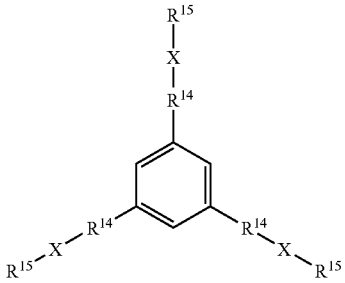

Structural formula (9)

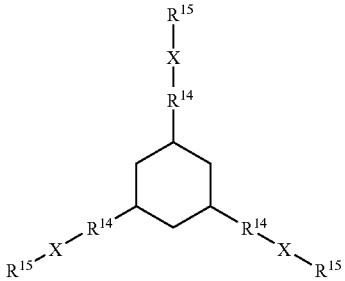

In the above structural formula (8) and structural formula (9), X denotes at least one selected from the group consisting of urethane bond, sulfonyl bond, carbamide bond, amide bond, diamide oxalate bond and diacyl hydrazide bond. $R^{14}$ denotes one of —$(CH_2)_m$— and —$(CH_2)_m$—O—$(CH_2)_n$—. $R^{15}$ denotes one of $CH_3(CH_2)_m$— and $CH_3(CH_2)_m$—O—$(CH_2)_n$—. m and n each denote an integer of 0 to 30.

Specific examples of the above straight chain hydrocarbon-containing compound preferably include those expressed by the following structural formula (10) to structural formula (26).

$R^{16}—OOCNH—R^{17}—NHCOO—R^{18}$ Structural formula (10)

$R^{16}—NHCOO—R^{17}—OOCNH—R^{18}$ Structural formula (11)

$R^{16}—SO_2—R^{17}—SO_2—R^{18}$ Structural formula (12)

$R^{16}—NHCOCONH—R^{18}$ Structural formula (13)

$R^{16}—CONHNHCO—R^{18}$ Structural formula (14)

$R^{16}—NHCO—R^{17}—NHCONH—R^{18}$ Structural formula (15)

$R^{16}$—CONH—$R^{17}$—NHCONH—$R^{18}$ Structural formula (16)

$R^{16}$—NHCOO—$R^{17}$—NHCONH—$R^{18}$ Structural formula (17)

$R^{16}$—NHCONH—$R^{17}$—NHCONH—$R^{18}$ Structural formula (18)

$R^{16}$—NHCOO—$R^{17}$—OOCNH—$R^{18}$ Structural formula (19)

In the above structural formula (10) to structural formula (19), $R^{16}$ and $R^{18}$ denote alkyl group. $R^{17}$ denotes any of methylene group, and the groups expressed by the following structural formula (10-1) to structural formula (10-2).

Structural formula (10-1)

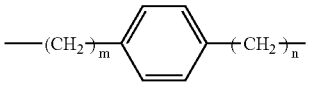

Structural formula (10-2)

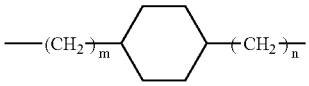

In the above structural formula (10-1) to structural formula (10-2), m and n each denote an integer of 0 to 20.

Structural formula (20)

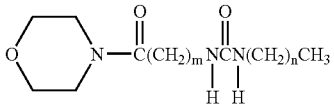

Structural formula (21)

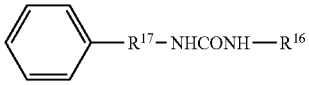

Structural formula (22)

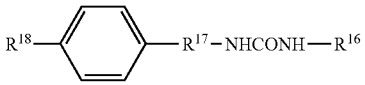

Structural formula (23)

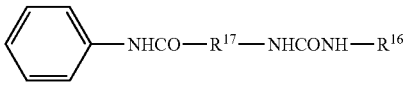

(Structural formula (24)

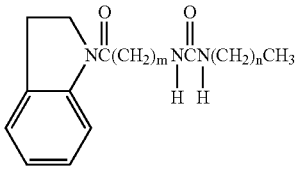

Structural formula (25)

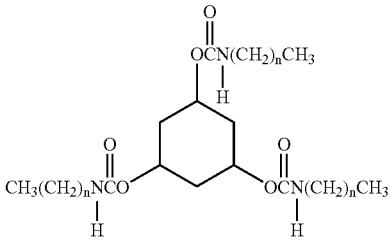

(Structural formula (26)

$R^{15}$—NHCONH—$R^{15}$

Specific examples of the compound expressed by the above structural formula (10) preferably include the following.

$CH_3(CH_2)_{11}OOCNH(CH_2)_6NHCOO(CH_2)_{11}CH_3$ melting point: 113° C.

$CH_3(CH_2)_{17}OOCNH(CH_2)_6NHCOO(CH_2)_{17}CH_3$ melting point: 119° C.

$CH_3(CH_2)_{21}OOCNH(CH_2)_6NHCOO(CH_2)_{21}CH_3$ melting point: 121° C.

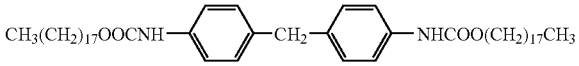

Melting point: 133° C.

Specific examples of the compound expressed by the above structural formula (11) preferably include the following.

$CH_3(CH_2)_{17}NHCOO(CH_2)_2OOCNH(CH_2)_{17}CH_3$ melting point: 115° C.

$CH_3(CH_2)_{17}NHCOO(CH_2)_4OOCNH(CH_2)_{17}CH_3$ melting point: 119° C.

$CH_3(CH_2)_{17}NHCOO(CH_2)_6OOCNH(CH_2)_{17}CH_3$ melting point: 111° C.

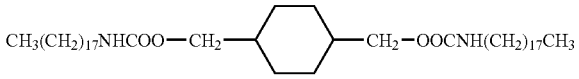

Melting point: 121° C.

Specific examples of the compound expressed by the above structural formula (12) preferably include the following;

$CH_3(CH_2)_{11}SO_2(CH_2)_4SO_2(CH_2)^{11}CH_3$ melting point: 149° C.

$CH_3(CH_2)_{17}SO_2(CH_2)_2SO_2(CH_2)_{17}CH_3$ melting point: 150° C.

$CH_3(CH_2)_{17}SO_2(CH_2)_4SO_2(CH_2)_{17}CH_3$ melting point: 148° C.

Specific examples of the compound expressed by the above structural formula (13) preferably include the following.

$CH_3(CH_2)_{11}NHCOCONH(CH_2)_{11}CH_3$ melting point: 124° C.

$CH_3(CH_2)_{17}NHCOCONH(CH_2)_{17}CH_3$ melting point: 121° C.

Specific examples of the compound expressed by the above structural formula (14) preferably include the following.

$CH_3(CH_2)_{10}CONHNHCO(CH_2)_{10}CH_3$ melting point: 151° C.

$CH_3(CH_2)_{16}CONHNHCO(CH_2)_{16}CH_3$ melting point: 134° C.

$CH_3(CH_2)_{16}CONHNHCO(CH_2)_{16}CH_3$ melting point: 147° C.

$CH_3(CH_2)_{20}CONHNHCO(CH_2)_{16}CH_3$ melting point: 136° C.

$CH_3(CH_2)_{20}CONHNHCO(CH_2)_{20}CH_3$ melting point: 143° C.

Specific examples of the compound expressed by the above structural formula (15) preferably include the following.

$CH_3(CH_2)_{17}NHCO(CH_2)_4NHCONH(CH_2)_{17}CH_3$ melting point: 144° C.

$CH_3O(CH_2)_3NHCO(CH_2)_{11}NHCONH(CH_2)_{17}CH_3$ melting point: 140° C.

$CH_3CH_2O(CH_2)_3NHCO(CH_2)_{11}NHCONH(CH_2)_{17}CH_3$ melting point: 135° C.

Specific examples of the compound expressed by the above structural formula (16) preferably include the following.

$CH_3(CH_2)_{16}CONH\ (CH_2)_6NHCONH(CH_2)_{17}CH_3$ melting point: 149° C.

Specific examples of the compound expressed by the above structural formula (17) preferably include the following.

$CH_3(CH_2)_{17}NHCOO(CH_2)_2NHCONH(CH_2)_{17}CH_3$ melting point: 127° C.

Specific examples of the compound expressed by the above structural formula (18) preferably include the following.

$CH_3\ (CH_2)_{17}NHCONH(CH_2)_6NHCONH\ (CH_2)_{17}CH_3$ melting point: 177° C.

Specific examples of the compound expressed by the above structural formula (19) preferably include the following.

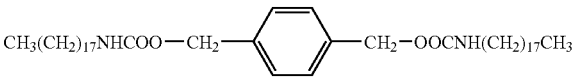

Melting point: 121° C.

Specific examples of the compound expressed by the above structural formula (20) preferably include the following.

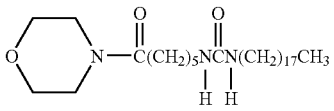

Melting point: 120° C.

Specific examples of the compound expressed by the above structural formula (21) preferably include the following.

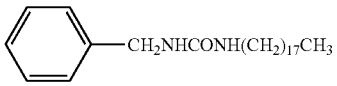

Melting point: 115° C.

Specific examples of the compound expressed by the above structural formula (22) preferably include the following.

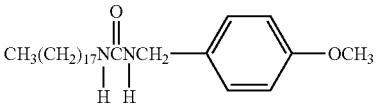

Melting point: 124° C.

Specific examples of the compound expressed by the above structural formula (23) preferably include the following.

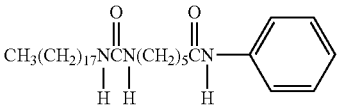

Melting point: 146° C.

Specific examples of the compound expressed by the above structural formula (24) preferably include the following.

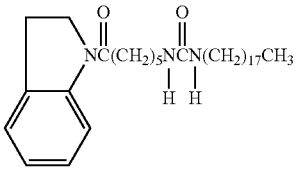

Melting point: 136° C.

Specific examples of the compound expressed by the above structural formula (25) preferably include the following.

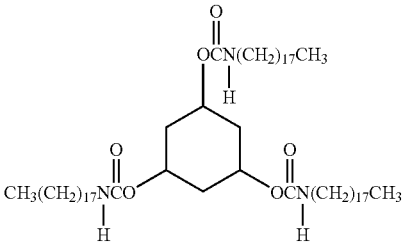

Melting point: 115° C.

Specific examples of the compound expressed by the above structural formula (26) preferably include the following.

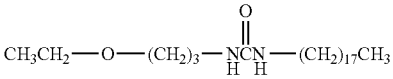

Melting point: 98° C.

The mix mass ratio of the above straight chain hydrocarbon-containing compound to the above low-melting-point organic low molecular compound (low-melting-point organic low molecular compound: straight chain hydrocarbon-containing compound) is not specifically limited, and therefore can be properly selected according to the object, examples thereof including preferably 95:5 to 5:95, 90:10 to 10:90 is more preferable, and 80:20 to 20:80 is especially preferable. In case that the above mix mass ratio is not within the above range, the following may be caused: i) when the above low-melting-point organic low molecular compound is too much, the transparency temperature width may get narrow, making the deleting property insufficient; and ii) when the above straight chain hydrocarbon-containing compound is too much, the image may not be formed.

When an organic low molecular compound other than the above low-melting-point organic low molecular compound and the above high-melting-point organic low molecular compound is combined, the above other organic low molecular compound is not specifically limited, and therefore can be properly selected according to the object, examples thereof including, higher fatty acid, higher fatty acid ester, higher fatty acid ether, and the like.

Examples of the above higher fatty acid include lauric acid, dodecanoic acid, myristic acid, pentadecanoic acid, palmitic acid, stearic acid, behenic acid, nonadecanoic acid, arachic acid, oleic acid, and the like. Examples of the above higher fatty acid ester include methyl stearate, tetradecyl stearate, octadecyl stearate, octadecyl laurate, tetradecyl palmitate, dodecyl behenate, and the like.

Examples of ether of the above higher fatty acid include $C_{16}H_{33}$—O—$C_{16}H_{33}$, and the like.

Examples of thio ether of the above higher fatty acid include $C_{16}H_{33}$—S—$C_{16}H_{33}$, $C_{18}H_{37}$—S—$C_{18}H_{37}$, $C_{12}H_{25}$—S—$C_{12}H_{25}$, $C_{19}H_{39}$—S—$C_{19}H_{39}$, $C_{12}H_{25}$—S—S—$C_{12}H_{25}$, and the like. These can be used alone or in combination of two or more. Among the above, the higher fatty acid having the number of carbons of 16 or more are especially preferable, such as palmitic acid, pentadecanoic acid, nonadecanoic acid, arachic acid, stearic acid, behenic acid, lignoceric acid and the like; more preferably the higher fatty acid having the number of carbons of 16 to 24.

The other component in the heat sensitive layer is not specifically limited, and therefore can be properly selected according to the object, examples thereof including the surfactant, plasticizer, and the like from the viewpoint of easy forming of the image.

The surfactant is not specifically limited, and therefore can be properly selected according to the object, examples thereof including anion surfactant, cation surfactant, nonion the surfactant, amphoteric surfactant, and the like.

The above plasticizer is not specifically limited, and therefore can be properly selected according to the object, examples thereof including phosphoric acid ester, fatty acid ester, phthalic acid ester, dibasic acid ester, glycol, polyester plasticizer, epoxy plasticizer, and the like.

Thickness of the heat sensitive layer is not specifically limited, and therefore can be properly selected according to the object, preferable examples thereof including 1 μm to 30 μm, and more preferably 2 μm to 20 μm.

When the thickness of the heat sensitive layer is too small, whiteness may be decreased thereby decreasing the contrast. When the thickness of the heat sensitive layer is too large, a heat distribution may be caused in the layer, making it difficult to evenly form the transparency. Herein, increasing content of the above organic low molecular compound in the heat sensitive layer can increase the whiteness.

In addition to the heat sensitive layer, the heat reversible recording medium of the present invention can have other layers properly selected when necessary, examples thereof including supporter, coloring layer, air layer, light reflecting layer, adhesive layer, middle layer, the protective layer, adhesive layer, viscosity layer and the like. Each of the above layers may be of a single layer structure or of a laminated structure.

The layer structure of the heat reversible recording medium is not specifically limited, and therefore can be properly selected according to the object. For example, Japanese Utility Model Application Laid-Open(JP-U) No. 2-3876 describes a magnetic heat sensitive layer (having, as its main component, a heat sensitive layer and a magnetic material) which is disposed on a supporter. In this structure, at least one of i) a directly lower part of the heat sensitive layer and ii) the supporter's part corresponding to the heat sensitive layer is colorized. For another example, JP-A No. 3-130188 describes a laminated structure having a supporter, a magnetic heat sensitive layer on the supporter, a light reflecting layer on the magnetic heat sensitive layer, and a heat sensitive layer on the light reflecting layer. Herein, the above magnetic heat sensitive layer is preferably disposed on the supporter's backface, or between the supporter and the heat sensitive layer.

In terms of configuration, structure, size and the like, the supporter is not specifically limited, and therefore can be properly selected according to the object. Examples of the above configuration include flat plate, and the like. Examples of the above structure include single layer structure and laminated structure. The above size can be properly selected according to the size of the heat reversible recording medium.

Examples of the material for the supporter include inorganic material, organic material, and the like. Examples of the above inorganic material include glass, quartz, silicon, silicon oxide, aluminum oxide, $SiO_2$, metal and the like. Examples of the above organic material include paper, polyethylene terephthalate, polycarbonate, polystyrene, polymethyl methacrylate, and the like. These can be used alone or in combination of two or more.

Thickness of the supporter is not specifically limited, and therefore can be properly selected according to the object, 100 μm to 2,000 μm is preferable, and 100 μm to 1,000 μm is more preferable.

For protecting the heat sensitive layer, the heat reversible recording medium can be provided with a protective layer. Examples of the material for the protective layer include silicone rubber, silicone resin (for example, JP-A No. 63-221087), polysiloxane graft polymer (for example, JP-A No. 63-317385), ultraviolet ray curing resin or electron beam curing resin (for example, JP-A No. 2-566), and the like.

For applying the above materials, usually, a solvent is to be used. Preferably, the above solvent is unlikely to dissolve the above resin and the above organic low molecular compound of the heat sensitive layer. Examples of the solvent include alcohol solvents such as n-hexane, methyl alcohol, ethyl alcohol, isopropyl alcohol, and the like. These may be used alone, or in combination or two or more. In terms of cost, alcohol solvent is preferable.

Simultaneously with the curing of the acrylic resin of the heat sensitive layer, the protective layer can be cured. In this case, after the heat sensitive layer is formed on the supporter, the protective layer is to be applied and dried. Thereafter, heating, ultraviolet ray irradiation, electron beam irradiation and the like are to be carried out, to thereby cure each of the layers.

Thickness of the protective layer is not specifically limited, and therefore can be properly selected according to the object, for example, 0.1 μm to 10.0 μm is preferable. When the thickness of the protective layer is less than 0.1 μm, effect of protecting the heat sensitive layer may be insufficient. When the thickness of the protective layer is more than 10.0 μm, the heat sensitivity may be decreased.

For protecting the heat sensitive layer from the solvent, the monomer component and the like of a protective layer forming solution, the heat reversible recording medium can be provided with a middle layer between the protective layer and the heat sensitive layer (for example, JP-A No. 1-133781). Examples of the material for the above middle layer include the one used for the resin in the heat sensitive layer, and other than that, include resin components such as heat plastic resin, thermosetting resin and the like. Specific examples of the resin components include polyethylene, polypropylene, polystyrene, polyvinyl alcohol, polyvinyl butyral, polyurethane, saturated polyester, unsaturated polyester, epoxy resin, phenol resin, polycarbonate, polyamide, and the like.

Thickness of the above middle layer is not specifically limited, and therefore can be properly selected according to the object, 0.5 μm to 10 μm is preferable.

For improving visibility, the heat reversible recording medium is preferably provided with a coloring layer between the supporter and the heat sensitive layer. The above coloring layer can be formed by i) applying to a target face a solution or a dispersing liquid containing the coloring agent and the resin binder, followed by drying, otherwise, ii) by merely attaching the coloring sheet.

As long as being recognizable, as a reflection image, the change in transparency and whitening of the heat sensitive layer (namely, an upper layer), the above coloring agent is not specifically limited, examples thereof including dyes and pigments having colors such as red, yellow, blue, iron blue, purple, black, brown, gray, orange, green, and the like. Herein, the above resin binder may be any of various heat plastic resins, thermosetting resin, ultraviolet ray setting resin, and the like.

The heat reversible recording medium may be provided with a color print layer. Examples of a coloring agent in the color print layer include various dyes, pigments and the like contained in color inks used for the conventional full color print. Examples of the above resin binder include various heat plastic resins, thermosetting resins, ultraviolet ray setting resins and electron beam setting resins, and the like. Thickness of the color print layer may be properly varied according to the print color density, and therefore can be selected according to the desired print color density.

Between the supporter and the heat sensitive layer, the heat reversible recording medium may have a non-adhesion part by an air layer. The above organic high molecular compound used for the heat sensitive layer has a refractive index of about 1.4 to 1.6, having a large difference from the refractive index 1.0 of the air. Thereby, the air layer can allow a light to be reflected in an interface between the heat sensitive layer and the above non-adhesion part, thus amplifying the degree of whiteness when the heat sensitive layer is in the white state. With this, the visibility can be improved, allowing the non-adhesion part by the air layer to be preferably usable as a display part.

The above air layer can also function as an insulator layer thus improving the heat sensitivity, moreover, functions as a cushion layer thus dispersing the pressure from the thermal head. Thereby, deformation of the heat sensitive layer, diffusion of the particulate organic low molecular compounds, and the like can be prevented, and the repetition durability can be improved.

Moreover, the heat reversible recording medium can be provided with a head matching layer. Examples of the material for the head matching layer include heat resistance resin, inorganic pigment, and the like. Preferably, the above heat resistance resin is the same as a heat resistance resin used in the protective layer. Examples of the above inorganic pigment include calcium carbonate, kaolin, silica, aluminum hydroxide, alumina, aluminum silicate, magnesium hydroxide, magnesium carbonate, magnesium oxide, titanium oxide, zinc oxide, barium sulfate, talc, and the like. These can be used alone or in combination of two or more. Examples of particle diameter of the above inorganic pigment preferably include 0.01 μm to 10.0 μm, and 0.05 μm to 8.0 μm is more preferable. Addition amount of the inorganic pigment is preferably 0.001 mass part relative to 2 mass part, relative to the above heat resistance resin 1 mass part, and more preferably 0.005 mass part to 1 mass part.

Herein, for curing the resin in the protective layer, the color print layer, the head matching layer by using heat, ultraviolet ray, electron beam and the like, addition of the cross-linking agent, the light polymerization starter, and the light polymerization promoter are preferable which are used for cross-linking (by ultraviolet ray) the resin of the heat sensitive layer.

The method of manufacturing the heat reversible recording medium is not specifically limited, and therefore can be properly selected according to the object, preferable examples thereof including: (1) applying on to the supporter a composition for the heat reversible recording medium which composition is made by dissolving and dispersing the above resin and the above organic low molecular compound in the solvent, then carrying out the cross-linking simultaneously with or after evaporating the solvent into a sheet and the like, (2) applying on to the supporter the composition for the heat reversible recording medium which composition is made by dispersing the above organic low molecular compound in the solvent in which only the above resin is dissolved, then carrying out the cross-linking simultaneously with or after evaporating the solvent into a sheet and the like, and (3) without the solvent, mixing the above resin and the above organic low molecular compound by heating and melting, then molding the thus melted mixture into a sheet and the like, then cooling, followed by cross-linking. Herein, among the above, the heat reversible recording medium can be molded into a sheet, without using the supporter.

Being different with types of the above resin and the above organic low molecular compound and the like, the solvent used in the above (1) or (2) cannot generally be specified. Examples thereof, however, include tetrahydro furan, methyl ethyl ketone, methyl isobutyl ketone, chloroform, carbon tetrachloride, ethanol, toluene, benzene, and the like. In the heat sensitive layer, the above organic low molecular compound is present in such a manner as to be dispersed in a form of particle.

For accomplishing high performance as a coating material, the composition for the heat reversible recording medium may be added by various pigment, defoaming agent, pigment, dispersing agent, slipping agent, antiseptic, cross-linking agent, plasticizer, and the like.

The method of applying the composition for the heat reversible recording medium is not specifically limited, and therefore can be properly selected from those known in the art, examples thereof including spray coating method, roller coating method, bar coating method, air knife coating method, brush coating method, dipping method, and the like.

The drying condition of the composition for the heat reversible recording medium is not specifically limited, and therefore can be properly selected according to the object, examples thereof including room temperature to 140° C., 10 minutes to one hour, and the like.

The above resin in the heat sensitive layer can be cured by heating, ultraviolet ray irradiation, electron beam irradiation. Specifically, the above curing is carried out by reacting the acrylic copolymer (acrylic resin) with the polyisocyanate compound.

The above ultraviolet ray irradiation can be carried out with a known ultraviolet ray irradiating apparatus, examples thereof including those provided with light source, lamp fitting, power source, cooling apparatus, conveying apparatus, and the like.

Specific examples of the above light source include mercury lamp, metal halide lamp, potassium lamp, mercury xenon lamp, flash lamp, and the like. The wavelength of the light source can be properly selected according to the ultraviolet ray-absorbing wavelength of the light polymerization starter and the light polymerization promoter which are added to the composition for the heat reversible recording medium.

The condition for irradiating the above ultraviolet ray is not specifically limited, and therefore can be properly selected according to the object. For example, the lamp output, the conveying speed and the like can be determined, according to the irradiating energy necessary for cross-linking the above resin.

The above electron beam irradiation can be carried out by using a known electron beam irradiating apparatus, which is categorized into two types including a scanning type (scan beam) and a non-scanning type (area beam). The condition for the above electron beam irradiation can be selected according to an irradiation area, an irradiation dosage and the like. Moreover, from the following equation, the electron beam irradiation condition can be determined according to the dosage necessary for cross-linking the resin, in view of electron flow, irradiation width and conveying speed.

$$D=(\Delta E/\Delta R)\times\eta\times I/(W\times V)$$

In the above equation, D denotes a necessary dosage (Mrad). $\Delta E/\Delta R$ denotes an average energy loss. $\eta$ denotes an efficiency. I denotes an electron flow (mA). W denotes an irradiation width (cm). V denotes a conveying speed (cm/). Hereinabove, from an industrial point of view, preferably, the above equation is to be simplified and the following equation is to be used.

$$D\times V=K\times I/W$$

Hereinabove, an apparatus rating is denoted by Mrad·m/min, an electron flow rating of 20 mA to 500 mA is to be selected.

Curing the above resin of the heat sensitive layer can improve hardness of the heat sensitive layer. Herein, when the pressing is carried out simultaneously with heating by using the thermal head and the like, the repeated image formings-deletings may deform the above resin around the particulate organic low molecular compound, and thereby the above organic low molecular compound finely dispersed may gradually get into a large-diameter particle, decreasing the effect of light-scattering (namely, degree of whiteness is decreased), resulting in decreased image contrast. Summarizing the above, hardness of the heat sensitive layer is important for the durability of the heat sensitive layer. The stronger the heat sensitive layer's hardness is, the better the durability is. Moreover, in the heating (100° C. to 140° C.), harder heat sensitive layer is better. Specifically, the hardness of the heat sensitive layer is measured, for example, by using a thin film hardness meter MHA-400 made by NEC.

Moreover, an air gap having a different refractive index present in the interface between the above resin and the above organic low molecular compound's particle in the heat sensitive layer or present in the particulate organic low molecular compound may improve image density in the white state, thus improving the contrast. In this case, size of the air gap is preferably 1/10 or more the wavelength of the light used for detecting the opaque state.

The image formed in the heat reversible recording medium may be visible as a transmission image, or may be visible as a reflection image.

When the image formed in the heat reversible recording medium is used as the above reflection image, it is preferable to provide a light-reflecting layer on a backface of the heat sensitive layer. In this case, the heat sensitive layer can have a decreased thickness. In other words, even decreasing the heat sensitive layer's thickness can increase the contrast, which is advantageous. The reflecting layer is not specifically limited, and therefore can be properly selected according to the object, examples thereof including layers to which vacuum evaporation is treated such as Al, Ni, Sn and the like (for example, JP-A No. 64-14079).

Selectively applying the heat to the heat reversible recording medium can selectively heat the heat sensitive layer, to thereby form the white image on the transparent base and form the transparent image on the white base, with the variation thereof being repeatable. In addition, locating a coloring sheet on the backface of the heat sensitive layer can form an image (having a color of the coloring sheet) on a blank, or an image (blank) on a base having a color of the coloring sheet. Moreover, projecting the heat reversible recording medium with an OHP (over head projector) may darken the white part, while brighten the transparent part on the screen with the light transmitted.

With the heat reversible recording medium, the image forming-deleting can be carried out by using a known image processor, and use of an after described image processor of the present invention is preferable. For example, the heat sensitive layer contains the above resin and the organic low molecular compound dispersed in the resin, and is in the "white" state (opaque) at a normal temperature that is less than or equal to the temperature "$T_0$." With heating, the heat sensitive layer may gradually become transparent from the temperature "$T_1$", and with further heating at the temperature "$T_2$" to the temperature "$T_3$", the heat sensitive layer may be in the "transparent" state. Even when being returned again from this "transparent" state to the normal temperature of "$T_0$" or less, the heat sensitive layer may be kept in the "transparent" state. That is, the above resin may start getting soft at about the temperature "$T_1$." Thereafter, with the temperature increase, though the resin and the above organic low molecular compound in combination may expand, the organic low molecular compound may gradually decrease the air gap in the interface between the resin and the organic low molecular compound, due to the organic low molecular compound having larger expansion than the above resin. As a result, the transparency may be gradually increased. From the temperature "$T_2$" to the temperature "$T_3$", the above organic low molecular compound may be in a semi-melted state, then the organic low molecular compound may embed the remaining air gap, thereby bringing about the "transparent" state. When the heat sensitive layer is cooled in this state, the above organic low molecular compound may be crystallized at a comparatively high temperature, causing a volume change. In this case, the above resin being in a softened state can follow the volume change caused by the crystallization of the above organic low molecular compound, thereby keeping the "transparent" state without causing an air gap in the interface between the organic low molecular compound and the resin. Moreover, being heated to the temperature "$T_4$" or more, the heat sensitive layer may be in the "semi-transparent" state which is the middle of the maximum transparency and the maximum opacity. Then, decreasing the temperature may cause the heat sensitive layer in the "white" state (opaque), skipping the "transparent" state. That is, after being completely melted at the temperature "$T_4$" or more, the above organic low molecular compound may be in an over cooled state, and thereby may be crystallized at a temperature slightly higher than the temperature "$T_0$". In this case, the above resin can follow the volume change attributable to the crystallization of the above organic low molecular compound, thereby causing the air gap in the interface between the organic low molecular compound and the resin, resulting in the "white" state.

Examples of the above image processor preferably include those having an image forming unit configured to form the image on the heat reversible recording medium, and an image deleting unit configured to delete the image. Among the above, in view of a short treatment time, the one having the above image forming unit in combination with the above image deleting unit is preferable. Specific examples of the image processor are described as follows: 1) an image processor using a thermal head and capable of processing the image by changing the energy applied to the thermal head. 2) an image processor having: an image forming unit which is a thermal head, and an image deleting unit which is one of the following: a contact-pressing unit for adhering an exothermic body such as thermal head, ceramic heater (exothermic body with exothermic resistor screen-printed on an alumina base plate), hot stamp, heat roller, heat block and the like, and a noncontact-pressing unit using hot air, infrared ray and the like.

The heat reversible recording medium of the present invention is convenient in that disposing (uniting) the heat sensitive layer (capable of reversible-displaying) and the information memorizing part on the same card such that displaying on the heat sensitive layer a part of the memory information of the information memorizing part allows the card owner and the like to verify the information merely by viewing the card without any specific apparatus.

Herein, the information memorizing part is not specifically limited, preferable examples thereof including magnetic record, IC, non-contact IC, and light memory. The heat sensitive layer is made of iron oxide, barium ferrite and the like, vinyl chloride resin, urethane resin, nylon resin and the like which are usually used, and is coated on the supporter. Otherwise, the heat sensitive layer is formed, without using the resin, by evaporating-spattering and the like. The above heat sensitive layer may be disposed on a face opposite to the heat sensitive layer of the supporter. Otherwise, the above heat sensitive layer may be disposed between the supporter and the heat sensitive layer, in a part on the heat sensitive layer. Moreover, the reversible heat sensitive material used for the display can be used for the memory part by means of bar code, 2 dimension code and the like. Among the above, the magnetic record and the IC are moreover preferable.

With the heat reversible recording medium of the present invention, even the minimum time (milli-seconds) heating by using the thermal head can sufficiently delete the image, and the deleting energy may not change with the elapsed time after the image formation, thereby keeping a sufficient deleting property. In addition, an image that is excellent in storing property, contrast, visibility and the like after being left at rest at high temperature for a long time can be formed. The heat reversible recording medium can be preferably used for various point cards and the like which are rewritable, and can be especially preferably used for the following heat reversible recording label, heat reversible member, image processor and image processing method of the present invention.

(Heat Reversible Recording Label and Heat Reversible Recording Member)

The heat reversible recording label of the present invention at least has any one of the adhesive layer and the viscosity agent layer on a second face opposite to a first face which is formed with the image on the heat reversible recording medium of the present invention (when the heat sensitive layer is disposed on the support, the one of the adhesive layer and the viscosity agent layer is formed on the supporter's second face opposite to the supporter's first face formed with the heat sensitive layer), and has other layer properly selected when necessary.

Configuration, structure, size and the like of the adhesive layer and the viscosity agent layer are not specifically limited, and therefore can be properly selected according to the object, examples of the configuration including sheet, film and the like, examples of the structure including single layer structure and laminated structure, examples of the size including being larger or being smaller than the heat sensitive layer.

The material for the adhesive layer and the viscosity agent layer is not specifically limited, and therefore can be properly selected according to the object, examples thereof including urea resin, melamine resin, phenol resin, epoxy resin, vinyl acetate resin, vinyl acetate-acrylic copolymer, ethylene-vinyl acetate copolymer, acrylic resin, polyvinyl ether resin, vinyl chloride-vinyl acetate copolymer, polystyrene resin, polyester resin, polyurethane resin, polyamide resin, chlorinated polyolefin resin, polyvinyl butyral resin, acrylic acid ester copolymer, methacrylic acid ester copolymer, natural rubber, cyano acrylate resin, silicone resin, and the like. These may be used alone or in combination of two or more. Moreover, these may be of hot melt type, use peel paper, and be of non-peel paper type.

When the above heat reversible recording label has at least any one of the adhesive layer and the viscosity agent layer, attachment to a partly face or an entire face of a thick base plate of a magnetic stripe-vinyl chloride card and the like is accomplished (herein, application of the heat sensitive layer to the thick base plate is difficult), thereby allowing display of part of the information memorized in the magnet.

The above heat reversible recording label can replace the display label on the disk cartridge incorporating therein a disk in which the record information is rewritable, examples of the disk including flexible disk (FD), MD, DVD-RAM, and the like.

Figure 5:
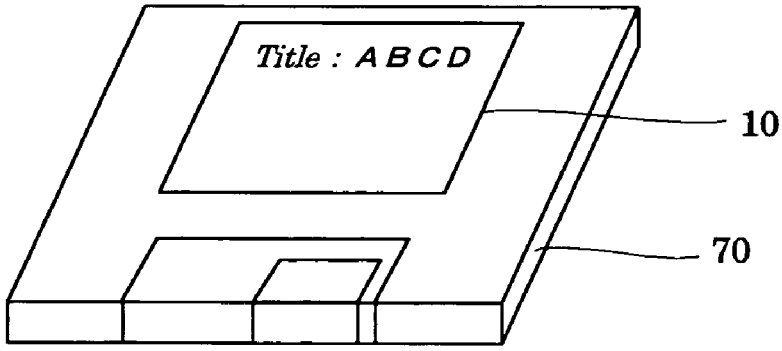
FIG. 5 is a schematic showing an example of a state where a heat reversible recording label of the present invention is attached to a disk cartridge of an MD.

FIG. 5 is a schematic showing an example of a state where the heat reversible recording label 10 of the present invention is attached to a disk cartridge 70 of an MD. In this case, according to the change of the memory content to the MD, display can be automatically changed. Herein, for a disk cartridge-free disk such as CD-RW and the like, the above heat reversible recording label of the present invention can be directly attached to the disk.

Figure 6:
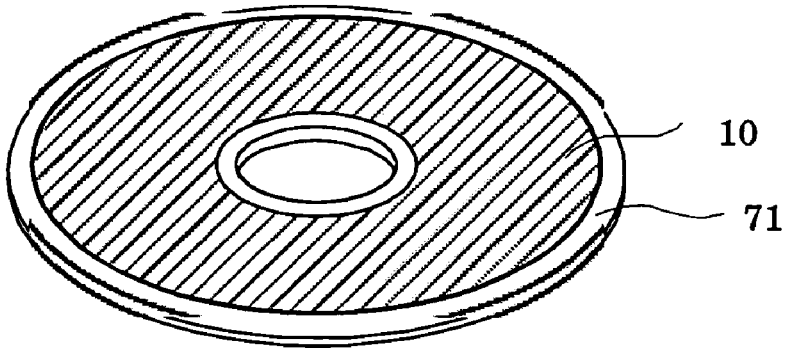
FIG. 6 is a schematic showing an example of a state where the heat reversible recording label of the present invention is attached to a CD-RW.

FIG. 6 is a schematic showing an example of a state where the heat reversible recording label 10 of the present invention is attached to a CD-RW 71. In this case, the above heat reversible recording label 10 can be attached to a writing-type disk such as CD-R and the like (in place of the CD-RW), and a part of the memory information thus written in the CD-R can be displayed in place.

Figure 7:
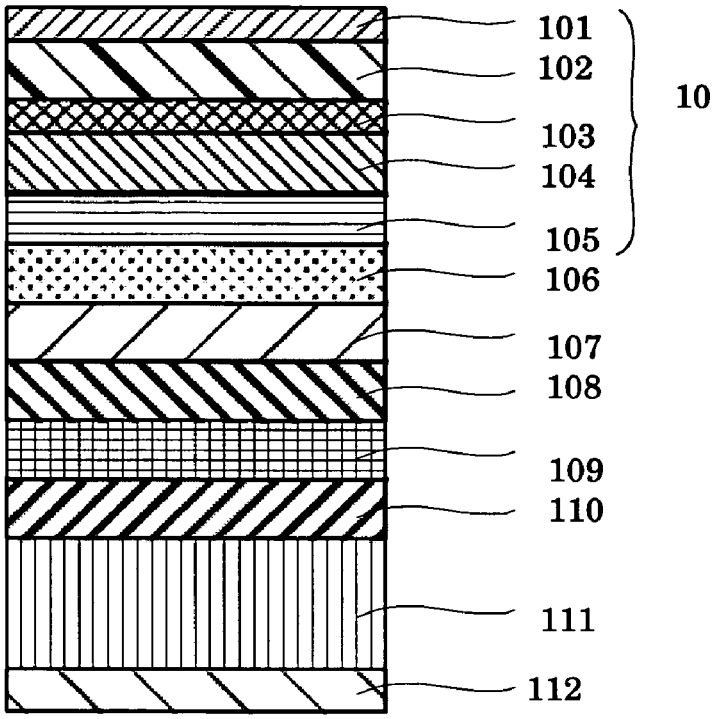
FIG. 7 is a schematic cross section showing an example of a state where the heat reversible recording label of the present invention is attached to an optical information recording medium (CD-RW).

FIG. 7 is a schematic cross section showing an example of a state where the heat reversible recording label of the present invention is attached to an optical information recording medium (CD-RW) using AgInSbTe phase change-type memorizing material. The basic structure of the CD-RW is described as follows. On a base body 111 having a guide groove, a primary dielectric layer 110, an optical information memory layer 109, a secondary dielectric layer 108, a reflection heat radiation layer 107, and a middle layer 106 are disposed in the above order. On a backface of the base body 111, a hard coat layer 112 is disposed. On to the middle layer 106 of the CD-RW, a heat reversible recording label 10 of the present invention is attached. The heat reversible recording label 10 has a layer 105 (which is one of an adhesive layer and a viscosity agent layer), a supporter 104, a light reflecting layer 103, a reversible heat sensitive layer 102, and a protective layer 101 in the above order. Herein, the above dielectric layers are not necessarily located on both sides of the optical information memory layer. When the above base body is made of a material having low heat resistance such as polycarbonate resin, however, the primary dielectric layer 110 is preferred to be located.

Figure 8:
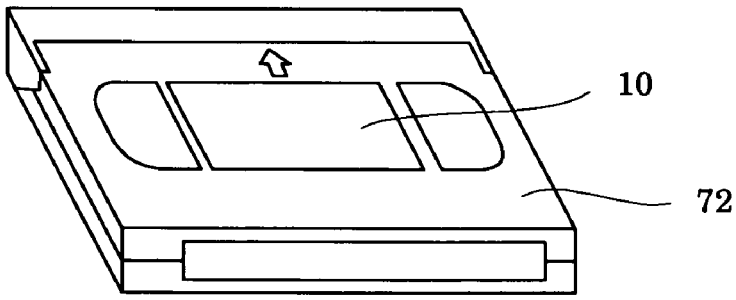
FIG. 8 is a schematic showing an example of a state where the heat reversible recording label of the present invention is attached on to a video cassette.

FIG. 8 is a schematic showing an example of a state where the heat reversible recording label 10 of the present invention is attached on to a video cassette 72. In this case, according to the change of the memory content to the video tape cassette 72, the display content can be automatically changed.

The heat reversible recording function can be set up on card, disk, disk cartridge, and tape cassette by the following methods, other than the method of attaching the heat reversible recording label: i) a method of applying the heat sensitive layer directly on to the card, the disk, the disk cartridge, and the tape cassette; ii) forming in advance the heat sensitive layer on another supporter, and then transferring the heat sensitive layer on to the card, the disk, the disk cartridge and the tape cassette; and the like. In the method of transferring the heat sensitive layer, the adhesive layer or the viscosity layer of hot melt type and the like may be located on the heat sensitive layer. In the case of attaching the heat reversible recording label on to the card, the disk, the disk cartridge and the tape cassette which are rigid, and setting up the heat sensitive layer at the above, a resilient cushion layer or a resilient cushion sheet is to be preferably located in the following manner, so as to improve contacting property with the thermal head to thereby form an even image: i) between the above rigid base body and the heat reversible recording label, and ii) between the above rigid base body and the heat sensitive layer.

The heat reversible recording medium of the present invention has the following embodiments. As is seen in FIG. 9A, there is provided a film having a reversible heat sensitive layer 13 and a protective layer 14 located on a supporter 11. As is seen in FIG. 9B, there is provided a film having an aluminum reflecting layer 12, the reversible heat sensitive layer 13, and the protective layer 14 located on the supporter 11. As is seen in FIG. 9C, there is provided a film having the aluminum reflecting layer 12, the reversible heat sensitive layer 13 and the protective layer 14 located on the supporter 11, and having a magnetic heat sensitive layer 16 located on a backface of the supporter 11.

The film (heat reversible recording medium) of each of the above embodiments can be used as a machined form 22 into a heat reversible recording card 21 having a print display part 23, as is seen in FIG. 10A. In FIG. 10B, the backface side of the card is formed with a magnetic record part 24.

Figure 11A:
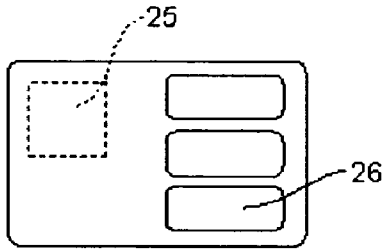
FIG. 11A is a schematic of another example of the heat reversible recording medium of the present invention, which medium is machined into a form of a card.
Figure 11B:
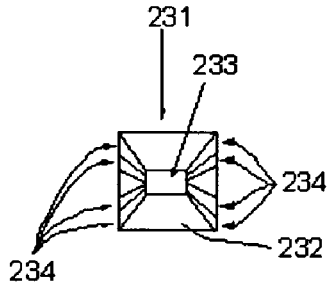
FIG. 11B is a schematic showing an IC chip embedded in a dent part for the IC chip in FIG. 11A.

Moreover, the heat reversible recording member (card) in FIG. 11A has the following structure: a film provided with an aluminum reflecting layer, a reversible heat sensitive layer, and a protective layer located on a supporter is machined into a card, and a dent part 25 housing therein an IC chip is formed. In FIG. 11A, a rewritable recording part 26 is machined to the card-shaped heat reversible recording medium as a label, and the dent part 25 for embedding therein the IC chip is formed in a predetermined position on a backface side of the card. As is seen in FIG. 11B, a wafer 231 is incorporated and fixed in the dent part 25. The wafer 231 has a wafer base plate 232 on which an integrated circuit 233 is located, and the wafer base plate 232 is provided with a plurality of contact terminals 234 electrically connected to the integrated circuit 233. Each of the contact terminals 234 is exposed on a backface side of the wafer base plate 232, and a special printer (reader writer) electrically contacts to the contact terminals 234, thereby reading out and rewriting the predetermined information.

Figure 12A:
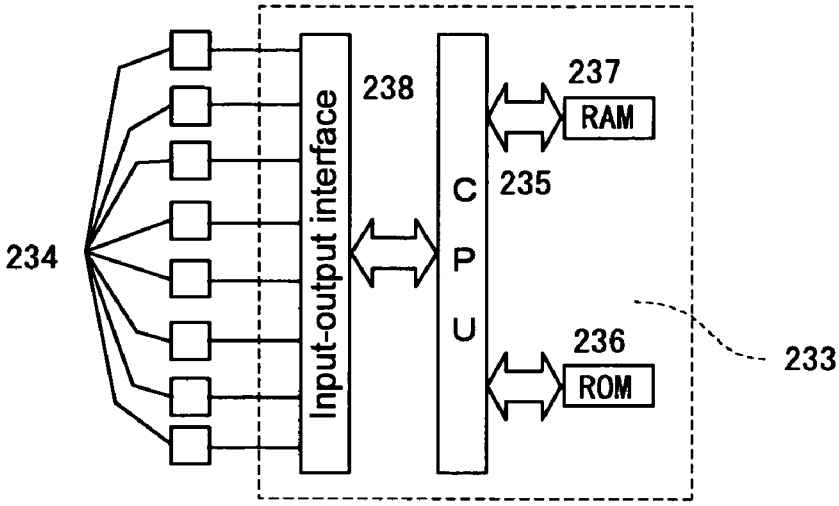
FIG. 12A is a structural block diagram, showing an integrated circuit.
Figure 12B:
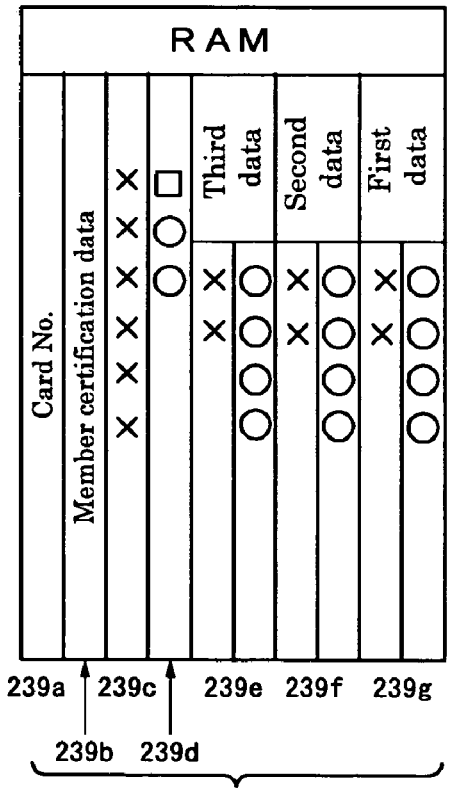
FIG. 12B is a schematic showing a RAM containing a plurality of memory zones.

Hereinafter described referring to FIGS. 12A and 12B is a function of the above heat reversible recording card. FIG. 12A is a schematic structural block diagram of the integrated circuit 233. Moreover, FIG. 12B is a structural block diagram showing an example of memory data of a RAM. The integrated circuit 233 is constituted, for example, of LSI, incorporating therein a CPU 235 capable of implementing control operation with a predetermined procedure, and a ROM 236 housing therein operation program data of the CPU 235, and a RAM 237 capable of writing and reading out necessary data. Moreover, the integrated circuit 233 includes an input-output interface 238 imparting input data to the CPU 235 after receiving an input signal and outputting an output data to an outer part after receiving an output signal from the CPU 235. Though not shown, the integrated circuit 233 also includes a power ON reset circuit, a clock generating circuit, a pulse dividing circuit (interrupting pulse generating circuit), and an address decoder circuit. According to an interrupting pulse periodically given from the pulse dividing circuit, the CPU 235 can implement an operation of an interruption control routine. Moreover, the address decode circuit may decode the address data from the CPU 235, giving to the ROM 236, the RAM 237, and the input-output interface 238 respective signals. To the input-output interface 238, the plurality (8 pieces in FIG. 12) of contact terminals 234 are connected, thereby inputting the predetermined data from the above special printer (reader writer) from the contact terminals 234 via the input-output interface 238 to the CPU 235. Responding to the input signal and according to the program data housed in the ROM 236, the CPU 235 may implement each of the operations and output the predetermined data and the signal to the sheet reader writer via the input-output interface 238.

As in seen in FIG. 12B, the RAM 237 includes a plurality of memory zones, that is, a memory zone 239*a* to a memory zone 239*g*. For example, the memory zone 239*a* memorizes a sheet number. For example, the memory zone 239*b* memorizes ID data such as sheet administrator's name, section, telephone number and the like. For example, the memory zone 239*c* memorizes information about remaining allowance usable by the user or about handling. For example, the memory zone 239*d*, the memory zone 239*e*, the memory zone 239*f* and the memory zone 239*g* memorize information about a former chief administrator, a former user and the like.

At least any one of the above heat reversible recording label and the above heat reversible recording member of the present invention is not specifically limited, can be subjected to an image processing by various image processing methods and various image processors, and can be subjected to the image forming-deleting by means of an after described image processor of the present invention.

(Image Processing Method and Image Processor)

The image processor of the present invention has at least any one of an image forming unit and an image deleting unit, moreover, other unit properly selected when necessary, examples thereof including conveying unit, controlling unit and the like.

The image processing method of the present invention carries out at least any one of an image forming and an image deleting by heating the heat reversible recording medium of the present invention, moreover, has other steps properly selected when necessary, examples thereof including conveying step, controlling step and the like.

The image processing method of the present invention can be preferably carried out with the image processor of the present invention. After heating the heat reversible recording medium of the present invention, the image forming and the image deleting can be carried out by using respectively the image forming unit and the image deleting unit. The above other steps can be carried out, respectively, with the above other units.

Image Forming Unit and Image Deleting Unit

The above image forming unit can form the image by heating the heat reversible recording medium of the present invention. Meanwhile, the above image deleting unit can delete the image by heating the heat, reversible recording medium of the present invention.

The above image forming unit is not specifically limited, and therefore can be properly selected according to the object, examples thereof including thermal head, laser and the like. These can be used alone or in combination of two or more.

The above image deleting unit can delete the image by heating the heat reversible recording medium of the present invention, examples thereof including hot stamp, ceramic heater, heat roller, hot air, thermal head, laser and the like. Among the above, the ceramic heater is preferable. Use of the above ceramic heater can make the unit smaller, and can obtain a stable deleting state, bringing about a good-contrast image. Set temperature of the above ceramic heater is not specifically limited, and therefore can be properly selected according to the object, preferable examples thereof including 110° C. or more, 112° C. or more being more preferable, and 115° C. or more being especially preferable.

Use of the thermal head can accomplish still smaller size, decreasing the power consumption, and allowing use of battery driven handy-type apparatus. Moreover, the thermal head can combine the above image recording and the image deleting, in this case, further smaller size is accomplished. When using the thermal head having the combined function of the recording-deleting, at first a former image is to be deleted entirely, and then a new image can be recorded; otherwise an over writing method is available in which the energy is changed per image and the former image is to be deleted at once to thereby record the new image. The over writing method can decrease the time for the above image recording combined with the time for the image deleting, leading to increase in recording speed.

When the heat reversible recording member (card) having the heat sensitive layer and the information memorizing part is used, the above apparatus may include a unit of reading the memory of the information memory part and a unit of rewriting the memory of the information memory part.

As long as having a function of sequentially conveying the heat reversible recording medium, the above conveying unit is not specifically limited, and therefore can be properly selected according to the object, examples thereof including a conveying belt, a conveying roller, a combination of the conveying belt and the conveying roller, and the like.

As long as having a function of controlling each of the above steps, the above controlling unit is not specifically limited, examples thereof including apparatuses such as a sequencer, a computer and the like.

Figure 13A:
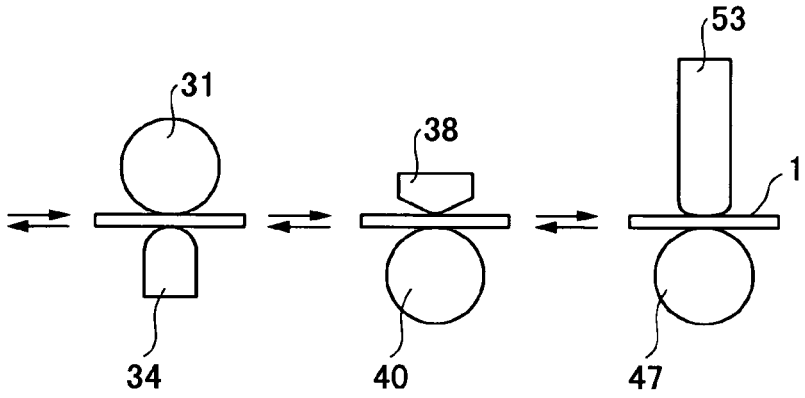
FIG. 13A is a schematic of an image processor including a ceramic heater for deleting an image and a thermal head for forming the image.

Hereinafter described referring to FIG. 13 is a first embodiment (mode) for carrying out the image processing method of the present invention by means of the image processor of the present invention. The image processor in FIG. 13 is provided with a thermal head 53 (the above heating unit), a ceramic heater 38, a magnetic head 34, a conveying roller 31, a conveying roller 40 and a conveying roller 47. As is seen in FIG. 13A, the magnetic head of the image processor, at first, reads the information memorized in the magnetic heat sensitive layer of the recording medium. Then, the ceramic heater may delete, by heating, the image recorded in the reversible heat sensitive layer. Moreover, new information processed based on the information read by the magnetic head is recorded in the reversible heat sensitive layer with the thermal head. Thereafter, the information about the magnetic heat sensitive layer may be also rewritten into new information.

In the image processor in FIG. 13A, the heat reversible recording medium 1 provided with the magnetic heat sensitive layer on the opposite side of the reversible heat sensitive layer may be conveyed along a conveying passage in such a manner as to make a round trip indicated by arrows. The magnetic heat sensitive layer of the heat reversible recording medium 1 is subjected to the magnetic recording-deleting between the magnetic head 34 and the conveying roller 31, and then is subjected to the image deleting between the ceramic heater 38 and the conveying roller 40 by heating, and then subjected to the image forming between the thermal head 53 and the conveying roller 47. Thereafter, the heat reversible recording medium 1 is conveyed out of the image processor. As described above, the ceramic heater 38 preferably has a set temperature of 110° C. or more, 112° C. or more being moreover preferable, and 115° C. or more being especially preferable. Herein, rewriting of the magnetic record may be carried out before or after the image deleting by the ceramic heater 38. After passing through between the ceramic heater 38 and the conveying roller 40, or after passing through between the thermal head 53 and the conveying roller 47, the heat reversible recording medium 1 may be conveyed in the opposite direction in the conveying passage, when so desired. Reheating with the ceramic heater 38 and reprinting with the thermal head 53 can thus be carried out.

Figure 13B:
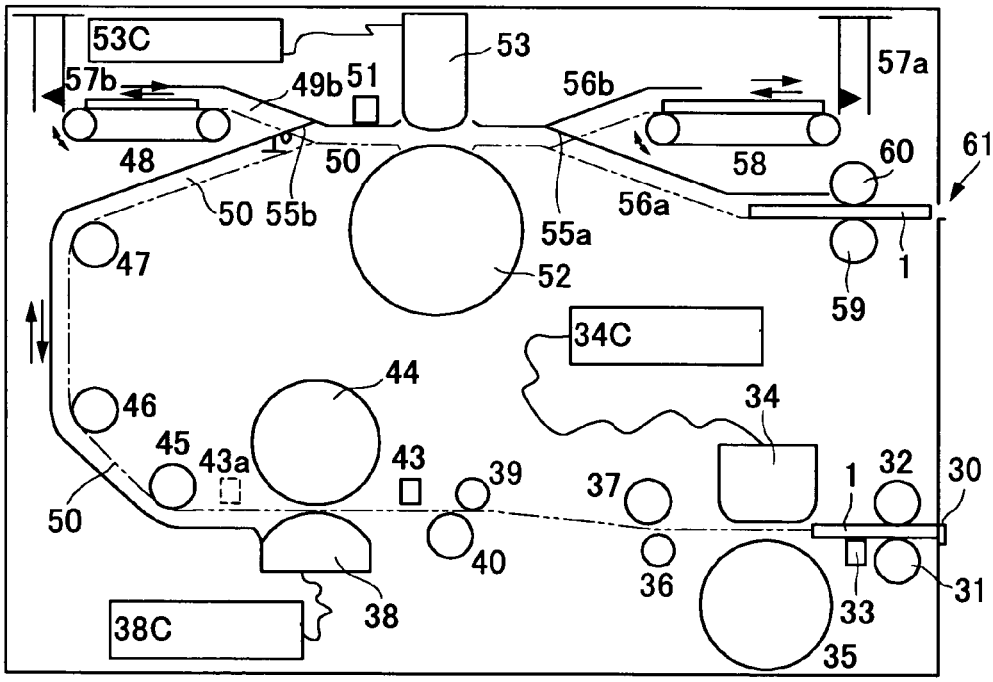
FIG. 13B is a schematic showing an example of an image processor of the present invention.
Figure 14:
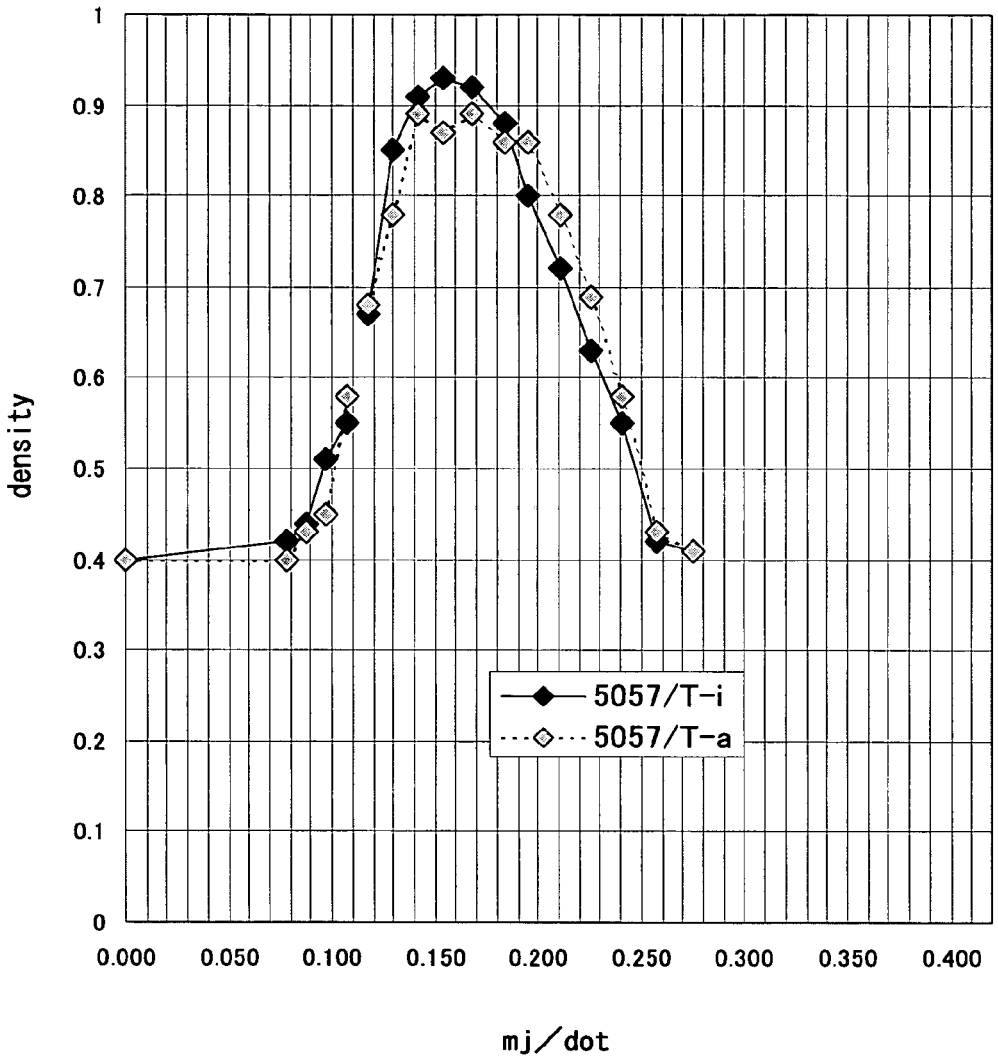
FIG. 14 is a graph showing a deleting energy relative to a deleting density, according to an example 1.
Figure 15:
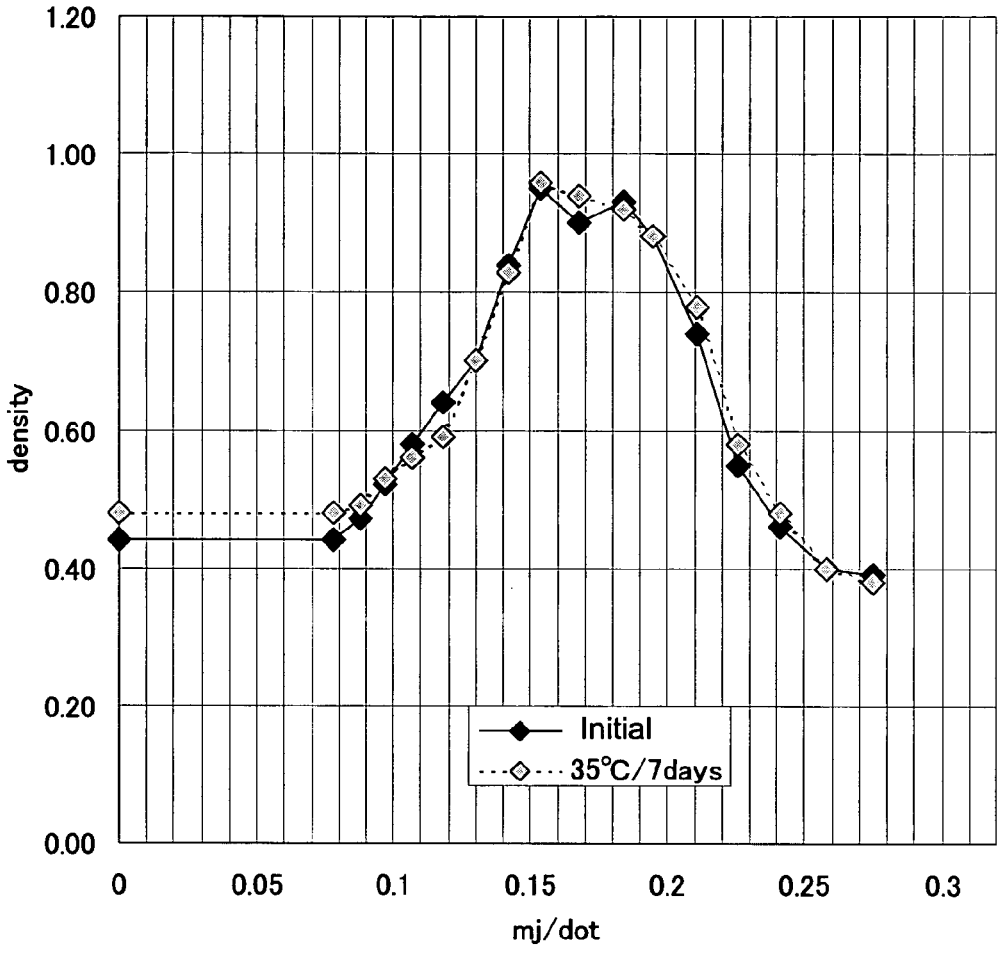
FIG. 15 is a graph showing a deleting energy relative to a deleting density, according to an example 2.
Figure 16:
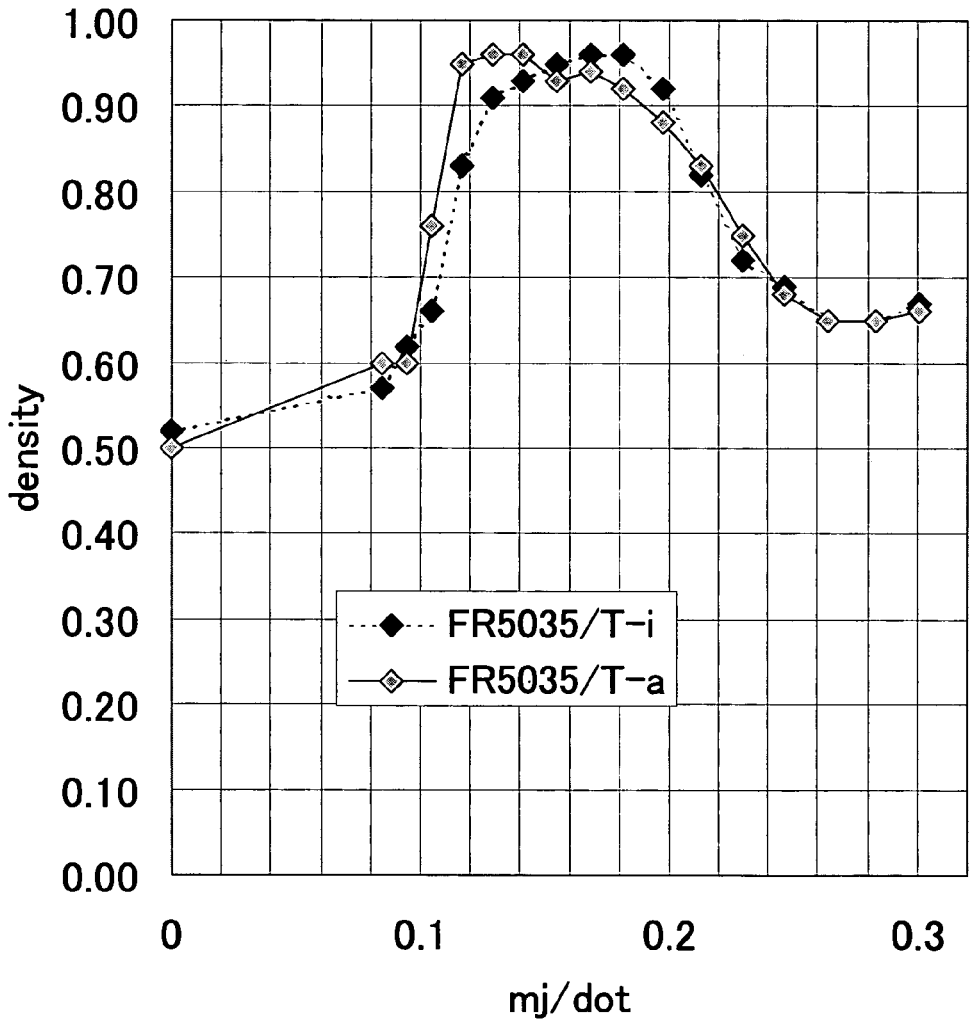
FIG. 16 is a graph showing a deleting energy relative to a deleting density, according to an example 3.
Figure 17:
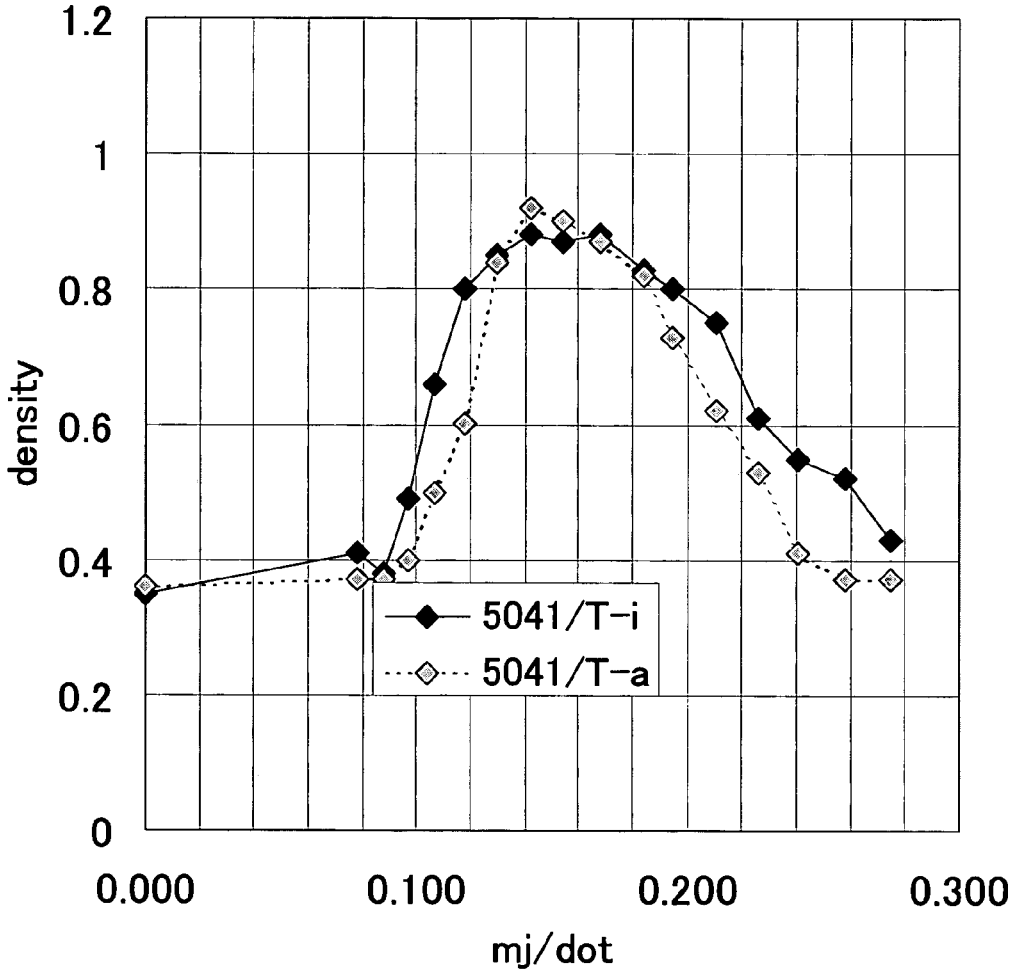
FIG. 17 is a graph showing a deleting energy relative to a deleting density, according to an example 4.
Figure 18:
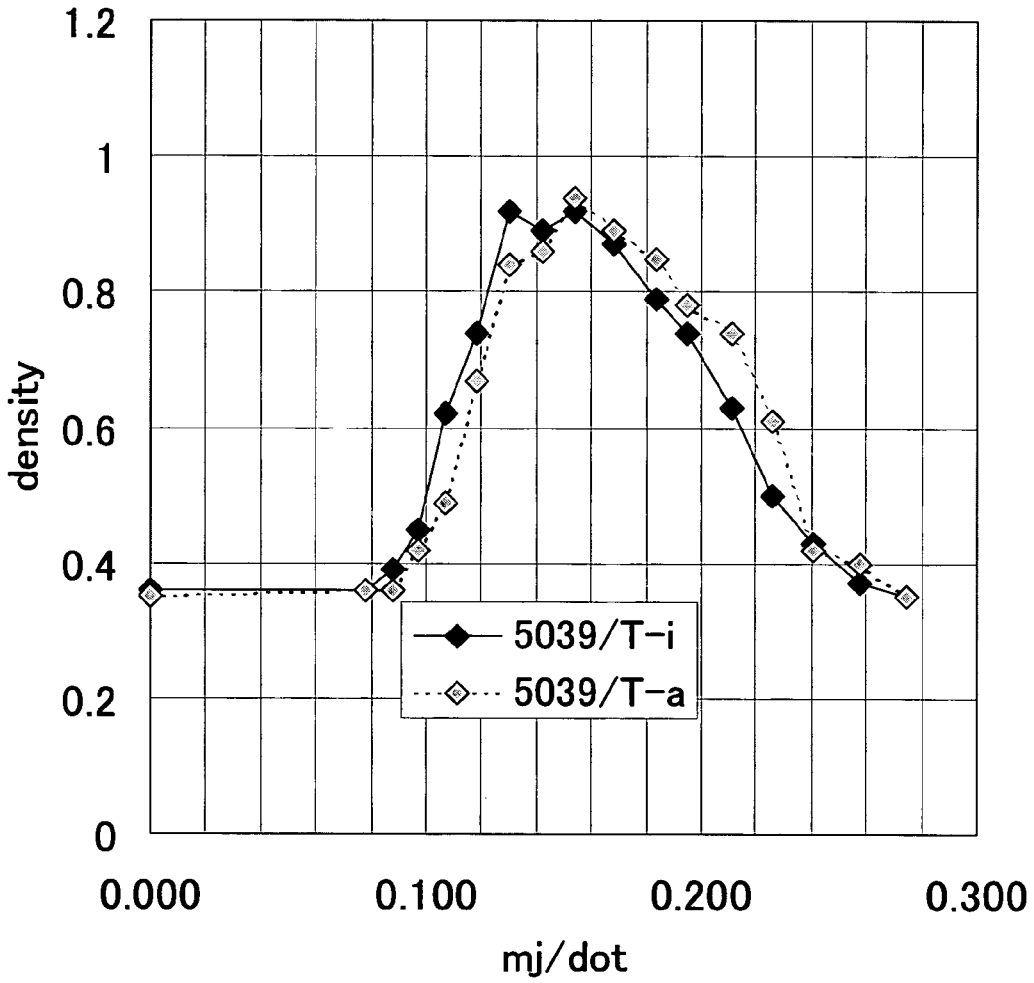
FIG. 18 is a graph showing a deleting energy relative to a deleting density, according to an example 5.
Figure 19:
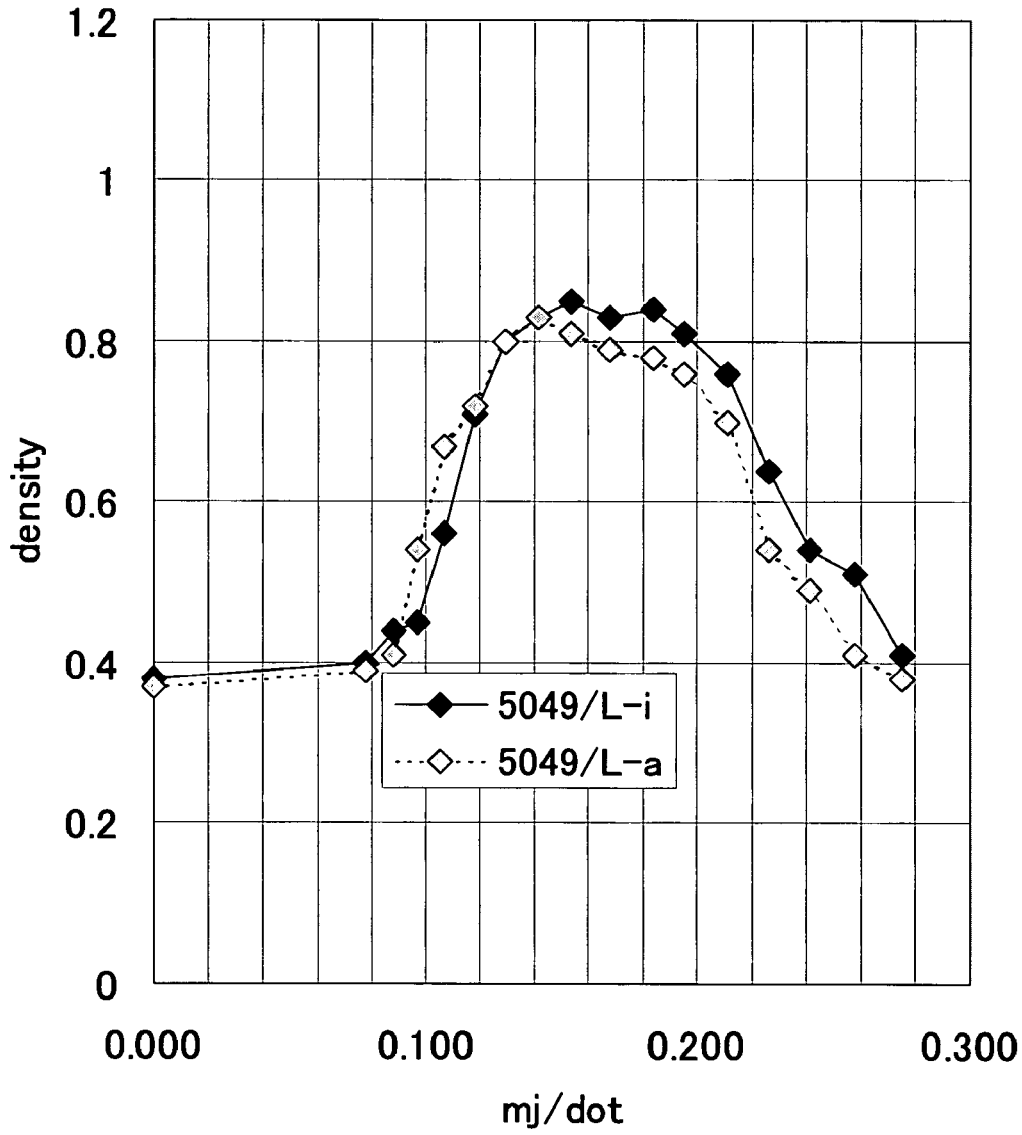
FIG. 19 is a graph showing a deleting energy relative to a deleting density, according to an example 6.

In the image processor in FIG. 13B, the heat reversible recording medium 1 inserted through an entrance-exit 30 may proceed along a conveying passage 50 indicated by two-point broken line, or may proceed in the opposite direction along the conveying passage 50 in the image processor. The heat reversible recording medium 1 inserted through the entrance-exit 30 may be conveyed by means of a conveying roller 31 and a guide roller 32 in the recording apparatus. Reaching a predetermined position of the conveying passage 50, the heat reversible recording medium 1 may be sensed with a sensor 33, then the magnetic heat sensitive layer of the heat reversible recording medium 1 may be subjected to the magnetic recording or the record deleting, via a controlling unit 34*c*, between the magnetic head 34 and a platen roller 35, then the heat reversible recording medium 1 may pass through between a guide roller 36 and a conveying roller 37, then may pass through between a guide roller 39 and a conveying roller 40, then may be subjected to the heating for the image deleting between a ceramic heater 38 (which operates via a ceramic heater controlling unit 38*c* when the heat reversible recording medium 1 is sensed with a sensor 43) and a platen roller 44, and then may be conveyed in the conveying passage 50 by means of a conveying roller 45, a conveying roller 46 and a conveying roller 47. The image forming is carried out in a predetermined position between the thermal head 53 (which operates via a thermal head controlling unit 53*c* when the heat reversible recording medium 1 is sensed with a sensor 51) and a platen roller 52. Then, the heat reversible recording medium 1 is conveyed from a conveying passage 56*a* to an exit 61 by means of a conveying roller 59 and a guide roller 60 to be ousted from the image processor. Herein, set temperature of the ceramic heater 38 is not specifically limited, and therefore can be properly selected according to the object, as above described, 110° C. or more is preferable, 112° C. or more is more preferable, and 115° C. or more is especially preferable.

When desired, the following operations are allowed: i) switching a conveying passage switching unit 55*a* to thereby lead the heat reversible recording medium 1 to a conveying passage 56*b*, ii) conveying the heat reversible recording medium 1 to between the thermal head 53 and the platen roller 52 by means of a conveying belt 58 which is operated in the opposite direction with a limit switch 57*a* turned on by pressing of the heat reversible recording medium 1, iii) heating again the heat reversible recording medium 1 between the thermal head 53 and the platen roller 52, iv) switching a conveying passage switching unit 55*b* to thereby activate a conveying passage 49*b*, a limit switch 57*b*, and a conveying belt 48, conveying the heat reversible recording medium 1 in the forward direction, and v) conveying the heat reversible recording medium 1 from the conveying passage 56*a* by means of the conveying roller 59 and the guide roller 60 to the exit 61, to be ousted from the image processor. Moreover, the above branched conveying passages and the conveying switching unit can be located on both sides of the ceramic heater 38. In this case, the sensor 43*a* is desirably to be put between the platen roller 44 and the conveying roller 45.

The image processor and the image processing method of the present invention can carry out the treatment for a short time at high speed, thereby the thermal head and the like can sufficiently carry out the forming and deleting of the image for a short time. In addition, the thus formed image has an excellent deleting property and a high contrast even after a long term storage.

Hereinafter described are examples of the present invention. The present invention is, however, not limited to the examples.

SYNTHESIS EXAMPLE 1

Synthesis of Acrylic Resin (A1)

Styrene 132 mass part, methacrylic acid methyl 297 mass part, acrylic acid 2-ethyl hexyl 54 mass part, acrylic acid 4-hydroxy butyl 108 mass part, and methacrylic acid 9 mass part are mixed, to thereby prepare a monomer mixture. Into a 2-liter flask having four openings, acetic acid butyl 360 mass part and the above monomer mixture 540 mass part were introduced as a solvent. To the remaining monomer mixture, Kayaester O (made by Kayaku Akzo Corporation) 6.6 mass part was added as a starting agent, to thereby prepare a droplet monomer mixture for droplet. After keeping the in-flask temperature at 120° C., the above droplet monomer mixture was dropped for 4 hours, then after the droplet completion, acetic acid butyl 30 mass part was introduced. With the in-flask temperature kept at 120° C. for one hour, a starting agent mixture made of Kayaester O as an additional starting agent 1.2 mass part and acetic acid butyl 30 mass part was added (batch) 3 times every one hour. Moreover, after the in-flask temperature kept at 120° C. for one hour, the in-flask temperature was cooled to 80° C. or less, at this point in time, methyl ethyl ketone (MEK) 360 mass part was introduced, and cooled, to thereby synthesize acrylic resin (A1) of the synthesis example 1. Herein, the thus obtained acrylic resin (A1) was stored in a can. The thus obtained acrylic resin (A1) has properties including viscosity (bubble viscosimeter)-J, heating balance 42.1% by mass, acid value 4.1 mgKOH/g, hydroxyl value 70, and weight average molecular weight 39,000. Moreover, the acrylic resin has a calculated glass transition temperature (Tg) 45° C., and calculated refractive index 1.5115.

EXAMPLE 1

Preparation of Heat Reversible Recording Medium

At first, to a PET film side of a magnetic made by Dainippon Ink and Chemicals, Incorporated (branded as MEMORY DIC, DS-1711-1040: a magnetic heat sensitive layer and a self cleaning layer are coated on to a transparent PET film having thickness 188 μm), aluminum (Al) was vacuum-evaporated in such a manner as to form thickness about 400 angstrom, to thereby provide a light reflecting layer. Then, on to the light reflecting layer, an application solution for an adhesive layer which solution made from vinyl chloride-vinyl acetate-phosphoric acid ester copolymer (DENKA vinyl #1000P made by Denki Kagaku Kogyo Kabushiki Kaisha) 10 mass part, methyl ethyl ketone 45 mass part, and toluene 45 mass part was applied, followed by heating-drying, to thereby provide an adhesive layer having thickness about 0.5 μm. Then, on to the adhesive layer, an application solution for the heat sensitive layer which solution is made from stearyl stearate (M9676 made by NOF CORPORATION) 5 mass part, eicosane diacid (SL-20-90 made by Okamura Oil Mill Ltd.) 5 mass part, acrylic resin (A1) 27 mass part of the synthesis example 1, isocyanate compound (CORONATE 2298-90T made by Nippon Polyurethane Industry Co., Ltd.) 3 mass part, xylene 40 mass part, and tetrahydro furan 160 mass part was applied, followed by heating-drying at 130° C. for 3 minutes, to thereby provide a heat sensitive layer having thickness about 10 μm, then heated at 60° C. for 48 hours, to thereby cure the heat sensitive layer. Then, on to the heat sensitive layer, an application solution for a protective layer which solution is made from a urethane acrylate ultraviolet ray setting resin (UNIDIC C7-157 made by Dainippon Ink and Chemicals, Incorporated) 75% by mass acetic acid butyl solution 10 mass part, and isopropyl alcohol 10 mass part was applied with a wire-bar, followed by heating-drying, followed by curing with ultraviolet ray lamp of 80 W/cm, to thereby provide a protective layer having thickness about 2 μm. The above wraps up the preparation of the heat reversible recording medium of the example 1.

SYNTHESIS EXAMPLE 2

Synthesis of Acrylic Resin (A2)

The synthesis example 1 was likewise carried out, except that the above monomer mixture was substituted with a monomer mixture 600 mass part made from styrene 132 mass part, methacrylic acid methyl 309 mass part, acrylic acid 2-ethyl hexyl 42 mass part, acrylic acid 4-hydroxy butyl 108 mass part, methacrylic acid 9 mass part, to thereby synthesize the acrylic resin (A2) of the synthesis example 2. The thus obtained acrylic resin (A2) had solution properties including viscosity (bubble viscosimeter)-G, heating balance 42.1% by mass, acid value 4.1 mgKOH/g, hydroxyl value 70, and weight average molecular weight 40,000. Moreover, acrylic resin (A2) had calculated glass transition temperature (Tg) 50° C., and calculated refractive index 1.5115.

EXAMPLE 2

Preparation of Heat Reversible Recording Medium

The example 1 was likewise carried out, except that the acrylic resin (A1) of the synthesis example 1 was substituted with an acrylic resin (A2) of the synthesis example 2, to thereby prepare a heat reversible recording medium of the example 2.

SYNTHESIS EXAMPLE 3

Synthesis of Acrylic Resin (A3)

The synthesis example 1 was likewise carried out, except that the above monomer mixture was substituted with a monomer mixture 600 mass part made from styrene 150 mass part, methacrylic acid methyl 123 mass part, methacrylic acid benzil 132 mass part, acrylic acid 2-ethyl hexyl 78 mass part, acrylic acid 4-hydroxy butyl 108 mass part, methacrylic acid 9 mass part, to thereby synthesize the acrylic resin (A3) of the synthesis example 3. The thus obtained acrylic resin (A3) had solution properties including viscosity (bubble viscosimeter)-D, heating balance 41.5% by mass, acid value 4.5 mgKOH/g, hydroxyl value 70, and weight average molecular weight 38,000. Moreover, the acrylic resin had calculated glass transition temperature (Tg) 30° C., and calculated refractive index 1.5308.

EXAMPLE 3

Preparation of Heat Reversible Recording Medium

The example 1 was likewise carried out, except that the acrylic resin (A1) was substituted with an acrylic resin (A3), and that the above isocyanate compound was substituted with CORONATE HL (made by Nippon Polyurethane Industry Co., Ltd.), to thereby prepare the heat reversible recording medium of the example 3.

SYNTHESIS EXAMPLE 4

Synthesis of Acrylic Resin (A4)

The synthesis example 1 was likewise carried out, except that the above monomer mixture was substituted with a monomer mixture 600 mass part made from styrene 120 mass part, methacrylic acid methyl 153 mass part, methacrylic acid benzil 180 mass part, acrylic acid 2-ethyl hexyl 30 mass part, acrylic acid 4-hydroxy butyl 108 mass part, and methacrylic acid 9 mass part, to thereby synthesize the acrylic resin (A4) of the synthesis example 4. The thus obtained acrylic resin (A4) had solution properties including viscosity (bubble viscosimeter)-R, heating balance 50.9% by mass, acid value 5.1 mgKOH/g, Tg 40° C., hydroxyl value 70, and weight average molecular weight 41,000. Moreover, the acrylic resin had calculated refractive index 1.532.

EXAMPLE 4

Preparation of Heat Reversible Recording Medium

The example 1 was likewise carried out, except that the acrylic resin (A1) was substituted with an acrylic resin (A4), to thereby prepare the heat reversible recording medium of the example 4.

SYNTHESIS EXAMPLE 5

Synthesis Example of Acrylic Resin (A5)

The synthesis example 1 was likewise carried out, except that the above monomer mixture was substituted with a monomer mixture 600 mass part made from styrene 125 mass part, methacrylic acid methyl 291 mass part, acrylic acid 2-ethyl hexyl 67 mass part, acrylic acid 4-hydroxy butyl 108 mass part, and methacrylic acid 9 mass part, to thereby synthesize the acrylic resin (A5) of the synthesis example 5. The thus obtained acrylic copolymer (A5) had solution properties including viscosity (bubble viscosimeter)-C, heating balance 40.4% by mass, acid value 4.2 mgKOH/g, Tg 40° C., hydroxyl value 70, and weight average molecular weight 37, 800. Moreover, the acrylic resin had calculated refractive index 1.5113.

EXAMPLE 5

Preparation of Heat Reversible Recording Medium

The example 1 was likewise carried out, except that the acrylic resin (A1) was substituted with an acrylic resin (A5), to thereby prepare the heat reversible recording medium of the example 5.

SYNTHESIS EXAMPLE 6

Synthesis of Acrylic Resin (A6)

The synthesis example 1 was likewise carried out, except that the above monomer mixture was substituted with a monomer mixture 600 mass part made from styrene 100 mass part, methacrylic acid methyl 290 mass part, acrylic acid butyl 93 mass part, acrylic acid 4-hydroxy butyl 108 mass part, and methacrylic acid 9 mass part, to thereby synthesize the acrylic resin (A6) of the synthesis example 6. The thus obtained acrylic resin (A6) had solution properties including viscosity (bubble viscosimeter)-D, heating balance 40.2% by mass, acid value 4.1 mgKOH/g, Tg 40° C., and weight average molecular weight 42,000. Moreover, the acrylic resin had calculated refractive index 1.5116.

EXAMPLE 6

Preparation of Heat Reversible Recording Medium

The example 1 was likewise carried out, except that the acrylic resin (A1) was substituted with an acrylic resin (A6), and that the above isocyanate compound was substituted with CORONATE HL (made by Nippon Polyurethane Industry Co., Ltd.), to thereby prepare the heat reversible recording medium of the example 6.

SYNTHESIS EXAMPLE 7

Synthesis of Acrylic Resin (A7)

The synthesis example 1 was likewise carried out, except that the above monomer mixture was substituted with a monomer mixture made from styrene 210 mass part, methacrylic acid methyl 229.2 mass part, acrylic acid 2-ethyl hexyl 90 mass part, acrylic acid 4-hydroxy butyl 58.8 mass part, and methacrylic acid 12 mass part, to thereby synthesize the acrylic resin (A7) of the synthesis example 7. The thus obtained acrylic resin (A7) had solution properties including viscosity (bubble viscosimeter)-D, heating balance 40% by mass, acid value 4.3 mgKOH/g, glass transition temperature (Tg) 50° C., and weight average molecular weight 40,000. Moreover, the acrylic resin had calculated refractive index 1.5257.

EXAMPLE 7

Preparation of Heat Reversible Recording Medium

At first, to a PET film side of a magnetic made by Dainippon Ink and Chemicals, Incorporated (branded as MEMORY DIC, DS-1711-1040: a magnetic heat sensitive layer and a self cleaning layer are coated on to a transparent PET film having thickness 188 μm), aluminum (Al) was vacuum-evaporated in such a manner as to form thickness about 400 angstrom, to thereby provide a light reflecting layer. Then, on to the light reflecting layer, application solution for an adhesive layer which solution made from vinyl chloride-vinyl acetate-phosphoric acid ester copolymer (DENKA vinyl #1000P made by Denki Kagaku Kogyo Kabushiki Kaisha) 10 mass part, methyl ethyl ketone 45 mass part, and toluene 45 mass part was applied, followed by heating-drying, to thereby provide an adhesive layer having thickness about 0.5 μm. Then, to the acrylic resin (A7) 502 mass part of the synthesis example 7, stearyl stearate (SS96 made by Miyoshi Oil & Fat Co., Ltd.) 63 mass part was added, then isocyanate compound 8 mass part expressed by the following structural formula (A), isocyanate compound 9 mass part expressed by the following structural formula (B), and methyl ethyl ketone 220 mass part were dispersed for 35 hours by using Paint shaker (made by Asada Tekko) with ceramic beads (having diameter about 2 mm) put in a glass bottle, to thereby prepare a dispersing liquid A.

Structural formula (A)

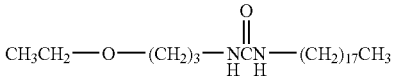

-continued

Structural formula (B)

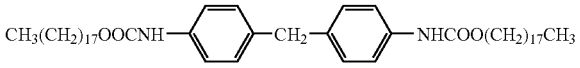

Then, a disperse solution made from the above dispersing liquid A 400 mass part, methyl ethyl ketone 209 mass part, isocyanate compound (E-402-90T made by Asahi Kagaku Kogyo Co., Ltd.) 35 mass part, o-xylene 115 mass part, and leveling agent (ST102PA MEK 1% by mass solution) 4 mass part was applied on to the above adhesive layer, followed by heating-drying at 125° C. for 1 minute, to thereby provide a heat sensitive layer having thickness about 11 μm, followed by heating at 50° C. for 48 hours, and followed by curing. Then, a protective layer was formed on the heat sensitive layer, like the example 1. The above wraps up the preparation of the heat reversible recording medium of the example 7.

EXAMPLE 8

Preparation of Heat Reversible Recording Medium

The example 7 was likewise carried out, except that the application solution for the heat sensitive layer was not added by the isocyanate compound expressed by the above structural formula (A) and the above structural formula (B), to thereby prepare a heat reversible recording medium of the example 8.

COMPARATIVE EXAMPLE 1

Preparation of Heat Reversible Recording Medium

At first, to a PET film side of a magnetic made by Dainippon Ink and Chemicals, Incorporated (branded as MEMORY DIC, DS-1711-1040: magnetic heat sensitive layer and self cleaning layer are coated on to a transparent PET film having thickness 188 μm), aluminum (Al) was vacuum-evaporated in such a manner as to form thickness about 400 angstrom, to thereby provide a light reflecting layer. Then, on to the light reflecting layer, an application solution for an adhesive layer made from vinyl chloride-vinyl acetate-phosphoric acid ester copolymer (DENKA vinyl #1000P made by Denki Kagaku Kogyo Kabushiki Kaisha) 10 mass part, methyl ethyl ketone 45 mass part, and toluene 45 mass part was applied, followed by heating-drying, to thereby provide an adhesive layer having thickness about 0.5 μm. Then, on to the adhesive layer, an application solution for the heat sensitive layer which solution is made from vinyl chloride-vinyl acetate copolymer (SOLBINE C, vinyl chloride/vinyl acetate=87/13 (mole ratio) made by Nisshin Chemical Industry Co., Ltd.) 120 mass part, hexadecyl stearate 40 mass part, dodecane diacid 10 mass part, stearone (18-pentatriacontanon) 10 mass part, and THF (tetrahydrofuran) 945 mass part was applied, followed by heating-drying at 120° C. for 2 minutes, to thereby provide a heat sensitive layer having thickness about 10 μm, followed by heating at 60° C. for 48 hours, to thereby cure the heat sensitive layer. Then, on to the heat sensitive layer, an application solution for a protective layer which solution made from a urethane acrylate ultraviolet ray setting resin (UNIDIC C7-157 made by Dainippon Ink and Chemicals, Incorporated) 75% by mass acetic acid butyl solution 10 mass part, and isopropyl alcohol 10 mass part was applied with a wire-bar, followed by heating-drying, followed by curing with ultraviolet ray lamp of 80 W/cm, to thereby provide a protective layer having thickness about 2 μm. The above wraps up the preparation of the heat reversible recording medium of the comparative example 1.

COMPARATIVE EXAMPLE 2

Preparation of Heat Reversible Recording Medium

The comparative example 1 was likewise carried out, except that the application solution for the heat sensitive layer was made from vinyl chloride-vinyl acetate copolymer (SOLBINE C, vinyl chloride/vinyl acetate=87/13 (mole ratio) made by Nisshin Chemical Industry Co., Ltd.) 80 mass part, dihexadecyl thio ether 28 mass part, dodecane diacid 12 mass part, and THF (tetrahydrofuran) 630 mass part, to thereby prepare the heat reversible recording medium of the comparative example 2.

COMPARATIVE EXAMPLE 3

Preparation of Heat Reversible Recording Medium

The comparative example 1 was likewise carried out, except that on the above adhesive layer, an application solution for the heat sensitive layer which solution including VMCH (copolymer of vinyl chloride 85% by mass to 87% by mass, MA (maleic acid) 0.7% by mass to 1% by mass, and vinyl acetate balance %; made by UCC) 50 mass part, dodecane diacid 25 mass part, stearyl behenate 60 mass part, 1–9 nonanediol acrylate 20 mass part, low Tg acrylic resin (S2040, solid content 30% by mass, made by Toagosei Co., Ltd.) 120 mass part, IRGACURE 184 (curing agent made by Ciba-Geigy) 10 mass part, dimethyl polysiloxane-polyoxy alkylene copolymer leveling agent (ST102PA made by Dow Corning Toray Silicone Co., Ltd.) 10 mass part, and THF (tetrahydrofuran) 962 mass part was applied, followed by heating-drying at 130° C. for 1 minutes, followed by 80 W/cm×2-lamp UV irradiation, to thereby provide a heat sensitive layer having thickness about 10 μm, followed by heating at 60° C. for 48 time for curing, to thereby prepare the heat reversible recording medium of the comparative example 3.

COMPARATIVE EXAMPLE 4

Preparation of Heat Reversible Recording Medium

The comparative example 1 was likewise carried out, except that an application solution for the heat sensitive layer which solution including VYHH (copolymer of vinyl chloride 85% by mass to 87% by mass and vinyl acetate balance %; made by UCC) 120 mass part, behenyl behenate 50 mass part, dodecane diacid 10 mass part, low Tg acrylic resin (S2040, solid content 30% by mass, made by Toagosei Co., Ltd.) 240 mass part, isocyanate compound (CORONATE L made by Nippon Polyurethane Industry Co., Ltd.) 10 mass part, dimethyl polysiloxane-polyoxy alkylene copolymer leveling agent (ST102PA made by Dow Corning Toray Silicone Co., Ltd.) 10 mass part, and THF (tetrahydrofuran) 1183 mass part was used, to thereby prepare the heat reversible recording medium of the comparative example 4.

COMPARATIVE EXAMPLE 5

Preparation of Heat Reversible Recording Medium

At first, to a solution 500 mass part having solid content 15% by mass which solution is made by dissolving vinyl chloride copolymer (ZEON CORPORATION made by, MR110) into THF (tetrahydrofuran), $HOOC(CH_2)_5NHCO(CH_2)CONH(CH_2)_5COOH_{15}$ was added, then ceramic beads having diameter about 2 mm was put in a glass bottle, then the resultant was dispersed using a Paint shaker (made by Asada Tekko) for 48 hours, to thereby prepare a dispersing liquid A. Then, behenic acid (behenic acid 95 made by Miyoshi Oil & Fat Co., Ltd.) 110 mass part, eicosane diacid (SL-20-90 made by Okamura Oil Mill Ltd.) 25 mass part, vinyl chloride copolymer (MR110 made by ZEON CORPORATION) 300 mass part, THF (tetrahydrofuran) 170 mass part, and o-xylene 60 mass part was mixed by an ordinary method, to thereby prepare a dispersing liquid B. Then, the above dispersing liquid A 8 mass part, the above dispersing liquid B 270 mass part, and isocyanate compound (2298-90T made by Nippon Polyurethane Industry Co., Ltd.) 60 mass part were mixed, to thereby prepare an application solution for the heat sensitive layer. Then, the comparative example 1 was likewise carried out, except that the above prepared application solution for the heat sensitive layer was used, to thereby prepare the heat reversible recording medium of the comparative example 5.

COMPARATIVE EXAMPLE 6

Preparation of Heat Reversible Recording Medium

The comparative example 1 was likewise carried out, except that on to the above adhesive layer, an application solution for the heat sensitive layer which solution made from 1, 18-octadeca dicarboxylic acid dodecyl (made by Miyoshi Oil & Fat Co., Ltd.) 4.75 mass part, eicosane diacid (SL-20-99 made by Okamura Oil Mill Ltd.) 5.25 mass part, vinyl chloride-vinyl acetate copolymer (M2018, vinyl chloride 80% by mass, vinyl acetate 20% by mass, average polymerization=1800; made by Kaneka) 28 mass part, reactive polymer (NK polymer B-3015H made by Shin-nakamura Chemical Corporation) 4.7 mass part, THF (tetrahydrofuran) 215.5 mass part, amyl alcohol 24 mass part, and dibutyl tin laurate stabilizer (Stann SCAT-1 made by Sankyo Organic Chemicals Co., Ltd.) 0.8 mass part was applied, followed by heating-drying, to thereby provide a heat sensitive layer (reversible heat sensitive layer) having thickness about 8 μm. Then, an electron beam irradiation was carried out on the heat sensitive layer, by using, as an electron beam irradiating apparatus, an area beam type electron beam irradiating apparatus EBC-200-AA2 made by NHV Corporation, with an irradiation dosage adjusted to 10 Mrad, to thereby prepare the heat reversible recording medium of the comparative example 6.

COMPARATIVE EXAMPLE 7

Preparation of Heat Reversible Recording Medium

The comparative example 1 was likewise carried out, except that on to the above adhesive layer, an application solution for the heat sensitive layer which solution made from acrylic resin (LR-269 made by Mitsubishi Rayon Co., Ltd.) 100 mass part, tetraethylene glycol diacrylate 50 mass part, light polymerization starter (IRGACURE 184 made by Ciba-Geigy) 2 mass part, polyester plasticizer (P-29 made by DIC) 25 mass part, stearyl stearate 40 mass part, eicosane diacid 8 mass part, and tetrahydro furan 180 mass part was applied, followed by heating-drying at 110° C. for 5 minutes, followed by UV irradiation at 120 W/cm.10 m/min, to thereby provide a heat sensitive layer having thickness about 10 μm. In this manner, the heat reversible recording medium of the comparative example 7 was prepared.

EXAMPLE 9

Preparation of Heat Reversible Recording Label

On a side (backface) of a supporter of the heat reversible recording medium prepared by the example 4, which side is free from the heat sensitive layer, an acrylic viscosity agent layer having thickness about 5 μm was provided. The above wraps up the preparation of the heat reversible recording label of the example 9.

EXAMPLE 10

Preparation and Evaluation of Heat Reversible Recording Member

On to the surface of the heat reversible recording medium prepared by the example 9, printing was carried out with UV ink (HAKURI OP (over print) varnish UP2 made by T & KToka). The resultant was cut into a form of card. Then, the print was displayed-recorded to the heat sensitive layer by using a recording apparatus having a recording-deleting unit (thermal head), with the thermal head's recording energy adjusted to the change of the heat reversible recording medium's recording energy, followed by visualization, to thereby carry out the recording-deleting. Moreover, rewritings of the displaying-recording were repeated 50 times, showing preferable recording-deleting.

EXAMPLE 11

Preparation and Evaluation of Heat Reversible Recording Member

The heat reversible recording label prepared by the example 9 was attached on to a cartridge of a mini disk (MD). Then, part of information (year, month, date, music title and the like) memorized in the MD was displayed-recorded to the heat sensitive layer by using a recording apparatus having a recording-deleting unit (thermal head), with the thermal head's recording energy adjusted to the change of the heat reversible recording medium's recording energy, followed by visualization, to thereby carry out the recording-deleting. Moreover, rewritings of the displaying-recording were repeated 50 times, showing preferable recording-deleting.

EXAMPLE 12

Preparation and Evaluation of Heat Reversible Recording Member

The heat reversible recording label prepared by the example 9 was attached on to a CD-RW, to thereby prepare an optical information recording medium having function of heat reversible display. With the above optical information recording medium, the following was carried out. Part of information (year, month, date, time and the like) memorized in a CD-RW drive (MP6200S made by Ricoh Company, Ltd.) was displayed-recorded to the heat sensitive layer by using a recording apparatus having a recording-deleting unit (thermal head), with the thermal head's recording energy adjusted to the change of the optical information recording medium's recording temperature, followed by visualization. Moreover, the CD-RW drive was used for rewriting the information of a memory layer of the optical information recording medium. Then, with the recording apparatus and using the deleting unit, the former recording was deleted, and then the thermal head was used for rewriting the thus rewritten information to the heat sensitive layer, to thereby carry out the displaying-recording. Moreover, the rewritings of the displaying-recording were repeated 50 times, showing preferable recording-deleting.

EXAMPLE 13

Heat Reversible Recording Member and Evaluation Thereof

The heat reversible recording label prepared by the example 9 was attached on to the tape cassette. Then, part of information (year, month, date, music title and the like) memorized in the tape cassette was displayed-recorded to the heat sensitive layer by using a recording apparatus having a recording-deleting unit (thermal head), with the thermal head's recording energy adjusted to the changes of the respective mediums' recording energy, followed by visualization, to thereby carry out the recording-deleting.

Moreover, rewritings of the displaying-recording were repeated 50 times, showing preferable recording-deleting.

Then, with the thus obtained heat reversible recording medium of each of the example 1 to the example 9 and the comparative example 1 to the comparative example 7, deleting property, transparency temperature width, glass transition temperature change, ammonia resistance, and repetition durability were measured in the following manner. Results are shown in Table 1-A, Table 1-B and Table 2.

<Deleting Property>

Figure 20:
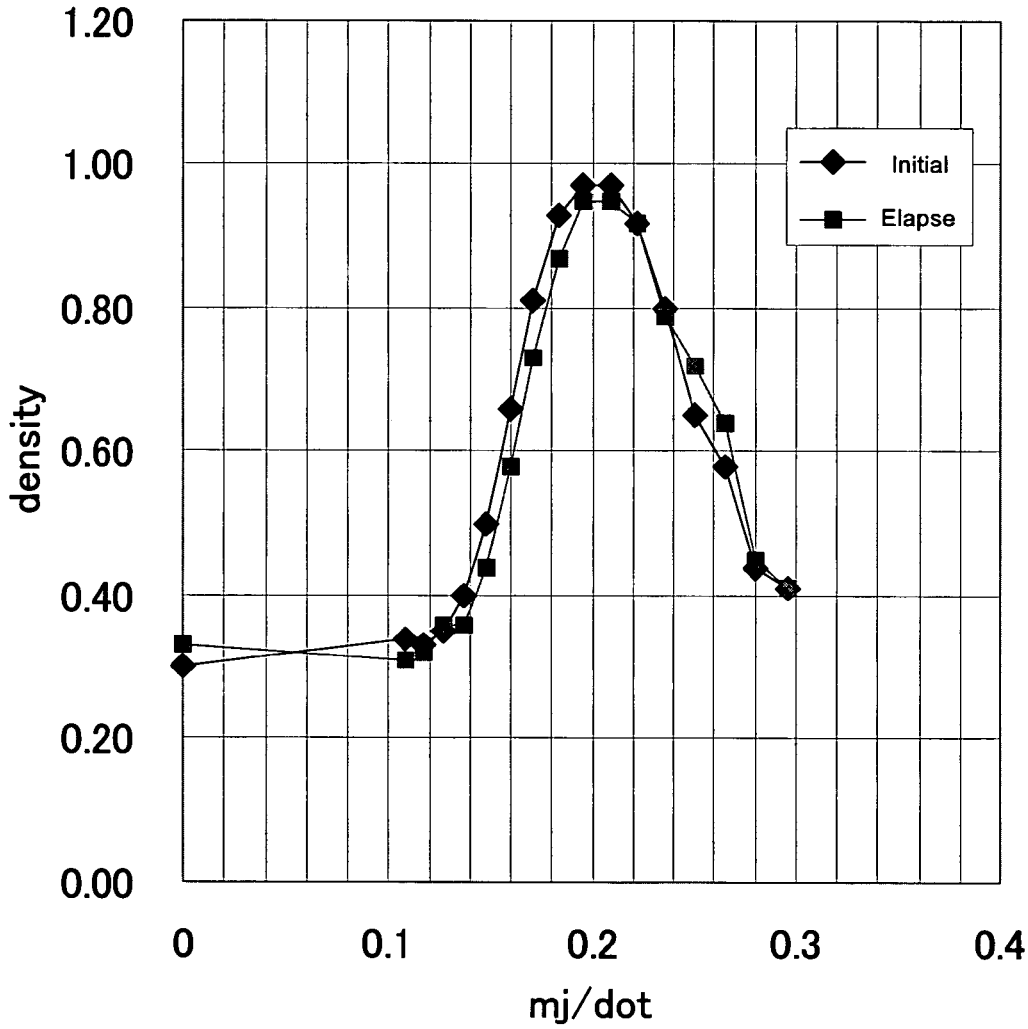
FIG. 20 is a graph showing a deleting energy relative to a deleting density, according to an example 7.
Figure 21:
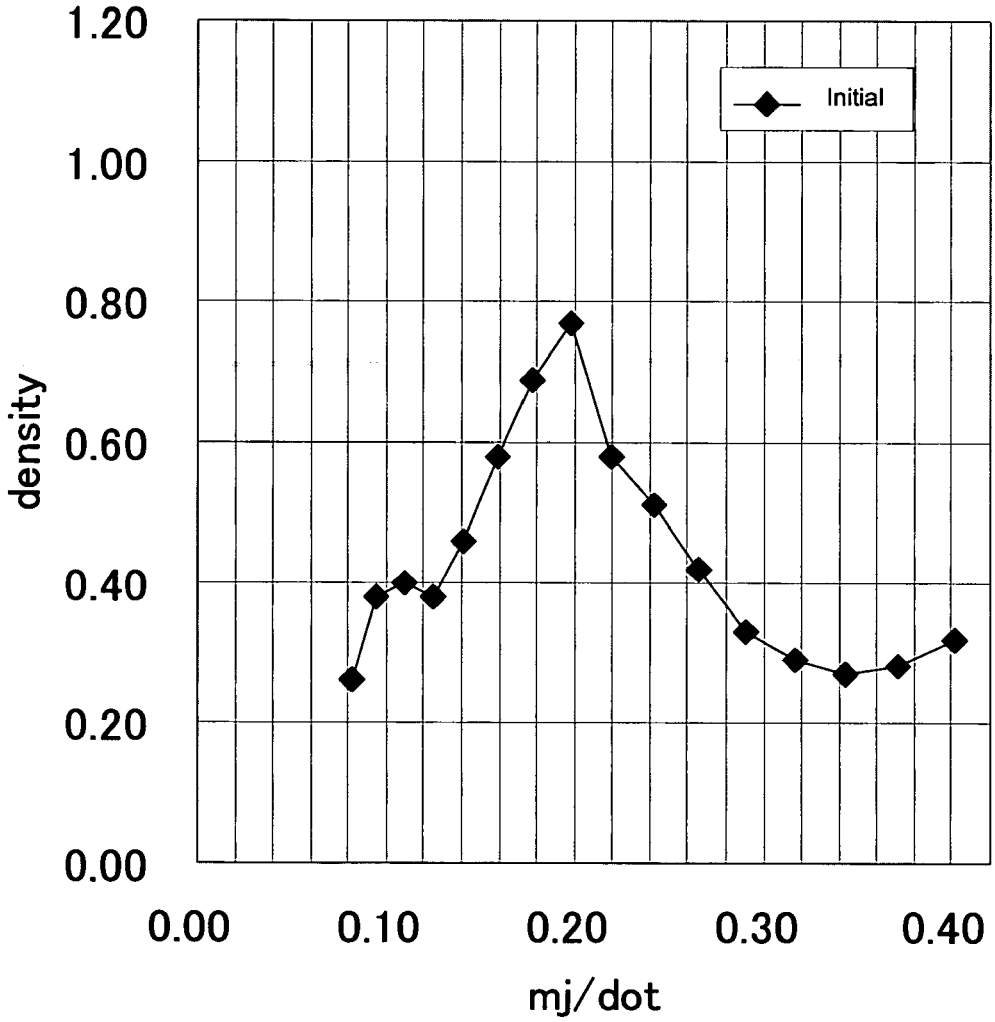
FIG. 21 is a graph showing a deleting energy relative to a deleting density, according to a comparative example 1.
Figure 22:
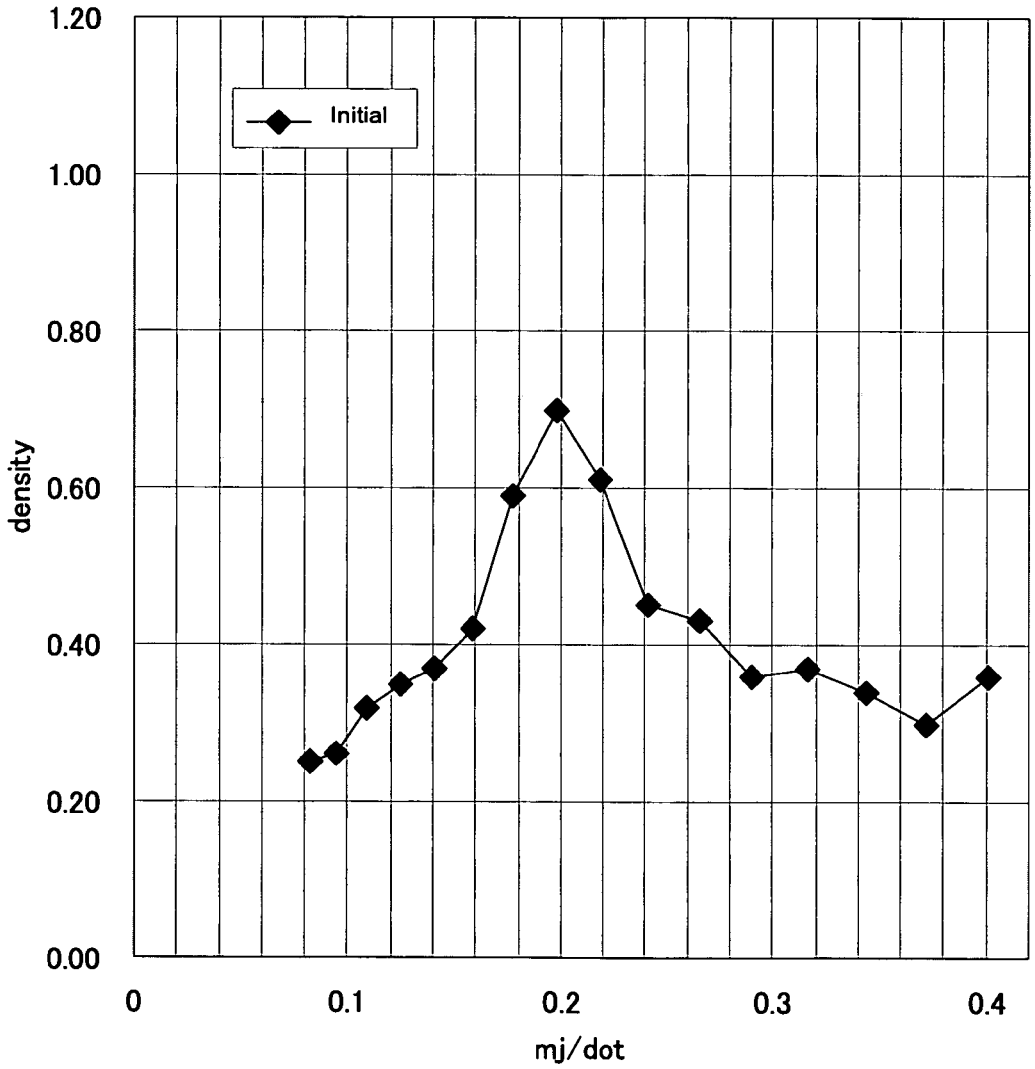
FIG. 22 is a graph showing a deleting energy relative to a deleting density, according to a comparative example 2.
Figure 23:
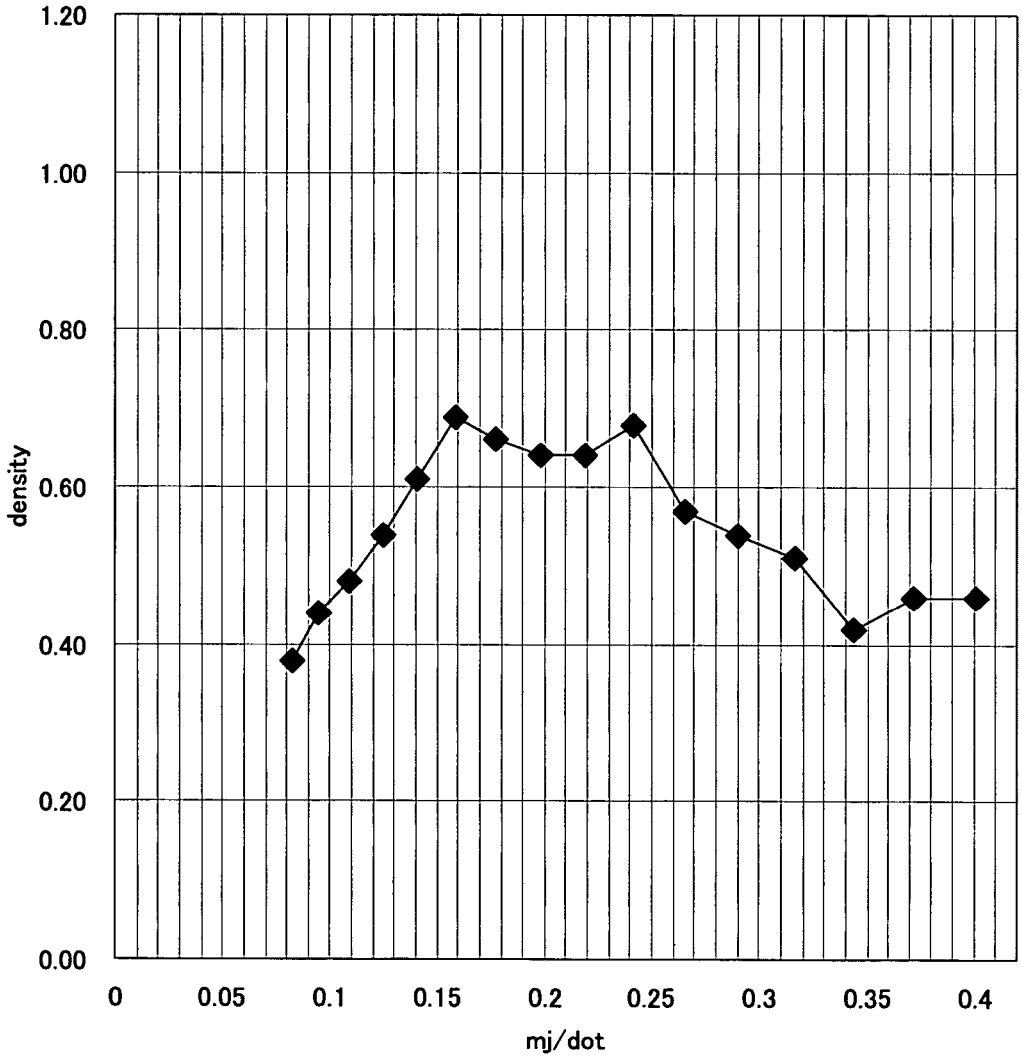
FIG. 23 is a graph showing a deleting energy relative to a deleting density, according to a comparative example 3.
Figure 24:
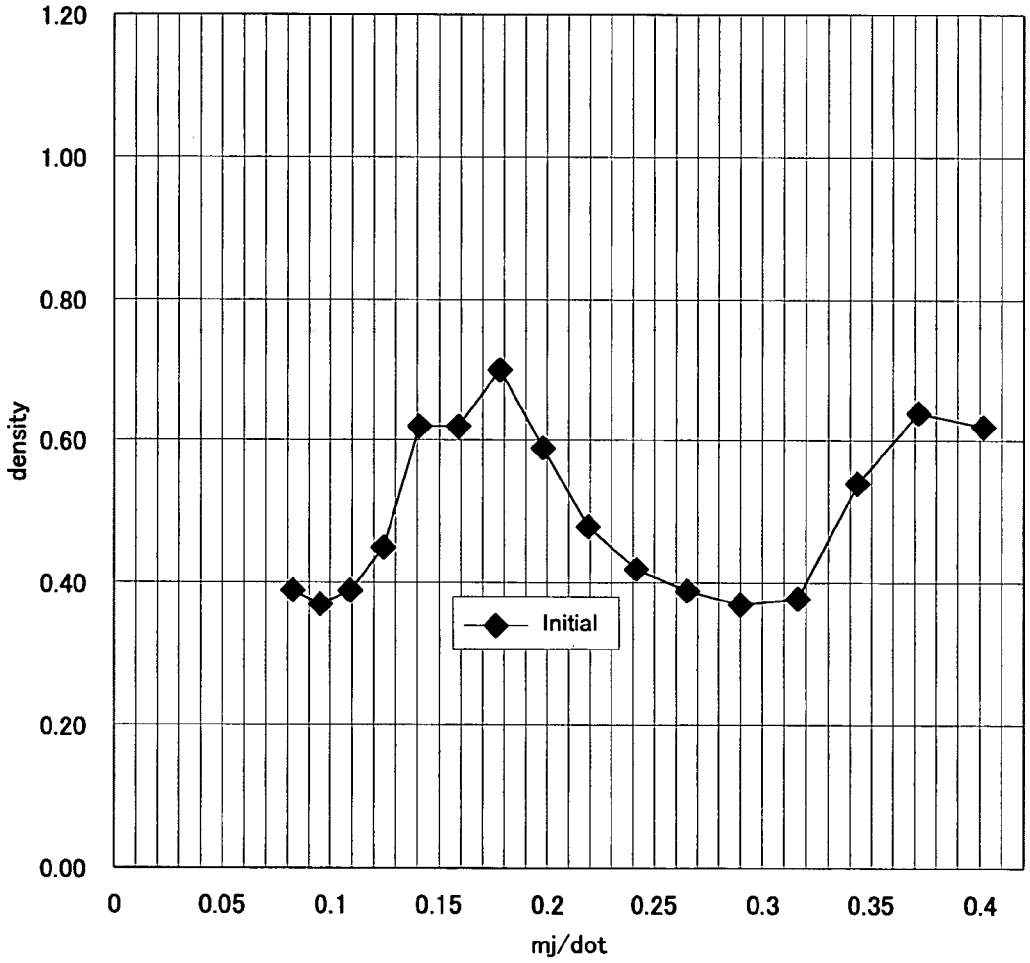
FIG. 24 is a graph showing a deleting energy relative to a deleting density, according to a comparative example 4.
Figure 25:
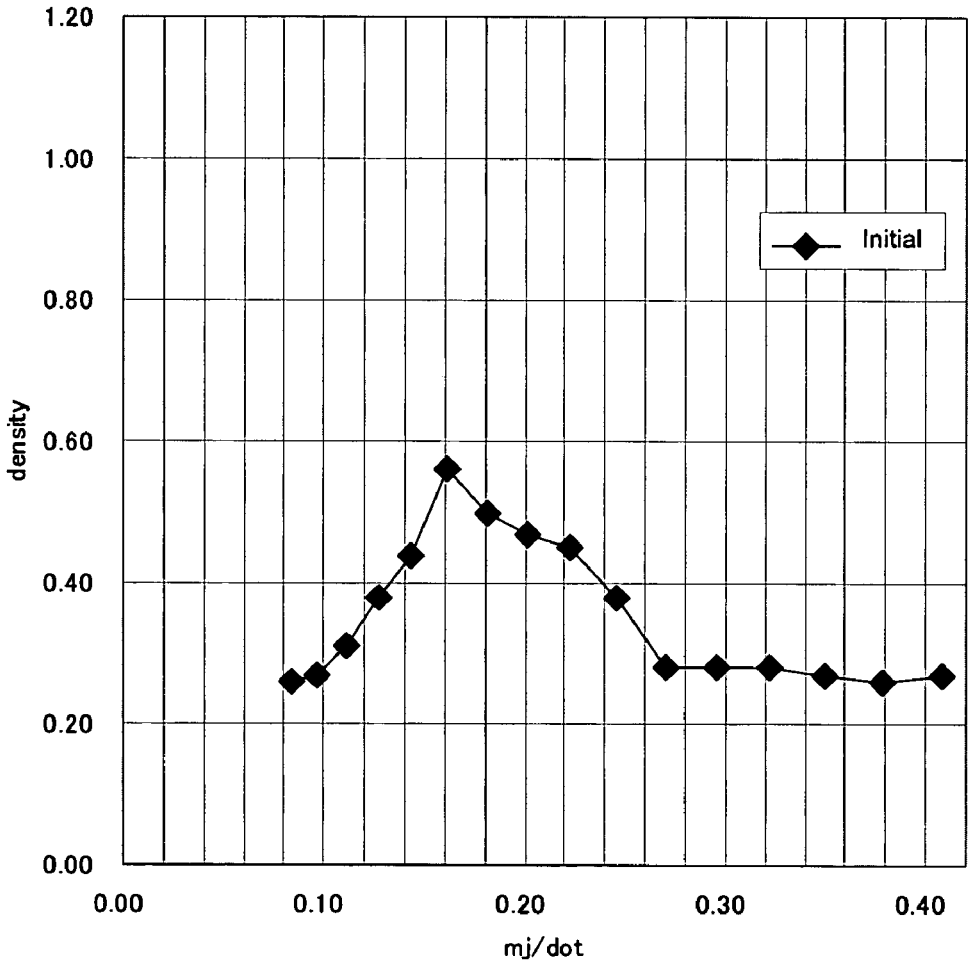
FIG. 25 is a graph showing a deleting energy relative to a deleting density, according to a comparative example 5.
Figure 26:
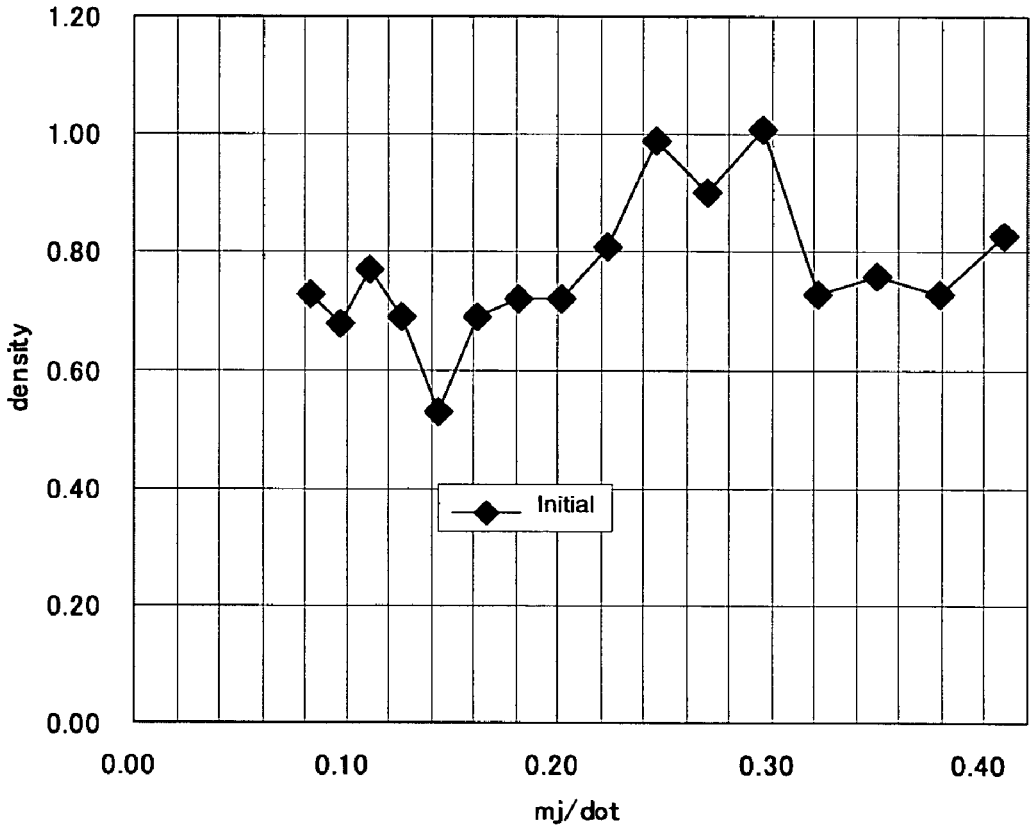
FIG. 26 is a graph showing a deleting energy relative to a deleting density, according to a comparative example 6.

A printing tester made by Hachijo Denki was used as a heat sensitive recording apparatus, and KBE-40-8M G K1 made by Kyocera Corporation was used as a thermal head, to thereby carry out white image formation, with pulse width 2.0 msec and an applied voltage 11.0 V. Soon after that, condition for printing by the thermal head was so set as to have line frequency 4.2 ms, pulse width 2.94 ms, and printing speed 29.76 mm/s. Then, an applied energy was properly changed in a range from 0.085 mj/dot to 0.30 mj/dot, to thereby carry out the transparency operation. Deleting density of each energy was measured with Macbeth RD-914 densitometer (made by Macbeth), to thereby obtain the deleting property. Like FIG. 3, the deleting density relative to the deleting energy was graphed, to thereby obtain the deletable energy range. Moreover, density of a part having the maximum transparency was defined as the maximum transparent density. The difference between the maximum transparent density and the texture's density was defined as an initial deleting property. Moreover, the difference between the texture's density and a density of the part same as that of the initial deleting property was defined as an elapsed time deleting property. Results of the example 1 to the example 6 are respectively shown in FIG. 14 to FIG. 19. Result of the example 7 is shown in FIG. 20. Results of the comparative example 1 to the comparative example 6 are respectively shown in FIG. 21 to FIG. 26. Moreover, the results are summed up in Table 1-A and Table 1-B.

<Transparency Temperature Width>

The transparency temperature width (ΔTw) was measured in the following manner. Each heat reversible recording medium was sufficiently whitened in advance. Then, each white heat reversible recording medium thus whitened was heated at various temperatures, so as to measure the temperature causing transparency. A heat slope tester (HG-100 made by TOYO SEIKI KOGYO CO., LTD.) was used for each heat reversible recording medium. The above heat slope tester has five heat blocks, each block being capable of setting temperature individually, and being capable of controlling heating time and pressure. In the thus set condition, the heat reversible recording mediums can be heated at five different temperatures at one time. Specifically, heating time is to be set at 1.0 sec., and pressure at heating is to be set at about 1.0 kg/cm$^2$. At an equal step of 1° C. to 5° C., the heating temperature was set from a low temperature causing no change in whiteness to a temperature causing sufficient whitening. After the heating, the heat reversible recording mediums were cooled to a normal temperature.

Figure 27:
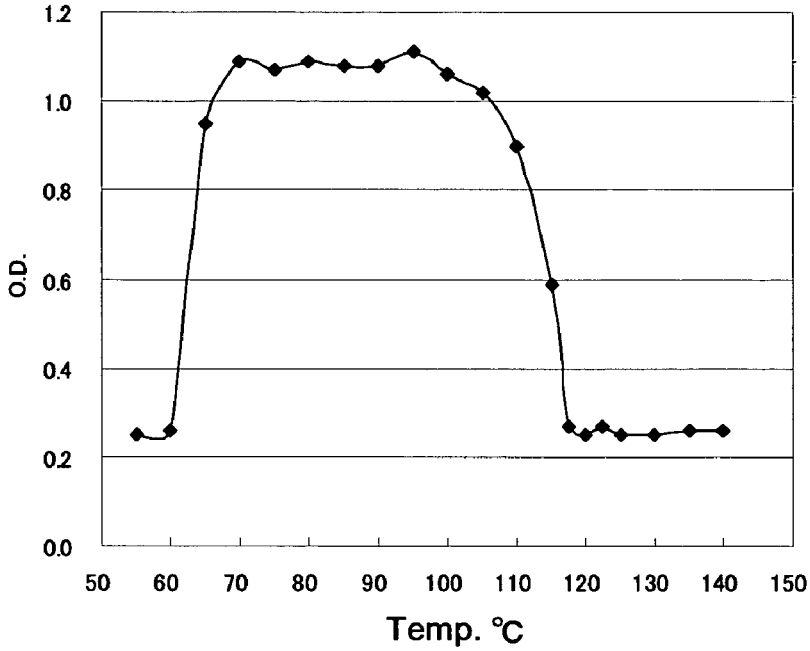
FIG. 27 is a graph showing a reflection density relative to a temperature, according to an example 7.
Figure 28:
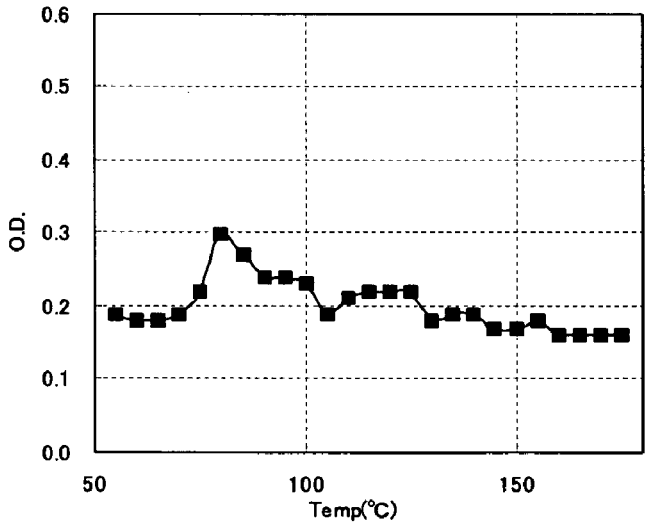
FIG. 28 is a graph showing a reflection density relative to a temperature, according to a comparative example 1.
Figure 29:
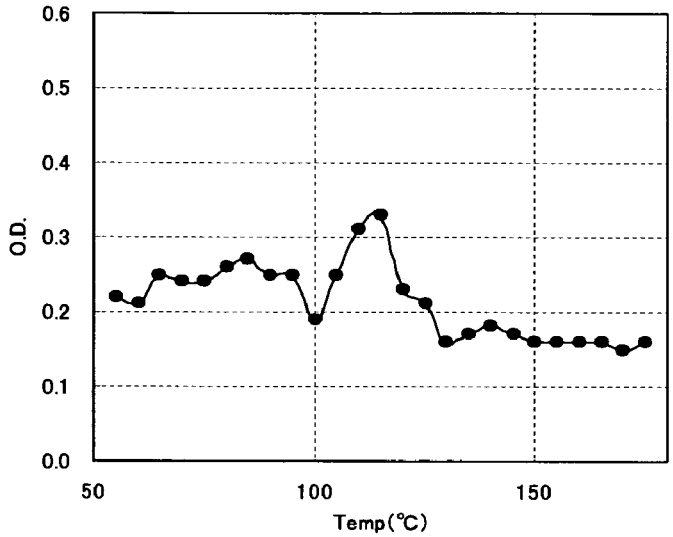
FIG. 29 is a graph showing a reflection density relative to a temperature, according to a comparative example 2.
Figure 30:
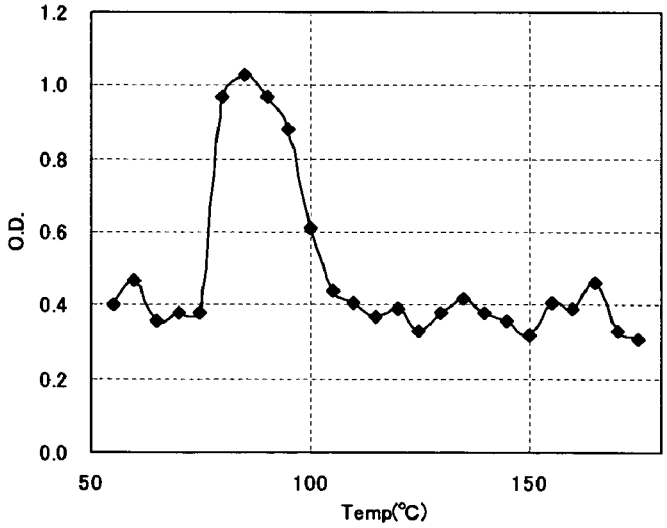
FIG. 30 is a graph showing a reflection density relative to a temperature, according to a comparative example 3.
Figure 31:
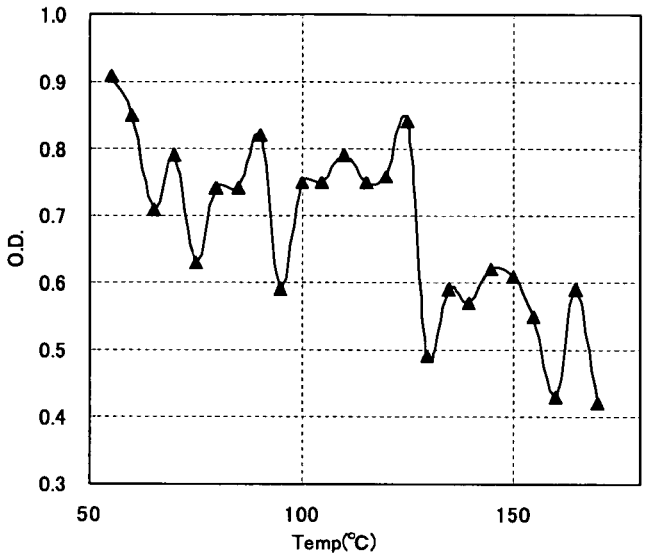
FIG. 31 is a graph showing a reflection density relative to a temperature, according to a comparative example 4.
Figure 32:
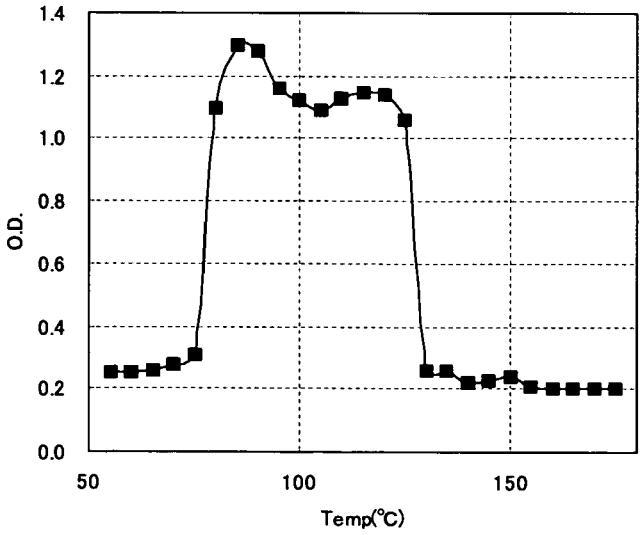
FIG. 32 is a graph showing a reflection density relative to a temperature, according to a comparative example 5.
Figure 33:
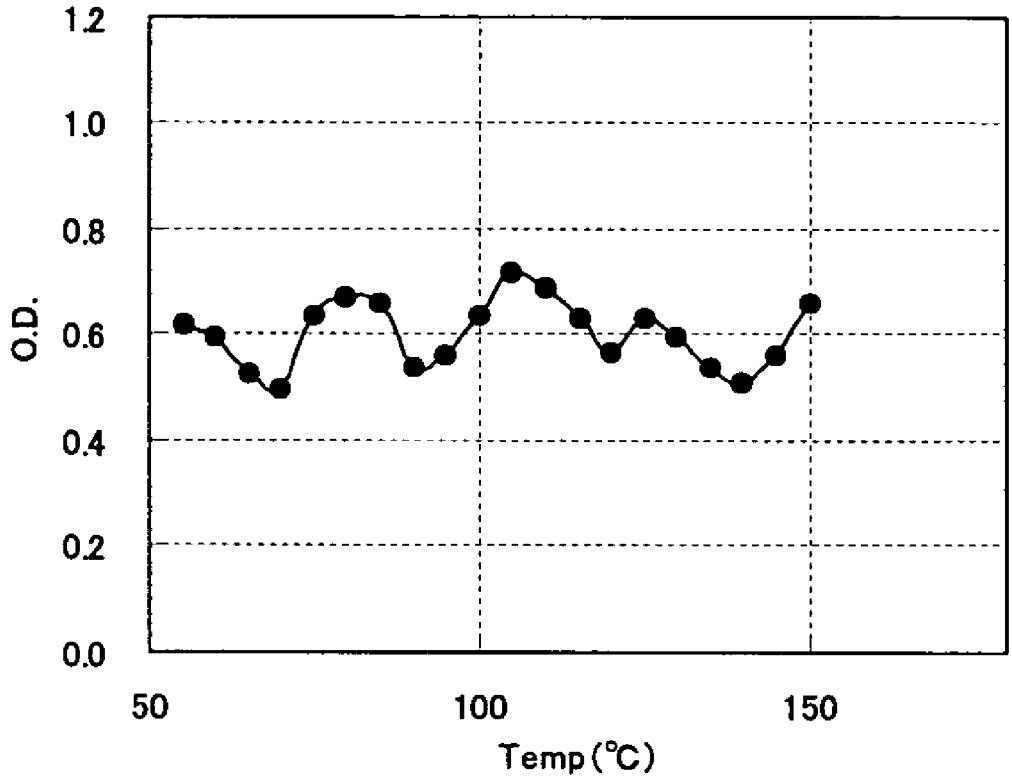
FIG. 33 is a graph showing a reflection density relative to a temperature, according to a comparative example 6.

Then, Macbeth RD-914 reflection densitometer (Made by Macbeth) was used for measuring the density of the part heated at respective temperatures, developing a graph having an abscissa denoting set temperature of the heat slope tester and an ordinate denoting reflection density. Like FIG. 3, the transparency temperature width was obtained. Result of the example 7 is shown in FIG. 27. Results of the comparative example 1 to the comparative example 6 are shown in FIG. 28 to FIG. 33. Moreover, the results are shown in Table 1-A and Table 1-B.

<Glass Transition Temperature Change>

DSC measurement was carried out with differential thermal layer scanning calorimeter 6200 (made by SII) for measuring a differential thermal analysis layer scanning heat. Samples of heat sensitive layers of the respective heat reversible recording mediums were measured by the following manner: the sample was applied to on an aluminum evaporation layer, then peeled by using dilute hydrofluoric acid, 3 mg to 6 mg of the sample was put in an aluminum cell for the DSC measurement. Aluminum oxide was used as a standard substance. Temperature increase rate was set at 15° C./min. The initial glass transition temperature (TgI) was measured after the sample put in the aluminum cell for the DSC measurement was heated for 5 minutes in a homoiothermal bath to 130° C. and thereafter was left at rest at room temperature (23° C.) for 30 minutes. DSC curve shown from the above was defined as glass transition temperature. The glass transition temperature obtained through the following steps was defined as an elapsed time glass transition temperature (Tga): heating the sample at 130° C. for 5 minutes, then sufficiently cooling the sample at room temperature, then storing the sample at an atmospheric temperature 35° C. for 1 week.

<Ammonia Resistance>

Transparency Temperature Range Test

In the example 5, the example 8 and the comparative example 2, and the comparative example 5, the transparency temperature range of the respective heat reversible recording mediums before test, and the transparency temperature range of the respective heat reversible recording mediums after being dipped in 8% by mass ammonium carbonate solution for 48 hours were measured in the above measurement methods. Then, the evaluation was carried out based on the following criteria.

[Evaluation Criteria]

Acceptable: No change

Not acceptable: Great change

Image Density Change Test

In the example 5 and the example 7, an image density obtained by whitening the respective heat reversible recording mediums which are not dipped in base substance was defined as an initial image. With the initial image, the measurement was carried out in the following manner. The heat reversible recording medium was dipped in 8% by mass ammonium carbonate solution, with dipping time varied from 10 minutes, 30 minutes, one hour, 6 hours. After the above dipping, the heat reversible recording medium was whitened with the same energy, to thereby measure the image density.

<Repetition Durability>

In the example 7 and the example 8, the respective heat reversible recording mediums were subjected to repeated printings-deletings with a thermal head. The number of changes of the image density evaluation by 0.5 or more was compared. Herein, the evaluation was carried out on up to the maximum 500 repetitions of printings-deletings.

TABLE 1-A

| | Deleting property energy width (%) | | Transparency temp. width | Texture | Whitening | Initial glass trans. temp. | Elapsed time glass trans. | Glass trans temp. | Repetition durability |
|---|---|---|---|---|---|---|---|---|---|
| | Initial | Elapsed time | (° C.) | density | density | (° C.) | temp. (° C.) | change (° C.) | (times) |
| Example 1 | 37.5 | 37.3 | 53.0 | 0.95 | 0.4 | 48.9 | 42.6 | −6.3 | Not available |
| Example 2 | 27.1 | 27.1 | 53.0 | 1.0 | 0.38 | 42.5 | 36.8 | −5.7 | Not available |
| Example 3 | 47.2 | 53.2 | 53.0 | 0.96 | 0.5 | 41.9 | 39.3 | −2.6 | Not available |
| Example 4 | 50.4 | 46 | 53.0 | 0.9 | 0.35 | 45.2 | 43.1 | −2.1 | Not available |
| Example 5 | 43.13 | 44.27 | 53.0 | 0.92 | 0.35 | 39.2 | 39.5 | 0.3 | Not available |
| Example 6 | 38.5 | 30.85 | 53.0 | 0.85 | 0.37 | 41.9 | 40.0 | −1.9 | Not available |
| Example 7 | 14.47 | 12.32 | 43.7 | 0.98 | 0.31 | 34.9 | 37.9 | 3.0 | 500 |
| Example 8 | 17.35 | 0 | 44.1 | 1.12 | 0.45 | 37.5 | 41.6 | 4.1 | 27 |

TABLE 1-B

| | Deleting property energy width (%) | | Transparency temp. width | Texture | Whitening | Initial glass trans. temp. | Elapsed time glass trans. | Glass trans temp. | Repetition durability |
|---|---|---|---|---|---|---|---|---|---|
| | Initial | Elapsed time | (° C.) | density | density | (° C.) | temp. (° C.) | change (° C.) | (times) |
| Comp. example 1 | 3.02 | 0 | 7.1 | 0.77 | 0.23 | 38.7 | 38.9 | 0.2 | Not available |
| Comp. example 2 | 19.4 | 0 | 8.1 | 0.7 | 0.22 | 32.2 | 32.2 | 0 | Not available |
| Comp. example 3 | 0 | 0 | 16.3 | 0.95 | 0.23 | 42.1 | 43.7 | 1.6 | Not available |
| Comp. example 4 | 5.68 | 0 | 20.6 | 0.84 | 0.32 | 39.3 | 38.5 | −0.8 | Not available |
| Comp. example 5 | 0 | 0 | 44.5 | 1.14 | 0.28 | 45.56 | 53.8 | 8.24 | Not available |
| Comp. example 6 | 0 | 0 | 41.1 | 1.1 | 0.3 | Not available | Not available | 9.5 | Not available |
| Comp. example 7 | 14.29 | 0 | 0 | 1.01 | 0.45 | 39.3 | 35.3 | −4 | Not available |

TABLE 2

| | Ammonia resistance | | | | | |
|---|---|---|---|---|---|---|
| | | Image density change | | | | |
| | Transparency temp. width | Initial | After 10 minutes | After 30 minutes | After 1 hour | After 6 hours |
| Example 5 | Not acceptable | 0.35 | 0.84 | 0.93 | 0.98 | 0.98 |
| Example 7 | Acceptable | 0.31 | 0.31 | 0.32 | 0.32 | 0.32 |
| Comp. example 2 | Not acceptable | Not available | Not available | Not available | Not available | Not available |
| Comp. example 5 | Not acceptable | Not available | Not available | Not available | Not available | Not available |

What is claimed is:

1. A heat reversible recording medium, comprising:

a heat sensitive layer which comprises a resin and an organic low molecular compound, and has a transparency which is reversibly variable depending on a temperature, wherein the heat sensitive layer has a glass transition temperature change of −10° C. to 5° C., and a transparency temperature width of 30° C. or more.

2. A heat reversible recording medium according to claim 1, wherein the resin comprises an acrylic resin, and the heat sensitive layer has a transparency temperature width of 40° C. or more.

3. The heat reversible recording medium according to claim 1, wherein a glass transition temperature of the heat sensitive layer is 30 to 70° C.

4. The heat reversible recording medium according to claim 1, wherein the resin comprises an acrylic resin.

5. The heat reversible recording medium according to claim 1, wherein the resin comprises an acrylic polyol resin.

6. The heat reversible recording medium according to claim 1, wherein the resin comprises an acrylic polyol resin which is cross-linked by an isocyanate compound.

7. The heat reversible recording medium according to claim 6, wherein an addition of the isocyanate compound is 1 mass part to 50 mass part relative to 100 mass part of the acrylic polyol resin.

8. The heat reversible recording medium according to claim 1, wherein the organic low molecular compound is a carboxyl group non-containing-compound.

9. The heat reversible recording medium according to claim 8, wherein the carboxyl group non-containing-compound is selected from the group consisting of a fatty acid ester, a dibasic acid ester and a polyvalent alcohol di-fatty acid ester.

10. The heat reversible recording medium according to claim 1, wherein a deleting energy width for deleting an image soon after the image is formed is 20% to 80%, which is obtained by the following equation:

$$\text{deleting energy width (\%)}=[(E_2-E_1)/E_c]\times 100$$

wherein $E_1$ denotes a lower limit (mj/dot) of a deleting energy, $E_2$ denotes an upper limit (mj/dot) of the deleting energy, and $E_c$ denotes a center value of the deleting energy which is expressed by $(E_1+E_2)/2$ (mj/dot).

11. The heat reversible recording medium according to claim 1, wherein a deleting energy width for deleting an image with an elapsed time after the image is formed is 20% to 80%, which is obtained by the following equation:

$$\text{deleting energy width (\%)}=[(E_2-E_1)/E_c]\times 100$$

wherein $E_1$ denotes a lower limit (mj/dot) of a deleting energy, $E_2$ denotes an upper limit (mj/dot) of the deleting energy, and $E_c$ denotes a center value of the deleting energy which is expressed by $(E_1+E_2)/2$ (mj/dot), and a deleting energy width change ratio with elapsed time is 12% or less.

12. The heat reversible recording medium according to claim 1, wherein the heat reversible recording medium comprises a supporter.

13. A heat reversible recording medium, comprising:

a heat sensitive layer which comprises a resin and an organic low molecular compound, and has a transparency which is reversibly variable depending on a temperature, wherein the resin comprises an acrylic polyol resin, and the heat sensitive layer has a glass transition temperature change of −10° C. to 5° C.

14. The heat reversible recording medium according to claim 13, wherein the acrylic polyol resin has a glass transition temperature Tg in a range of 30° C. to 60° C. obtained by the following expression:

$$1/Tg=\Sigma(Wi/Tgi)$$

wherein Wi denotes a mass ratio of a monomer i, Tgi denotes a glass transition temperature (K) of a homopolymer of the monomer i.

15. The heat reversible recording medium according to claim 13, wherein a hydroxyl value of the acrylic polyol resin is 20 mgKOH/g to 130 mgKOH/g.

16. The heat reversible recording medium according to claim 13, wherein the acrylic polyol resin has a refractive index of 1.45 to 1.60.

17. The heat reversible recording medium according to claim 13, wherein the acrylic polyol resin has a weight average molecular weight of 20,000 to 100,000.

18. A heat reversible recording medium, comprising:

a heat sensitive layer which comprises a resin and an organic low molecular compound, and has a transparency which is reversibly variable depending on a temperature, wherein the resin comprises an acrylic polyol resin, and the heat sensitive layer has a transparency temperature width of 30° C. or more.

19. The heat reversible recording medium according to claim 18, wherein the acrylic polyol resin has a glass transition temperature Tg in a range of 30° C. to 60° C. obtained by the following expression:

$$1/Tg=\Sigma(Wi/Tgi)$$

wherein Wi denotes a mass ratio of a monomer i, Tgi denotes a glass transition temperature (K) of a homopolymer of the monomer i.

20. The heat reversible recording medium according to claim 18, wherein a hydroxyl value of the acrylic polyol resin is 20 mgKOH/g to 130 mgKOH/g.

21. The heat reversible recording medium according to claim 18, wherein the acrylic polyol resin has a refractive index of 1.45 to 1.60.

22. The heat reversible recording medium according to claim 18, wherein the acrylic polyol resin has a weight average molecular weight of 20,000 to 100,000.

23. A heat reversible recording label, comprising:

a heat reversible recording medium having a first face which is formed with an image and a second face opposite to the first face; and one of an adhesive layer and a viscosity layer on the second face of the heat reversible recording medium, wherein the heat reversible recording medium comprises:

a heat sensitive layer which comprises a resin and an organic low molecular compound, and has a transparency which is reversibly variable depending on a temperature, wherein the heat sensitive layer has a glass transition temperature change of −10° C. to 5° C., and a transparency temperature width of 30° C. or more.

24. A heat reversible recording member, comprising:

an information memorizing part; and a reversible displaying part which comprises a heat reversible recording medium which comprises:

a heat sensitive layer which comprises a resin and an organic low molecular compound, and has a transparency which is reversibly variable depending on a temperature, wherein the heat sensitive layer has a glass transition temperature change of −10° C. to 5° C., and a transparency temperature width of 30° C. or more.

25. The heat reversible recording member according to claim 24, wherein the information memorizing part and the reversible displaying part are united.

26. The heat reversible recording member according to claim 24, wherein the heat reversible recording member is selected from the group consisting of a card, a disk, a disk cartridge and a tape cassette.

27. An image processor, comprising:

at least one of:

an image forming unit configured to form an image on a heat reversible recording medium, by heating the heat reversible recording medium; and an image deleting unit configured to delete the image formed on the heat reversible recording medium, by heating the heat reversible recording medium, wherein the heat reversible recording medium comprises:

a heat sensitive layer which comprises a resin and an organic low molecular compound, and has a transparency which is reversibly variable depending on a temperature, wherein the heat sensitive layer has a glass transition temperature change of −10° C. to 5° C., and a transparency temperature width of 30° C. or more.

28. The image processor according to claim 27, wherein the image forming unit is a thermal head.

29. The image processor according to claim 27, wherein the image deleting unit is one of a thermal head and a ceramic heater.

30. An image processing method, comprising:

at least one of:

forming an image on a heat reversible recording medium, by heating the heat reversible recording medium; and deleting the image formed on the heat reversible recording medium, by heating the heat reversible recording medium, wherein the heat reversible recording medium comprises:

a heat sensitive layer which comprises a resin and an organic low molecular compound, and has a transparency which is reversibly variable depending on a temperature, wherein the heat sensitive layer has a glass transition temperature change of −10° C. to 5° C., and a transparency temperature width of 30° C. or more.

31. The image processing method according to claim 30, wherein the forming of the image is carried out with a thermal head.

32. The image processing method according to claim 30, wherein the deleting of the image is carried out with one of a thermal head and a ceramic heater.

33. The image processing method according to claim 30, wherein the image is deleted with a thermal head while another image is formed.

* * * * *